US008348377B2

(12) United States Patent
Asauchi

(10) Patent No.: US 8,348,377 B2
(45) Date of Patent: Jan. 8, 2013

(54) STORAGE DEVICE, BOARD, LIQUID CONTAINER, METHOD OF RECEIVING DATA WHICH ARE TO BE WRITTEN IN DATA STORAGE UNIT FROM HOST CIRCUIT, AND SYSTEM INCLUDING STORAGE DEVICE WHICH IS ELECTRICALLY CONNECTABLE TO HOST CIRCUIT

(75) Inventor: Noboru Asauchi, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 45 days.

(21) Appl. No.: 13/113,859

(22) Filed: May 23, 2011

(65) Prior Publication Data

US 2011/0292102 A1 Dec. 1, 2011

(30) Foreign Application Priority Data

May 25, 2010 (JP) ..... 2010-118937

(51) Int. Cl.
*B41J 29/393* (2006.01)

(52) U.S. Cl. ..... 347/19; 347/14; 347/5

(58) Field of Classification Search ..... 347/5, 9, 347/10, 14, 19, 20, 23, 40, 42
See application file for complete search history.

(56) References Cited

U.S. PATENT DOCUMENTS 5,506,611 A * 4/1996 Ujita et al. ..... 347/19
5,929,885 A 7/1999 Nakajima et al.
6,984,012 B2 1/2006 Asauchi
7,321,436 B2 1/2008 Asauchi
7,590,026 B2 9/2009 Asauchi
7,660,008 B2 2/2010 Asauchi
7,697,372 B2 4/2010 Asauchi
7,925,843 B2 4/2011 Ueno et al.
2002/0016893 A1 2/2002 Asauchi
2002/0024559 A1 2/2002 Murray et al.
2002/0057319 A1 5/2002 Saruta et al.
2002/0173825 A1 11/2002 Thompson
2002/0191041 A1 12/2002 Asauchi
2005/0071725 A1 3/2005 Gibart
2006/0069851 A1 3/2006 Chung et al.
2007/0043898 A1 2/2007 Ozeki et al.

(Continued)

FOREIGN PATENT DOCUMENTS

CN 1332412 A 1/2002

(Continued)

OTHER PUBLICATIONS

Anonymous, "The I2C-bus specification Version 2.1". Philips Semiconductors. Product Specification. Jan. 1, 2000, pp. 1-46.

(Continued)

*Primary Examiner* — Juanita D Jackson
(74) *Attorney, Agent, or Firm* — Kilpatrick Townsend & Stockton LLP

(57) ABSTRACT

A storage device electrically connected to a host circuit includes a data receiving unit, determination unit, and a data transmitting unit. The data receiving unit receives data including first data which are to be written in a memory array and second data which are generated based on the first data from the host circuit. The determination unit determines consistency between the first data and the second data. The data transmitting unit transmits a result of the determination to the host circuit.

12 Claims, 21 Drawing Sheets

U.S. PATENT DOCUMENTS

| | | | |
|---|---|---|---|
| 2007/0104327 | A1 | 5/2007 | Macri et al. |
| 2007/0250659 | A1 | 10/2007 | Booth et al. |
| 2008/0106757 | A1 | 5/2008 | Asauchi |
| 2008/0201538 | A1 | 8/2008 | Furuichi et al. |
| 2008/0310070 | A1 | 12/2008 | Wegman |
| 2009/0073762 | A1 | 3/2009 | Lee et al. |
| 2009/0265602 | A1 | 10/2009 | Nakano |
| 2009/0276688 | A1 | 11/2009 | Yoshida |
| 2009/0287891 | A1 | 11/2009 | Nakano |
| 2010/0257305 | A1 | 10/2010 | Asauchi |
| 2010/0257327 | A1 | 10/2010 | Kosugi |

FOREIGN PATENT DOCUMENTS

| | | | |
|---|---|---|---|
| EP | 1 316 428 | A1 | 6/2003 |
| EP | 1 389 528 | A1 | 2/2004 |
| EP | 1 767 369 | A2 | 3/2007 |
| JP | 02-068642 | A | 3/1990 |
| JP | 06-226989 | A | 8/1994 |
| JP | 06-303222 | A | 10/1994 |
| JP | 10-247899 | A | 9/1998 |
| JP | 2001-146030 | A | 5/2001 |
| JP | 2002-370383 | A | 12/2002 |
| JP | 2003-112431 | A | 4/2003 |
| JP | 2004-074464 | A | 3/2004 |
| JP | 2004-299405 | A | 10/2004 |
| JP | 2009-259225 | A | 11/2009 |
| WO | WO 00/60476 | A1 | 10/2000 |
| WO | WO 2005/094455 | A2 | 10/2005 |
| WO | WO 2009/018054 | A2 | 2/2009 |

OTHER PUBLICATIONS

Partial European Search Report mailed on Sep. 19, 2011, in European Patent Application No. 11167416.4, for Seiko Epson Corporation.

* cited by examiner

STORAGE DEVICE, BOARD, LIQUID CONTAINER, METHOD OF RECEIVING DATA WHICH ARE TO BE WRITTEN IN DATA STORAGE UNIT FROM HOST CIRCUIT, AND SYSTEM INCLUDING STORAGE DEVICE WHICH IS ELECTRICALLY CONNECTABLE TO HOST CIRCUIT

BACKGROUND

1. Technical Field

The invention relates to a storage device, a circuit board having a storage device, a liquid container, a method of receiving data which are to be written in a data storage unit from a host circuit, and a system including a storage device which is electrically connectable to a host circuit.

2. Related Art

In general, an ink container which is a detachable liquid container is attached to an ink jet type printing apparatus as an example of a liquid ejecting apparatus. Some types of ink containers are provided with a storage device. The storage device stores, for example, various types of information such as a remaining ink amount in the ink container or an ink color (JP-A-2002-370383 and JP-A-2004-299405). A control unit provided to the printing apparatus communicates with the storage device of the ink container. JP-A-2001-146030, JP-A-6-226989, and JP-A-2003-112431 are examples of the related art.

However, in the related art, reliability of communication between the control unit provided to the printing apparatus and the storage device of the ink container is not sufficiently considered. For example, due to defective contact at electrical connection portion between the printing apparatus and the ink container, a failure may occur in communication between the control unit provided to the printing apparatus and the storage device of the ink container. If the printing control unit is continuously operated in the state of the communication failure, there may be a problem such as occurrence of an error in the stored contents of the storage device. This problem is not limited to the storage device provided to the ink container, but the problem is common to the storage device electrically connected to a host circuit.

SUMMARY

An advantage of some aspects of the invention is to improve reliability of communication between a storage device electrically connected to a host circuit and the host circuit.

The invention may be implemented as the following aspects or applications in order to solve at least a portion of the aforementioned problems.

Application 1

There is provided a storage device electrically connected to a host circuit, including: a non-volatile data storage unit; a data receiving unit which receives data including first data which are to be written in the data storage unit and second data which are generated based on the first data from the host circuit; a determination unit which determines consistency of the data received by the data receiving unit; a data transmitting unit which transmits a result of the determination to the host circuit, wherein the determination unit determines whether or not the first and second data are consistent with each other, wherein in the case where an affirmative determination result is obtained by the determination unit, (1) in the case where writing data in the data storage unit is completed, the data transmitting unit transmits the affirmative determination result to the host circuit, and wherein (2) in the case where the writing data in the data storage unit is not completed, the data transmitting unit does not transmit the affirmative determination result to the host circuit.

According to the storage device of Application 1, since the consistency between the first data and the second data is determined and the determination result is transmitted to the host circuit, the host circuit may communicate with the storage device while checking the existence of a communication error. As a result, it is possible to improve reliability of communication between the host circuit and the storage device. In the case where the writing of data in the data storage unit is completed, since the affirmative determination result is transmitted to the host circuit, it is possible to reliably perform data transmission and data writing with respect to the data storage unit.

Application 2

There is provided the storage device according to Application 1, wherein the second data are inverted data of the first data, wherein, at the time of a writing process from the host circuit to the storage device, the data receiving unit receives identification data for designating one storage device among a plurality of the storage devices, inverted identification data, write command data, inverted write command data, a first set of the first data and the second data having a predetermined size in this order from the host circuit, and after that, the data receiving unit repetitively receives a second set and the following sets of the first data and the second data having the predetermined size set by set, wherein (i) after the reception of the identification data is started until the reception of the first set of the first data and the second data is completed, the data transmitting unit does not transmit the result of determination unit to the host circuit, and after the reception of the first set of the first data and the second data having a predetermined size is completed, the data transmitting unit transmits the result of determination unit to the host circuit, and wherein (ii), with respect to the second set and the following sets of the first data and the second data having the predetermined size, every time when the reception of each of the sets is completed, the data transmitting unit transmits the result of determination unit to the host circuit.

According to this configuration, since the storage device transmits the result of the consistency determination to the host circuit every time when one set of the first data and the second data having a predetermined size is received, it is possible to improve reliability of communication between the host circuit and the storage device. In addition, in the initial stage of the writing process, since the result of determination is not transmitted to the host circuit after the reception of the identification data is started until the reception of the first set of the first data and the second data is completed, it is possible to reduce the number of times of transmission of the result of determination from the storage device to the host circuit, so that it is possible to efficiently perform the whole of the writing process.

Application 3

There is provided the storage device according to Application 2, wherein each of the first and second data includes a parity bit, and wherein, only in the case where the first and second data have a relationship of inversion therebetween and there is no parity error in the first and second data, the determination unit generates the affirmative determination result.

According to this configuration, it is possible to further improve reliability of communication between the host circuit and the storage device.

Application 4

There is provided the storage device according to Application 1, wherein a data amount of the first data is equal to a data amount of the second data.

Accordingly, since the first data and the second data have the same data amount, it is possible for the host circuit to more accurately determine the consistency.

Application 5

There is provided the storage device according to Application 4, further including a read/write controller which writes the first data in the data storage unit in the case where the determination result is affirmative and which does not write the first data in the data storage unit in the case where the determination result is negative.

Accordingly, in the case where there is a communication error, since the first data are not written in the data storage unit, it is possible to suppress the data storage unit from performing erroneous updating.

Application 6

There is provided the storage device according to Application 4 or 5, wherein the first data and the second data are n-bit signals (n is an integer of 1 or more), and wherein the second data is inverted data which are obtained by inverting a value of each bit of the first data.

Accordingly, the second data transmitted from the host circuit are the inverted data of the first data. Therefore, for example, in the case where the signals received by the storage device have the same value in the first data and the second data due to a communication error, it is possible to reliably detect the communication error.

Application 7

There is provided the storage device according to Application 6, where the data receiving unit serially receives the first data and the second data in synchronization with a clock signal supplied from the host circuit, and wherein the data transmitting unit transmits the result of the determination to the host circuit in a time period of the next clock signal pulse of a clock signal pulse for receiving the last data among the first data and the second data.

Accordingly, just after the transmission of the first data and the second data, the host circuit may recognize the result of the determination. Therefore, in the case where the result of the determination is negative, the host circuit may rapidly take a measure such as re-transmission of data.

Application 8

There is provided the storage device according to Application 6, wherein, in the case where a result of Exclusive OR operation between an m-th value of the first data (m is an integer of 1 or more and n or less) and an m-th value of the second data is TRUE with respect to all n bits, the determination unit determines that the determination result is affirmative, and wherein, in the case where the result of the Exclusive OR operation is FALSE with respect to any one of the n bits, the determination unit determines that the determination result is negative.

Accordingly, by calculating the Exclusive OR operation, it is possible to easily determine the existence of a communication error.

Application 9

There is provided the storage device according to Application 6, wherein n is an even number, wherein the data receiving unit receives upper n/2 bits of the first data, upper n/2 bits of the second data, lower n/2 bits of the first data, and lower n/2 bits of the second data in this order in synchronization with a clock signal, and wherein the data transmitting unit transmits the determination result in a time period of the next clock signal pulse of a clock signal pulse in which a lowermost bit of the lower n/2 bits of the second data is received.

Accordingly, whenever 2n-bit data are received, the determination result is transmitted. Therefore, since communication may be performed while checking the existence of a communication error in units of 2n bits, it is possible to further improve reliability of communication.

Application 10

There is provided the storage device according to any one of Applications 4 to 9, wherein the host circuit and the storage device are electrically connected through a circuit-side terminal electrically connected to the host circuit and a storage-device-side terminal electrically connected to the storage device.

Accordingly, by detecting the occurrence of a communication error due to defective contact between the storage-device-side terminal and the circuit-side terminal, it is possible to improve reliability of communication between the host circuit and the storage device.

The invention may be implemented in various aspects. For example, the aspects includes a board which may be connected to the liquid ejecting apparatus, a liquid container which may be attached to the liquid ejecting apparatus, a method of receiving data which are to be written in the data storage unit from the host circuit, a system including a host circuit and a storage device which is detachable from the host circuit, a liquid ejecting system, a computer program for implementing functions of the method or the apparatus, a recording medium recording the computer program, or the like. In addition, in this specification, the "recording medium" denotes an actual recording medium such as a DVD or a hard disk drive.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in the following order.

A. Configuration of Printing System:
B. Electrical Configuration of Printer:
C. Whole Procedure of Access to Storage Device:
D. Reading Process with respect to Storage Device:
E. Writing Process with respect to Storage Device:
F. Write Locking Process with respect to Storage Device:
G. Printing Process of Printer:
H. Modified Examples:

A. Configuration of Printing System

Figure 1:
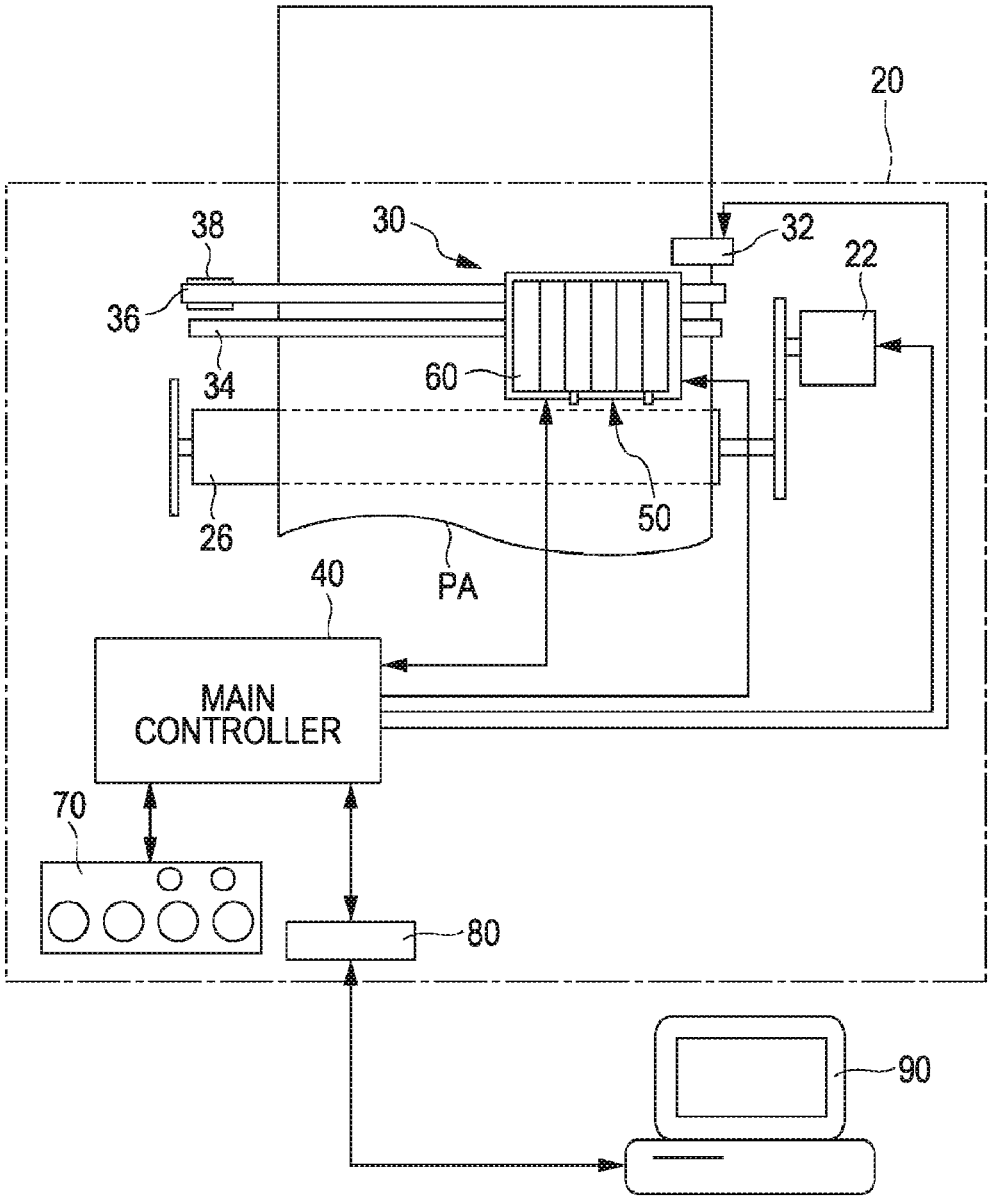
FIG. 1 is a diagram illustrating a schematic configuration of a printing system.

FIG. 1 is a diagram illustrating a schematic configuration of a printing system. The printing system includes a printer 20 as a printing apparatus and a computer 90. The printer 20 is connected through a connector 80 to the computer 90.

The printer 20 includes a sub scan transporting mechanism, a main scan transporting mechanism, a head driving mechanism, and a main controller 40. The sub scan transporting mechanism includes a paper transport motor 22 and a platen 26 so as to transport a paper PA in a sub scan direction by transmitting the rotation of the paper transport motor 22 to the platen 26. The main scan transporting mechanism includes a carriage motor 32, a pulley 38, a driving belt 36 which is suspended between the carriage motor 32 and the pulley 38, and a sliding shaft 34 which is disposed in parallel to a shaft of the platen 26. The sliding shaft 34 slidably supports a carriage 30 fixed to the driving belt 36. The rotation of the carriage motor 32 is transmitted through the driving belt 36 to the carriage 30, so that the carriage 30 is reciprocatingly moved along the sliding shaft 34 in the shaft direction (main scan direction) of the platen 26. The head driving mechanism includes a printing head unit 60 mounted on the carriage 30 to drive a printing head so as to eject ink on the paper PA. The main controller 40 controls the aforementioned components to implement a printing process. For example, the main controller 40 receives a printing task of a user through the computer 90 and controls the aforementioned components to perform printing based on the contents of the received printing task. The printing head unit 60 includes a sub controller 50 which performs various control operations in cooperation with the main controller 40. As described later, a plurality of the ink cartridges are detachably mounted on the printing head unit 60. In other words, the ink cartridges which supply ink to the printing head are mounted on the printing head unit 60 in the state where the ink cartridges are able to be detached by operations of the user. In addition, the printer 20 includes a manipulation unit 70 through which the user performs various printer settings or checks printer status.

Figure 2A:
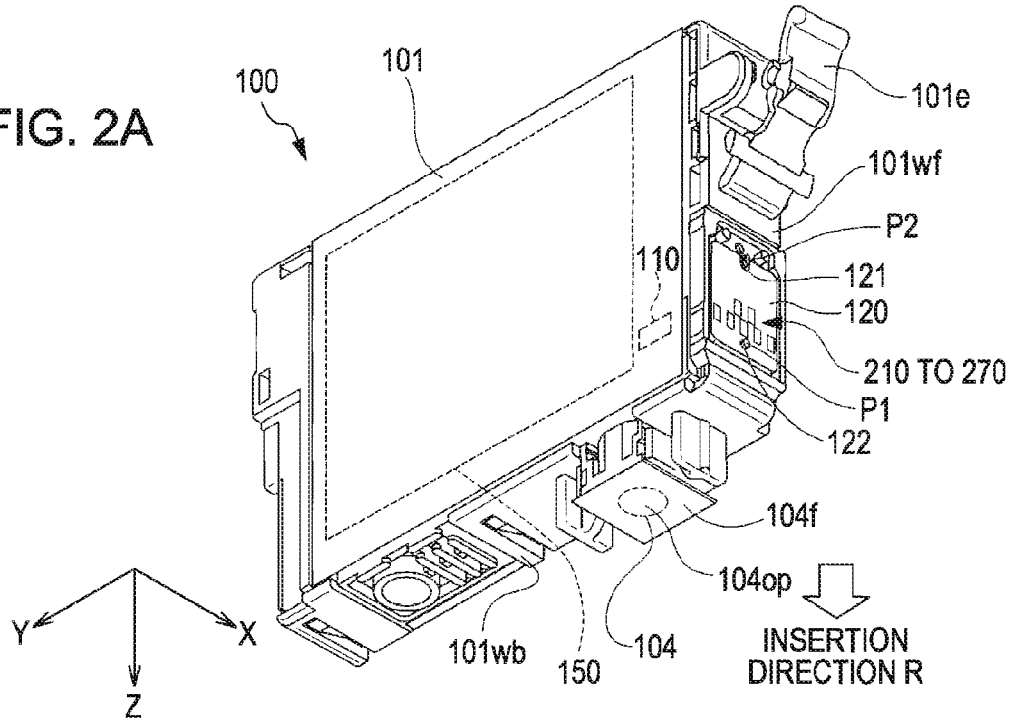
FIGS. 2A and 2B are perspective diagrams illustrating a configuration of an ink cartridge according to an embodiment of the invention.
Figure 2B:
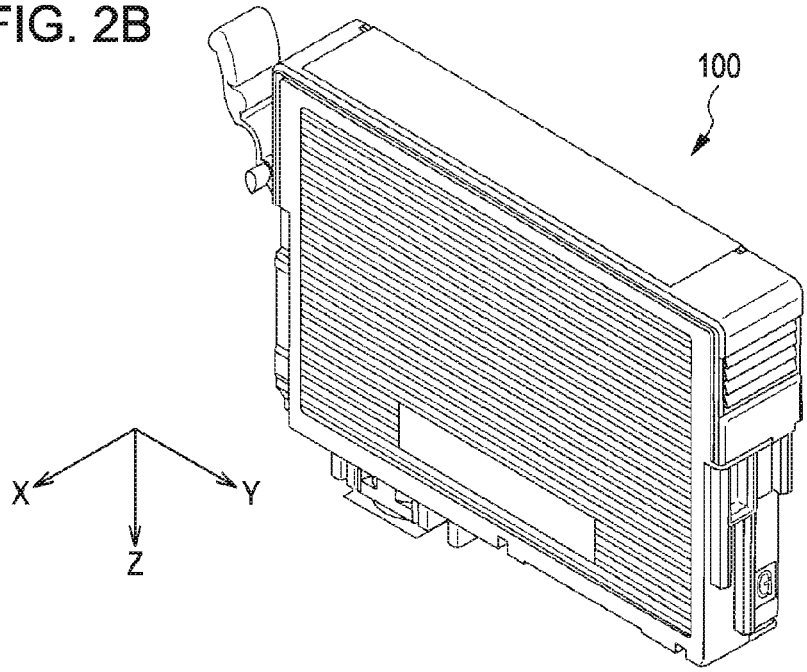

FIGS. 2A and 2B are perspective diagrams illustrating a configuration of the ink cartridge according to an embodiment of the invention. In FIGS. 2A and 2B, the X direction indicates a thickness direction of the ink cartridge 100; the Y direction indicates a length direction (forward/backward direction) thereof; and the Z direction indicates a height direction (upward/downward direction) thereof. A main body 101 of the ink cartridge 100 includes a front wall 101*wf* and a bottom wall 101*wb*. The front wall 101*wf* intersects the bottom wall 101*wb*. In the embodiment, the walls 101*wf* and 101*wb* intersect each other. A printed circuit board (hereinafter, simply referred to as a "circuit board" or a "board") 120 and an engagement protrusion 101*e* are disposed on the front wall 101*wf* of the main body 101. A plurality of terminals 210 to 270 are disposed on an outer surface of the circuit board 120. An ink chamber 150 which contains ink is formed in the inner portion of the main body 101. In addition, a sensor 110 which is used to detect a remaining ink amount is disposed in the inner portion of the main body 101. A sensor which detects an ink amount by using, for example, a piezoelectric element as a vibrating element and a vibration detecting element may be used as the sensor 110. An ink supply opening 104 which communicates with the ink chamber 150 is disposed on the bottom surface of the main body 101. An opening 104*op* of the ink supply opening 104 is sealed by a film 104*f*.

In addition, in the example of FIGS. 2A and 2B, although one ink tank is configured as one ink cartridge, a plurality of ink tanks may be configured as one ink cartridge.

Figure 3:
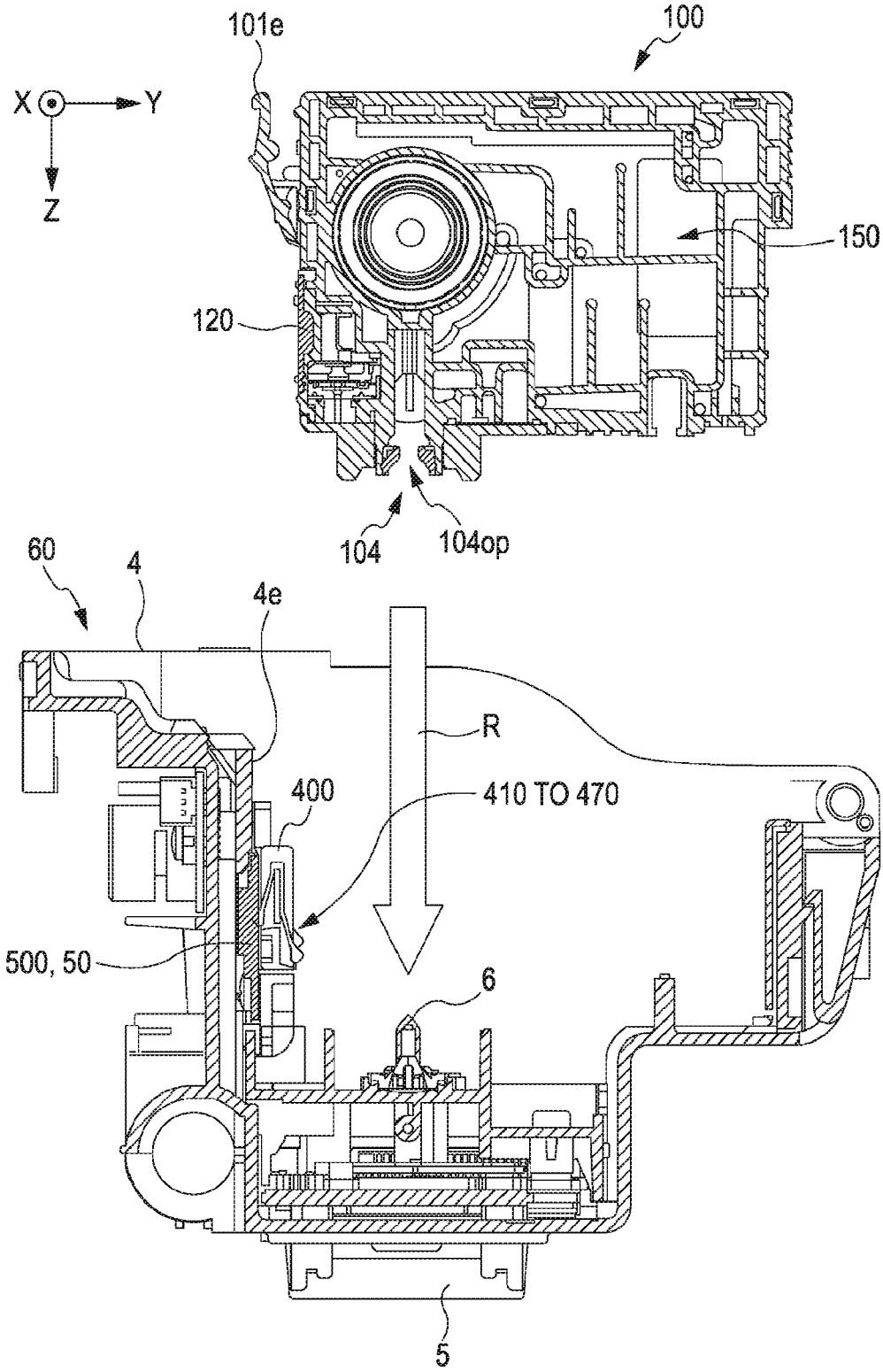
FIG. 3 is a diagram illustrating a configuration of a printing head unit.

FIG. 3 is a diagram illustrating a state where the ink cartridge 100 is mounted on the printing head unit 60. The printing head unit 60 includes a holder 4, a connection mechanism 400, a printing head 5, and a sub control board 500. The sub controller 50 (referred to as a "carriage circuit 50") is mounted on the sub control board 500. The sub controller 50 performs electrical connection to the terminals 210 to 270 of the circuit board 120 of the ink cartridge 100 through the connection mechanism 400. The holder 4 has a configuration of mounting a plurality of the ink cartridges 100 and is disposed on the printing head 5. The connection mechanism 400 includes conductive connection terminals 410 to 470 for electrically connecting the sub control board 500 to a plurality of the terminals 210 to 270 of the circuit board 120 of the ink cartridge 100. An ink supply needle 6 for supplying ink from the ink cartridge 100 to the printing head 5 is disposed on the printing head 5.

The ink cartridge 100 is inserted in the +Z direction (insertion direction R) so as to be mounted on the holder 4. By the mounting, the engagement protrusion 101*e* of the ink cartridge 100 is engaged with an engagement hole 4*e* of the holder 4, so that is possible to prevent the ink cartridge 100 from being unintentionally detached from the holder 4. If the engagement protrusion 101*e* is pushed by a finger and the ink cartridge 100 is pulled in the upward direction (−R direction), the ink cartridge 100 may be drawn out from the holder 4. The circuit board 120 mounted on the ink cartridge 100 is attached to or detached from the printer 20 according to the attachment and detachment of the ink cartridge 100 performed by the user. When the ink cartridge 100 is attached to the printer 20, the circuit board 120 is electrically connected to the printer 20.

When the ink cartridge 100 is attached to the printing head unit 60, the ink supply needle 6 destructs the film 104*f* (FIGS. 2A and 2B) to be inserted into the ink supply opening 104. As a result, ink contained in the ink chamber 150 (FIGS. 2A and 2B) may be supplied through the ink supply needle 6 to the printing head 5 of the printer 20. The printing head 5 includes a plurality of nozzles and a plurality of piezoelectric elements (piezo elements) to form dots on the paper PA by ejecting ink droplets from the nozzles according to voltages applied to the piezoelectric elements.

Figure 4A:
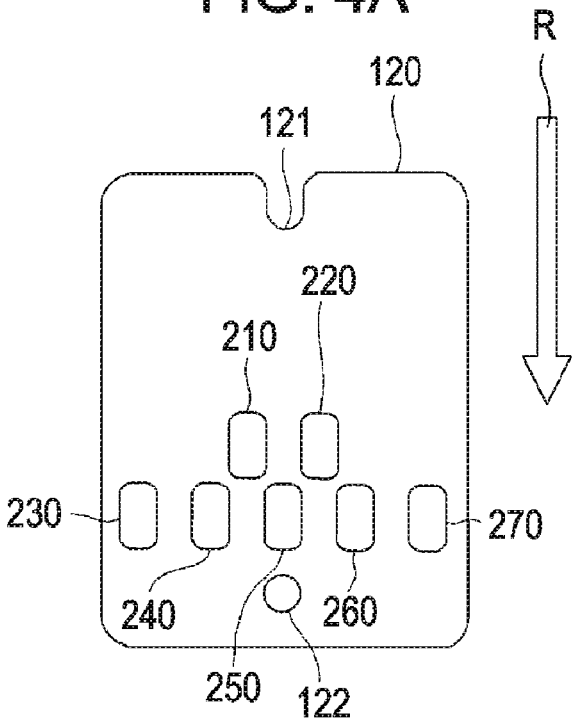
FIGS. 4A and 4B are diagrams illustrating a configuration of a board according to an embodiment of the invention.
Figure 4B:
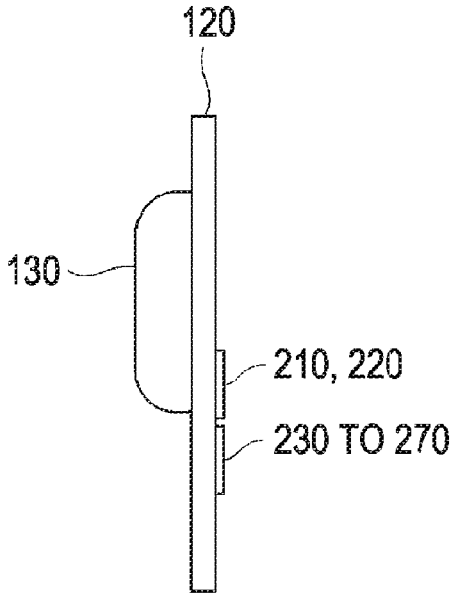

FIGS. 4A and 4B are diagrams illustrating a configuration of the circuit board 120. A hole 122 and a notch 121 which are used to fix the circuit board 120 to the main body 101 of the ink cartridge are formed on the circuit board 120. On the other hand, two protrusions P1 and P2 are formed on the front wall 101*wf* (FIGS. 2A and 2B) of the main body 101 of the ink cartridge. In the state where the circuit board 120 is attached to the front wall 101*wf*, the protrusions P1 and P2 are inserted into the hole 122 and the notch 121. In addition, at the time of manufacturing the ink cartridge 100, after the circuit board 120 is attached to the front wall 101*wf*, the distal ends of the protrusions P1 and P2 are crushed, so that the circuit board 120 is fixed to the front wall 101*wf*.

In FIG. 4A, the arrow R indicates the insertion direction of the ink cartridge 100. As illustrated in FIG. 4B, the circuit board 120 includes a storage device 130 on the rear surface, that is, a surface opposite to the surface which is connected to the printer 20 and a terminal group including seven terminals 210 to 270 on the front surface, that is, the surface which is connected to the printer 20. In the embodiment, the storage device 130 is a semiconductor storage device including the memory cell array. The memory cell array stores various data associated with the ink or the ink cartridge 100, for example, consumed ink amount data, ink color, or the like. The consumed ink amount data are data about the ink contained in the ink cartridge, which indicate a total sum of an ink amount consumed according to the printing or the head cleaning. The consumed ink amount data may be data indicating the consumed ink amount itself or data indicating a ratio of the consumed ink amount to a reference ink amount which may be determined based on an ink amount contained in the ink cartridge in advance.

Each of the terminals on the front surface side of the circuit board 120 has a substantially rectangular shape, and the terminals are disposed so as to form two columns which are substantially perpendicular to the insertion direction R. Among the two terminal columns, the terminal column located at the side of the insertion direction R (the distal end side of the insertion direction R), that is, at the lower side in FIG. 4A is referred to as a "lower side terminal column" or a "lower side column", and the terminal column located at the opposite side of the insertion direction R, that is, at the upper side of FIG. 4A is referred to as an "upper side terminal column" or an "upper side column". Herein, the terms "upper side" and "lower side" are the terms that are used for convenience of the description with reference to FIGS. 4A and 4B. The terminals 210 and 220 constituting the upper side terminal column and the terminals 230 to 270 constituting the lower side terminal column are disposed in an alternate manner so that the centers of the terminals are not aligned with each other in the insertion direction R. Particularly, except for the terminals 230 and 270 located at the two ends, other terminals 240, 210, 250, 220, and 260 are disposed in a zigzag shape.

The upper side terminal column includes a ground terminal 210 and a power supply terminal 220. The lower side terminal column includes a first sensor driving terminal 230, a reset terminal 240, a clock terminal 250, a data terminal 260, and a second sensor driving terminal 270. The five terminals (the ground terminal 210, the power supply terminal 220, the reset terminal 240, the clock terminal 250, and the data terminal 260) located at the central portion in the left/right direction are connected to the storage device 130 through wire line pattern layers (not shown) of the front and rear surfaces of the circuit board 120 or through-holes (not shown) disposed on the circuit board 120. The two terminals (the first and second sensor driving terminals 230 and 270) located at the two ends of the lower side terminal column are connected to the sensor 110 (FIGS. 2A and 2B) which is provided to the main body 101 of the ink cartridge.

In the circuit board 120, the five terminals 210, 220, and 240 to 260 connected to the storage device 130 and the two terminals 230 and 270 connected to the sensor 110 are disposed so as to be close to each other. Therefore, in the connection mechanism 400 (FIG. 3) in the side of the printer 20, the connection terminals 410, 420, and 440 to 460 corresponding to the five terminals 210, 220, and 240 to 260 connected to the storage device 130 and the two connection terminals 430 and 470 corresponding to the two terminals 230 and 270 connected to the sensor 110 are also disposed so as to be close to each other.

If the ink cartridge 100 is fixed to the holder 4, the terminals of the circuit board 120 is in contact with the connection terminals 410 to 470 of the connection mechanism 400 provided to the holder 4 to be electrically connected thereto. In addition, the connection terminals 410 to 470 of the connection mechanism 400 is in contact with the terminal group on the sub control board 500 to electrically connected thereto, so that the connection terminals 410 to 470 are electrically connected to the sub controller 50. In other words, if the ink cartridge 100 is fixed to the holder 4, the terminals 210 to 270 of the circuit board 120 is electrically connected to the sub controller 50.

B. Electrical Configuration of Printer

Figure 5:
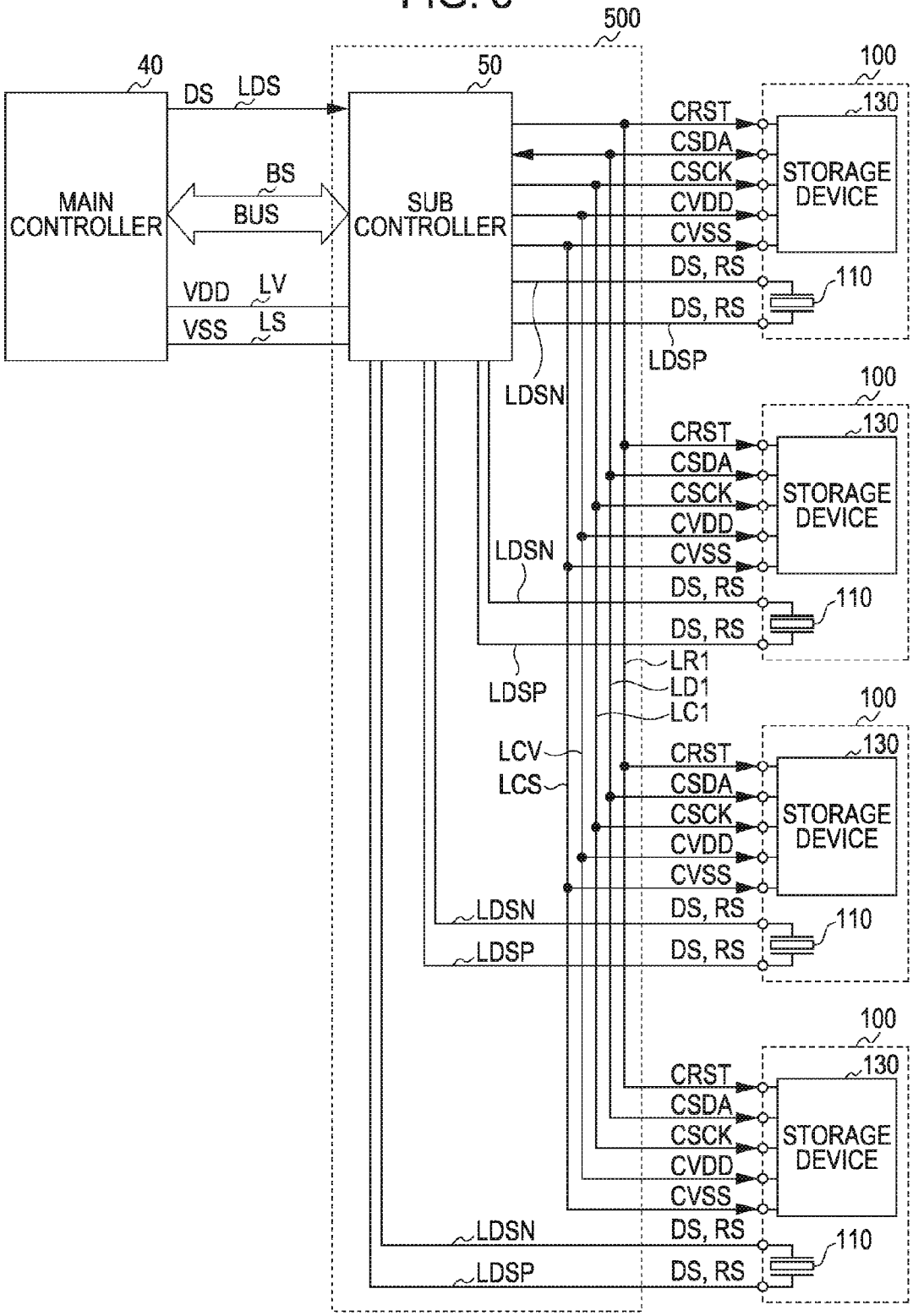
FIG. 5 is a first diagram illustrating an electrical configuration of a printer.

FIG. 5 is a block diagram illustrating a circuit configuration of the main controller 40, the sub controller 50, and the ink cartridge 100. In addition, in the embodiment, the main controller 40 and the sub controller 50 correspond to a host circuit according to the invention.

The main controller 40 and the sub controller 50 are electrically connected to each other through a plurality of wire lines. The plurality of the wire lines include a bus BS, a second power supply line LV, a second ground line LS, and a third sensor driving signal line LDS. The bus BS is used for data communication between the main controller 40 and the sub controller 50. The second power supply line LV and the second ground line LS are conduction lines which supply a power supply voltage VDD and a ground potential VSS from the main controller 40 to the sub controller 50. The power supply voltage VDD has the same level as that of a power supply voltage CVDD supplied to the storage device 130. For example, a potential of about 3.3V with respect to the ground potentials VSS and CVSS (0V) is used as the power supply voltage VDD. Needless to say, the potential level of the power supply voltage VDD may be other potential according to the process generation of the logic IC portions of the sub controller 50 or the like. For example, 1.5V, 2.0V, or the like is used as the potential level of the power supply voltage VDD. The third sensor driving signal line LDS is a conduction line which supplies a sensor driving signal DS, which is to be applied to the sensor 110, from the main controller 40 to the sub controller 50.

In the embodiment, the sub controller 50 supplies power to the storage devices 130 as a data storage unit and transmits commands indicating types of access to the storage devices 130 so as to perform writing data in the storage devices 130 and reading data from the storage devices 130.

The storage devices 130 of the ink cartridges 100 may be allocated with different 8-bit ID numbers (identification information). The storage devices 130 of the ink cartridges 100 are connected to wire lines, which are extended from the sub controller 50, in parallel (that is, bus connection). In the case where the reading or writing process of the sub controller 50 with respect to a storage device 130 of a specific ink cartridge 100 is performed, as described later, the sub controller 50 transmits the ID number to all the ink cartridges 100, so that the ink cartridge 100 (that is, the storage device 130) which is the access object is specified.

The wire lines which electrically connect the sub controller 50 and the ink cartridges 100 include a reset signal line LR1, a clock signal line LC1, a data signal line LD1, a first ground line LCS, a first power supply line LCV, a first sensor driving signal line LDSN, and a second sensor driving signal line LDSP.

The reset signal line LR1 is a conduction line which supplies a reset signal CRST from the sub controller 50 to the storage device 130. If the sub controller 50 supplies the reset signal CRST of the low level to a memory control circuit in the storage device 130, the memory control circuit becomes the initial state (stand-by state capable of receiving access). The clock signal line LC1 is a conduction line which supplies a clock signal CSCK from the sub controller 50 to the storage device 130. The data signal line LD1 is a conduction line which transmits a data signal CSDA in a bidirectional manner between the sub controller 50 and the storage device 130. The data signal CSDA is received and transmitted in synchronization with the clock signal CSCK. For example, the transmission of the data signal CSDA is started in synchronization with the falling edge of the clock signal CSCK, and the reception thereof is performed in synchronization with the rising edge of the clock signal CSCK. The three wire lines LR1, LC1, and LD1 connect the sub controller 50 to the plurality of the ink cartridges 100. In other words, with respect to the three wire lines LR1, LC1, and LD1, a plurality of the storage devices 130 are connected to the sub controller 50 in a bus connection manner. All the reset signal CRST, the data signal CSDA, and the clock signal CSCK are binary signals taking one of the values of the high level (for example, CVDD potential (3.3V)) or the low level (for example, CVSS potential (0V)). However, the potential level of the power supply voltage CVDD may be different potential according to the process generation of the storage device 130 or the like. For example, 1.5V, 2.0V, or the like is used as the potential level of the power supply voltage CVDD. Hereinafter, a high level signal is represented by the value "1", and a low level signal is represented by the value "0".

The first ground line LCS is a conduction line which supplies a ground potential CVSS to the storage device 130. The first ground line LCS is electrically connected through the ground terminal 210 (FIGS. 4A and 4B) of the circuit board 120 to the storage device 130. The ground potential CVSS is connected to the ground potential VSS (=the CVSS potential) which is supplied from the main controller 40 through the second ground line LS to the sub controller 50. The ground potential CVSS is set to the low level (0V). The first power supply line LCV is a conduction line which supplies the power supply voltage CVDD, which is an operating voltage of the storage device 130, to the storage device 130. The first power supply line LCV is connected through the power supply terminal 220 of the circuit board 120 to the storage device 130. With respect to the power supply lines LCS and LCV, a plurality of the storage devices 130 are connected to the sub controller 50 in a bus connection manner.

The first and second sensor driving signal lines LDSN and LDSP are conduction lines which applies a driving voltage to the piezoelectric element of the sensor 110 and transmits a voltage, which is generated according to the piezoelectric effect of the piezoelectric element after the stop of applying the driving voltage, to the sub controller 50. The first and second sensor driving signal lines LDSN and LDSP constitute an independent wire line pair for each of the ink cartridges 100. The first sensor driving signal line LDSN is eclectically connected to the one electrode of the piezoelectric element of the sensor 110 through the first sensor driving terminal 230 (FIGS. 4A and 4B). The second sensor driving signal line LDSP is electrically connected to the other electrode of the piezoelectric element of the sensor 110 through the second sensor driving terminal 270.

Figure 6:
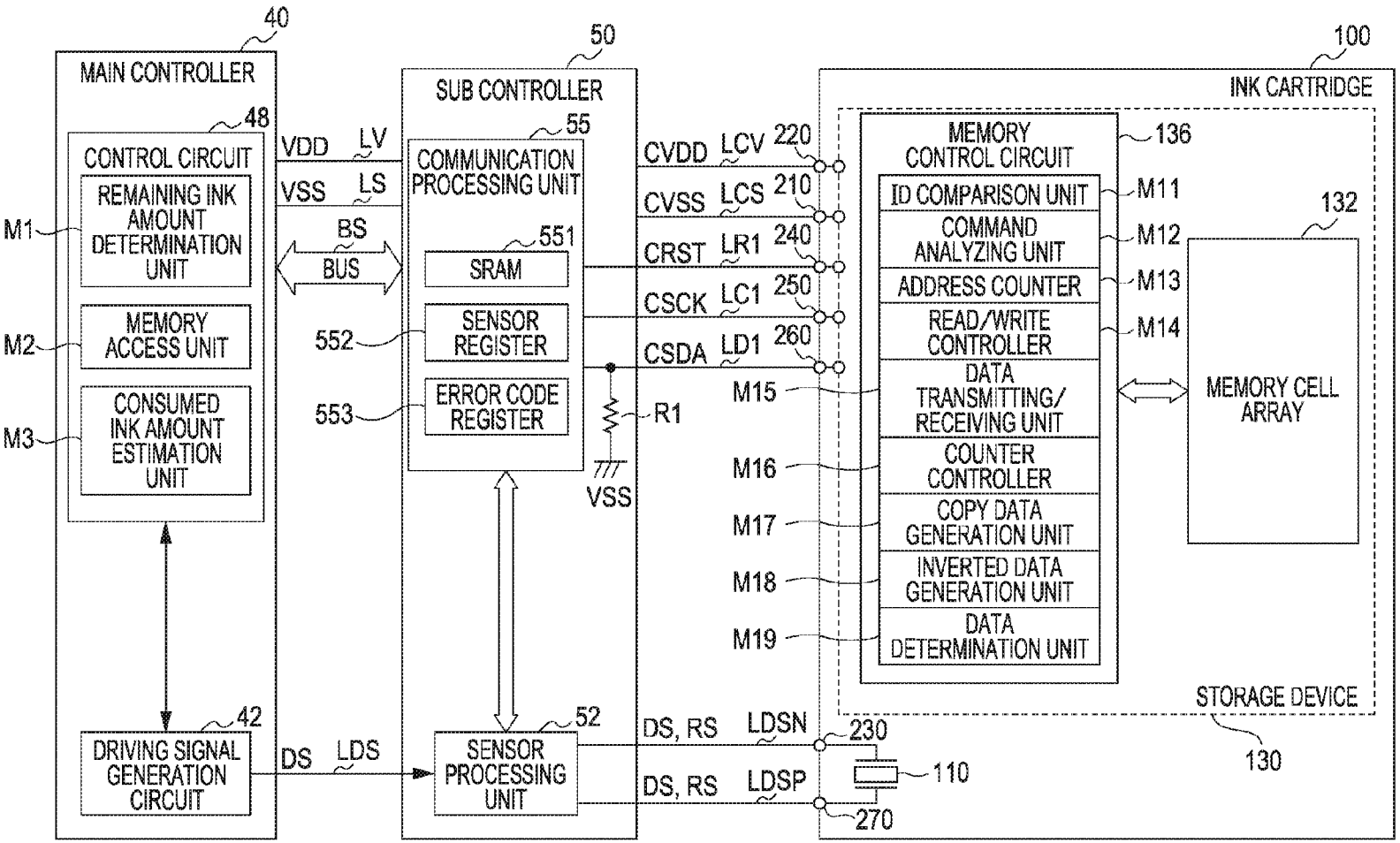
FIG. 6 is a second diagram illustrating an electrical configuration of a printer.

FIG. 6 is a block diagram illustrating a functional configuration of the main controller 40 and functional configurations of the sub controller 50 and the ink cartridge 100. The main controller 40 includes a control circuit 48, a driving signal generation circuit 42, and a ROM, a RAM, an EEPROM or the like (not shown). Various programs for controlling the printer 20 are stored in the ROM. The control circuit 48 includes a CPU (Central Processing Unit) to perform control of the whole of the printer 20 in cooperation with the memory such as an ROM, an RAM, or an EEPROM. The control circuit 48 includes, as functional blocks, a remaining ink amount determination unit M1, a memory access unit M2, and a consumed ink amount estimation unit M3.

The remaining ink amount determination unit M1 controls the sub controller 50 and the driving signal generation circuit 42 to drive the sensor 110 of the ink cartridge 100 so as to determine whether or not an ink amount in the ink cartridge 100 is equal to larger than a predetermined amount. The memory access unit M2 accesses the storage device 130 of the ink cartridge 100 through the sub controller 50 so as to read information stored in the storage device 130 or update information stored in the storage device 130. The consumed ink amount estimation unit M3 counts ink dots ejected on the printing paper according to the print performing of the printer 20 to estimate the ink amount consumed in the printing based on the ink dot count value and the ink amount consumed per dot. In addition, the ink amount consumed in the head cleaning process is also estimated. In addition, a total value of the estimated value of the consumed ink amount consumed in the ink cartridge from the time when the ink cartridge 100 is newly attached to the printer 20 is counted based on the aforementioned ink amount.

Data indicating the sensor driving signal DS for driving the sensor are stored in the EEPROM of the main controller 40 in advance. The driving signal generation circuit 42 reads data indicating a waveform of the sensor driving signal DS from the EEPROM to generate the sensor driving signal DS having a desired waveform according to a command from the remaining ink amount determination unit M1 of the control circuit 48. The sensor driving signal DS includes a potential higher than the power supply voltage CVDD (in the embodiment, 3.3V). For example, in the embodiment, the sensor driving signal DS includes a potential of about 36V in maximum. More specifically, the sensor driving signal DS is a trapezoidal pulse signal having a maximum voltage of 36V.

In addition, in the embodiment, the driving signal generation circuit 42 also has a function of generating a head driving signal which is supplied to the printing head 5. In other words, the control circuit 48 allows the driving signal generation circuit 42 to generate a sensor driving signal so as to perform the remaining ink amount determination and allows the driving signal generation circuit 42 to generate the head driving signal so as to perform printing.

The sub controller 50 is configured with ASIC (Application Specific IC). The sub controller 50 includes a communication processing unit 55 and a sensor processing unit 52.

The communication processing unit 55 performs a communication process with respect to the main controller 40 through the bus BS. In addition, the communication processing unit 55 performs a communication process with respect to the storage device 130 of the ink cartridge 100 through the reset signal line LR1, the data signal line LD1, and the clock signal line LC1. In addition, in the sub controller 50, the data signal line LD1 connected to the ground potential, that is, the CVSS potential (0V) through a pull-down resistor R1. As a result, when transmission and reception of data signals are not performed between the sub controller 50 and the storage device 130, the potential of the data signal line LD1 is maintained in the low level. The communication processing unit 55 may detect whether or not the circuit board 120 of the ink cartridge 100 is electrically connected to the printer 20, that is, whether or not the ink cartridge 100 is attached to the printer 20 by detecting a potential of a specific terminal among the terminal group of the circuit board 120. The communication processing unit 55 notifies the detection of the attachment of the ink cartridge 100 to the main controller 40. Therefore, the main controller 40 may determine whether or not each of the ink cartridges 100 is mounted on the cartridge mounting portion. In the case where the circuit board 120 is electrically connected to the printer 20 and thus, the ink cartridge 100 is determined to be attached to the printer 20, the main controller 40 performs access to the storage device 130 of the ink cartridge 100 through the communication processing unit 55 at a predetermined timing. The access is described later more in detail.

The communication processing unit 55 is a circuit which is driven by the power supply voltage VDD (in the embodiment, 3.3V). The ASIC constituting the communication processing unit 55 includes a memory area (SRAM 551) portion and a logic area. The logic area includes a sensor register 552 and an error code register 553. The SRAM 551 is a memory which is used for temporarily storing data when the communication processing unit 55 performs a process. For example, the SRAM 551 temporarily stores data received from the main controller 40 or data received from the sensor 110 or the storage device 130. The SRAM 551 stores data read from the storage devices 130 of the ink cartridges 100. The data stored in the SRAM 551 are updated according to the performing of the printing operation if necessary.

The sensor register 552 is a register for recording results of the determination of the remaining ink amounts of the ink cartridges performed by the sensor processing unit 52. The error code register 553 is a register for writing the later-described communication error or the memory cell error with respect to each row of the rewritable areas (described later) in each of the storage devices 130.

The sensor processing unit 52 performs the remaining ink amount determination process (sensor process) by using the sensor 110. The sensor processing unit 52 includes a change-over switch. The change-over switch is used to supply the sensor driving signal DS through one of the first and second sensor driving signal lines LDSN and LDSP to the sensor 110 of the one ink cartridge 100 that is the object of the sensor process.

Although not illustrated in detail, the sensor 110 includes a cavity (resonance portion) which constitutes a portion of an ink passage in the vicinity of an ink supply unit, a vibrating plate which constitutes a portion of a wall of the cavity, and a piezoelectric element which is disposed on the vibrating plate. The cavity and the vibrating plate constitute a sensor chamber. The sensor processing unit 52 may vibrate the vibrating plate through the piezoelectric element by applying the sensor driving signal DS through the sensor driving terminals 230 and 270 to the piezoelectric element. After that, the sensor processing unit 52 may detect whether or not ink exist in the cavity by receiving a response signal RS having a frequency of the remaining vibration of the vibrating plate from the piezoelectric element. More specifically, the ink contained in the main body 101 is consumed, so that the internal state of the cavity is changed from the state where a portion of the internal portion of the cavity is filled with the ink to the state where a portion of the internal portion is filled with the atmosphere. Accordingly, the frequency of the remaining vibration of the vibrating plate is changed. The change in frequency leads to a change in frequency of the response signal RS. The sensor processing unit 52 may detect whether or not ink exists in the cavity by measuring the frequency of the response signal RS. The detection of "absence" of ink in the cavity denotes that the remaining amount of the ink contained in the main body 101 is equal to or smaller than a first threshold value Vref1. The first threshold value Vref1 is a value corresponding to a volume of the passage at the downstream side of the cavity of the sensor chamber. The detection of "presence" of ink in the cavity denotes that the remaining amount of the ink contained in the main body 101 is larger than the first threshold value Vref1.

Next, an electrical configuration of the ink cartridge 100 is described. The ink cartridge 100 includes the storage device 130 and the sensor 110. The storage device 130 includes a memory cell array 132 as a data storage unit and a memory control circuit 136. In FIG. 6, as illustrated by white circles on the broken line indicating the storage device 130, the storage device 130 includes a ground terminal which is electrically connected to the ground terminal 210 of the printed circuit board 120, a power supply terminal which is electrically connected to the power supply terminal 220, a reset terminal which is electrically connected to the reset terminal 240, a clock terminal which is electrically connected to the clock terminal 250, and a data terminal which is electrically connected to the data terminal 260. The storage device 130 is a memory which does not receive address data designating an address of an access site from an external portion. The storage device 130 may control designating a to-be-accessed the memory cell according to the clock signal CSCK and command data which are supplied from an external portion without direct input of the address data.

The memory cell array 132 is a non-volatile semiconductor memory cell array. The memory cell array 132 provides a storage area having a characteristic of data rewritability. For example, an EEPROM may be used as the memory cell array 132.

The memory control circuit 136 is a circuit of relaying the access (reading and writing) of the sub controller 50 to the memory cell array 132. The memory control circuit 136 analyzes the identification data or the command data which are transmitted from the sub controller 50. In addition, at the time of writing, the memory control circuit 136 performs data writing with respect to the memory cell array 132 based on the writing data received from the sub controller 50. In addition, at the time of reading, the memory control circuit 136 performs data reading with respect to the sub controller 50 based on the data read from the memory cell array 132. The memory control circuit 136 includes an ID comparison unit M11, a command analyzing unit M12, an address counter M13, a read/write controller M14, a data transmitting/receiving unit M15, a counter controller M16, a copy data generation unit M17, an inverted data generation unit M18, and a data determination unit M19. Details of the processes of the components are as follows.

1. ID Comparison Unit M11

The ID comparison unit M11 compares the ID number transmitted from the sub controller 50 with the ID number allocated to the storage device 130 itself to determine whether or not the storage device 130 itself is an object of the access. The ID number allocated to the storage device 130 itself is stored in the memory cell which is connected to a word line selected based on an output of the address counter M13 when the access of the sub controller 50 is started after the storage device 130 is initialized. The ID number described herein is used to identify the storage device 130 which is the object of the access of the sub controller 50 among the plurality of the storage devices 130 which are connected to the sub controller 50 in a bus connection manner. The ID number is defined according to, for example, a color of the ink contained in the ink cartridge 100.

2. Command Analyzing Unit M12

The command analyzing unit M12 analyzes communication start data (SOF), communication end data (EOF), and the command data which are transmitted from the sub controller 50 to determine starting or ending of the access of the sub controller 50 and access types (reading, writing, or the like).

3. Address Counter M13

The address counter M13 is a counter indicating a row address (word line) of an object of the access to the memory cell array 132. A counter value of the address counter M13 is reset to an initial value when the reset signal CRST of the low level is input to the storage device 130 so that the storage device 130 is initialized. The initial address value is a value indicating the row address of the memory cell storing the ID number. After that, the address value is appropriately counted up according to the clock signal CSCK input to the storage device 130 based on the control of the counter controller M16. The counter value of the address counter M13 is output from the address counter M13 to an address decoder (row decoder) (not shown) in the case of performing the access to the memory cell array 132 under the control of the read/write controller M14.

4. Read/Write Controller M14

The read/write controller M14 performs collective writing, collective reading, and the like in units of a row on the word line selected by the address counter M13 according to the contents (access types) of the command data analyzed by the command analyzing unit M12. The read/write controller M14 includes registers or buffers (not shown), so that the read/write controller M14 may temporarily store later-described original data, inverted data, and mirror data.

5. Data Transmitting/Receiving Unit M15

The data transmitting/receiving unit M15 receives the data signal CSDA, which is transmitted from the sub controller 50 through the data signal line LD1, in synchronization with the clock signal CSCK or transmits the data signal CSDA through the data signal line LD1 in synchronization with the clock signal CSCK under the control of the read/write controller M14. In other words, the data transmitting/receiving unit M15 sets the direction of the transmission and reception of the data signal CSDA which is transmitted and received between the storage device 130 and the sub controller 50. In addition, the data transmitting/receiving unit M15 according to the embodiment corresponds to a data receiving unit and a data transmitting unit according to the invention.

6. Counter Controller M16

The counter controller M16 includes a clock counter which counts the number of pulses of the clock signal CSCK. The counter controller M16 supplies a control signal instructing count up or count down to the address counter M13 based on the count value. In other words, after the access of the sub controller 50 to the storage device 130 is started, the counter controller M16 counts the number of clock pulses of the clock signal CSCK input to the storage device 130 and outputs the control signal of performing count up or count down of the counter value of the address counter M13 every time of counting a predetermined number of pulses to the address counter M13 based on the result of the command analysis of the command analyzing unit M12.

7. Copy Data Generation Unit M17

The copy data generation unit M17 copies the later-described original data to generate mirror data having the same amount as that of the original data.

8. Inverted Data Generation Unit M18

The inverted data generation unit M18 inverts values of bits of the original data to generate inverted data (described later) having the same amount as that of the original data.

9. Data Determination Unit M19

The data determination unit M19 performs parity check of the original data and mirror data or calculation of Exclusive OR operation to determine consistency between the data.

Figure 7:
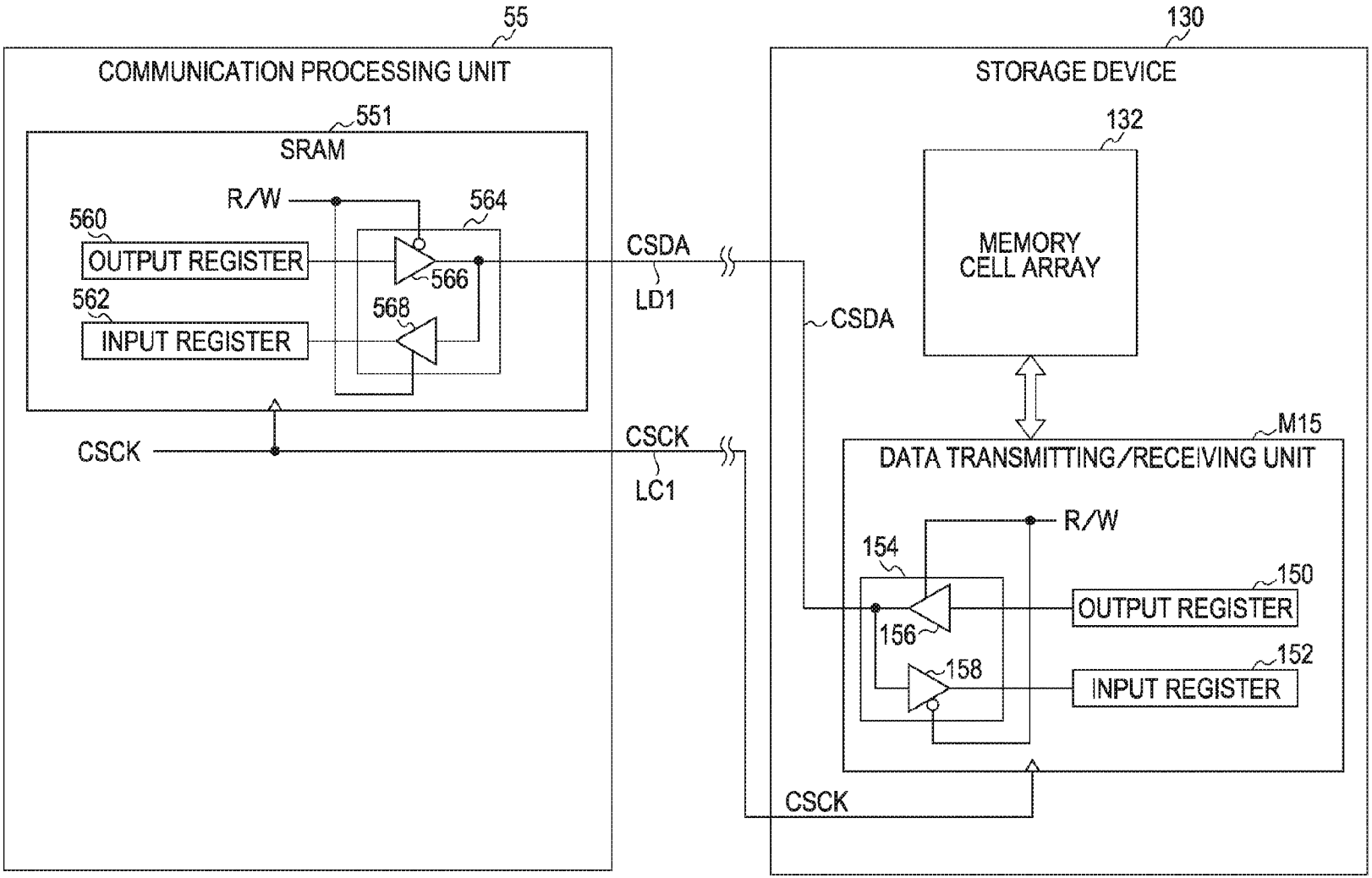
FIG. 7 is a block diagram illustrating an internal configuration of an input/output unit of SRAM and a data transmitting/receiving unit.

FIG. 7 is a block diagram illustrating an internal configuration of an input/output unit of the SRAM 551 in the communication controller 55 and the data transmitting/receiving unit M15 in the storage device 130. The input/output unit of the SRAM 551 includes an output register 560, an input register 562, and a switching circuit 564 which switches the transmission and reception directions. The output register 560 is a storage portion which temporarily stores data which are to be transmitted to the storage device 130, and the input register 562 is a storage portion which temporarily stores data which are received from the storage device 130. The switching circuit 564 includes a first 3-state buffer circuit 566 connected to the output register 560 and a second 3-state buffer circuit 568 connected to the input register 562. The first 3-state buffer circuit 566 is set to the conduction state at the time of the data transmission (at the time of the data writing) and set to the high impedance state (non-conduction state) at the time of the data reception (at the time of the data reading) according to a switching signal R/W applied from a logic circuit in the communication controller 55. On the contrary to the first 3-state buffer circuit 566, the second 3-state buffer circuit 568 is set to the high impedance state at the time of the data transmission (at the time of the data writing) and set to the conduction state at the time of the data reception (at the time of the data reading). In addition, the second 3-state buffer circuit 568 for inputting data may be replaced with a typical buffer circuit.

In addition, in this specification, the "data read" denotes a process of reading data from the storage device 130 to the side of the sub controller 50 (that is, the printer main body side), and the "data write" denotes a process of writing data from the side of the sub controller 50 (that is, the printer main body side) to the storage device 130.

Similarly to the SRAM 551, the data transmitting/receiving unit M15 in the storage device 130 also includes an output register 150, an input register 152, and a switching circuit 154. The switching circuit 154 includes two 3-state buffer circuits 156 and 158. The first 3-state buffer circuit 156 for outputting is set to the conduction state at the time of the data transmission (at the time of the data reading) and set to the high impedance state (non-conduction state) at the time of the data reception (at the time of the data writing) according to the switching signal R/W applied from the read/write controller M14 (FIG. 6) of the storage device 130. On the contrary to the first 3-state buffer circuit 156, the second 3-state buffer circuit 158 is set to the high impedance state at the time of the data transmission (at the time of the data reading) and set to the conduction state at the time of the data reception (at the time of the data writing).

In the initial state of the storage device 130, the transmission and reception directions of the switching circuits 564 and 154 are set to the direction of the reception of the storage device 130. In other words, at the time of power on of the printer 20 or at the time of replacing the ink cartridge 100, the attachment of the ink cartridge is detected, so that the storage device 130 is initialized. After that, when the access of the sub controller 50 to the storage device 130 is started, the transmission and reception directions of the switching circuits 564 and 154 are set to the direction of the reception of the storage device 130. In addition, at the time of starting the access to the storage device 130, when the ID number applied from the communication controller 55 is determined not to be consistent with the ID number stored in the storage device 130, the second 3-state buffer circuit 158 for inputting is set to the high impedance state. As a result, since the storage devices 130 other than the storage device 130 which is the access object become in the state of being incapable of receiving data, the current of the data signal line LD1 is decreased, so that it is possible to implement power saving.

In addition, the circuit configurations and functional configurations described with reference to FIGS. 6 and 7 are exemplary ones, and thus, arbitrary modifications are available. For example, the main controller 40 and the sub controller 50 may be configured as one controller.

Figure 8:
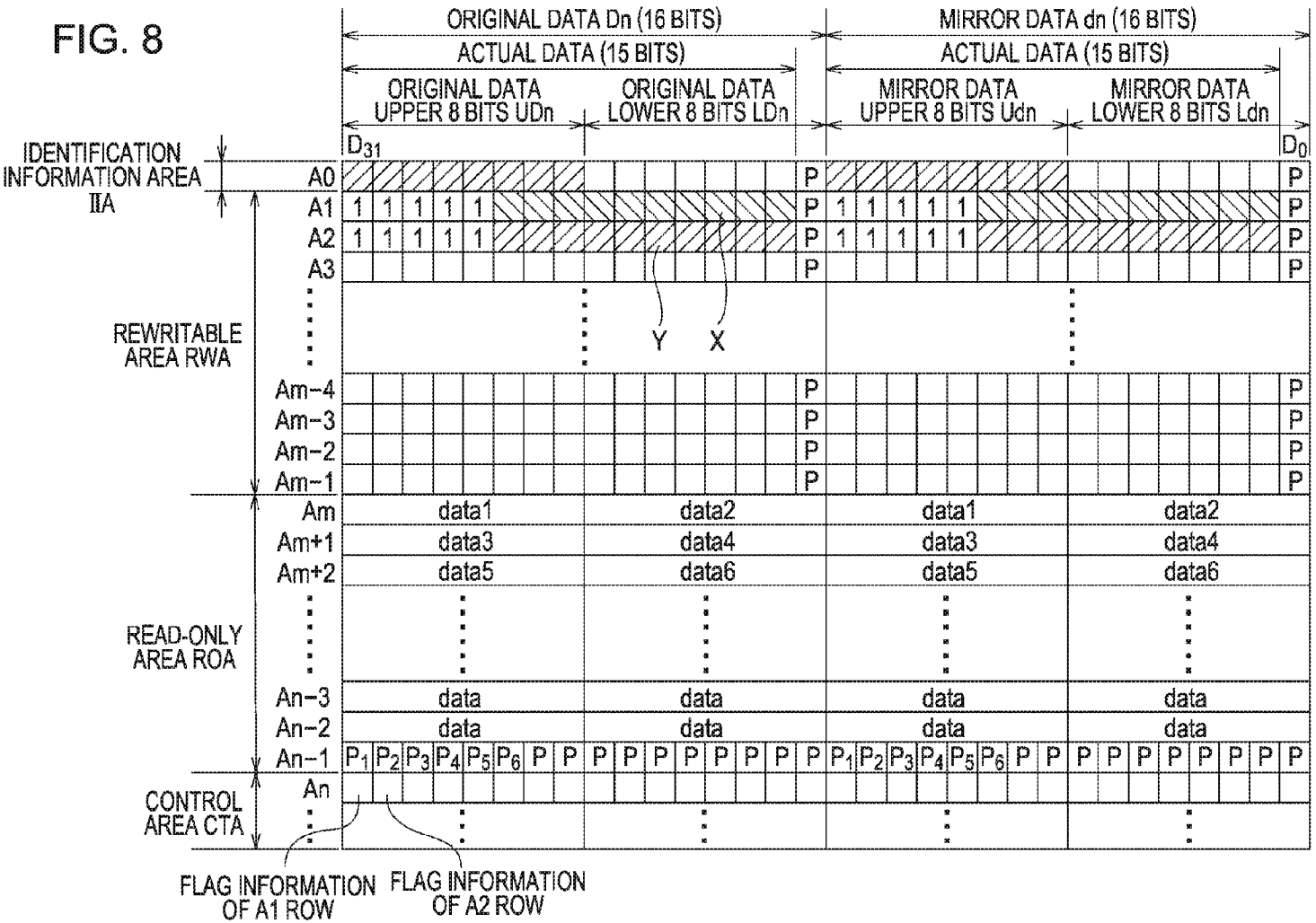
FIG. 8 is a schematic diagram illustrating a memory map of a storage area according to a first embodiment of the invention.

FIG. 8 is a schematic diagram illustrating a memory map of the memory cell array 132. The memory cell array 132 includes a plurality of rows, and one row is configured with 32-bit data D31 to D0. The one row corresponds to the row (that is, the word line) selected by the address counter M13. In other words, the memory cell array 132 is sequentially accessed in the order of rows selected according to the valued indicated by the address counter. In the memory map, the order of the sequential access is the direction from the upper side to the lower side in units of a row. Herein, for the convenience, the memory cell that is located at the more left side (uppermost bit D31 side) in the same row is referred to as an upper cell. In addition, an upper row from a specific row denotes a row in the upper side from the specific row (a row of which the row number is small), and a lower row from a specific row denotes a row in the lower side from the specific row (a row of which the row number is large).

The data of one row of the memory cell array 132 correspond to the unit data (also referred to as an "access unit") at the time when the memory control circuit 136 performs writing and reading with respect to the memory cell array 132. In general, the access unit is constructed with N bits (N is an integer of 2 or more).

The memory cell array 132 is partitioned into an identification information area IIA, a rewritable area RWA, a read-only area ROA, and a control area CTA. The identification information area IIA includes a 32-bit storage area of an A0 row to be used for storing the ID number. The rewritable area RWA includes a storage area of ($m^{-1}$) rows (m is an integer of 2 or more) of from an A1 row to an Am−1 row and is an area in which the writing of data from the sub controller 50 of, the printer 20 is available. The read-only area ROA includes a storage area of (n-m) rows (n is an integer larger than m) of from the Am row to an An−1 row and is an area in which only the reading of data from the sub controller 50 of the printer 20 is available. The control area CTA is disposed at the lower position of the read-only area ROA and is a storage area which stores various types of the flag information such as increment flag information and write locking flag information described later.

The upper 16 bits in an arbitrary one row of the memory cell array 132 are an original data area for writing the original data Dn. Herein, the original data Dn are the data which are the origin of the inverted data and the mirror data described later. The lower 16 bits in an arbitrary one row of the memory cell array 132 are a mirror data area for writing the mirror data dn. The mirror data are a copy of the original data Dn written in the upper 16 bits. In the normal time, that is, in the case where cell defect, a writing error, or the like do not exist in each row, the original data Dn and the mirror data dn in each row have the same contents.

In the identification information area IIA and the rewritable area RWA, actual data are stored in the upper 15 bits of the original data area in each row, and a parity bit P associated with the actual data is stored in the last bit (the 16-th bit). Herein, the "actual data" are data that the main controller 40 of the printer 20 uses for various control processes (for example, printing and control of a user interface) of the printer 20. However, the actual data may include a fixed value written in an empty space in the upper 15 bits of the original data area. The actual data according to the embodiment include, for example, data indicating a consumed ink amount, data indicating the starting time of use of the ink cartridge, and the like. Similarly, the mirror data of the actual data of the original data are stored in the upper 15 bits of the mirror data area, and the mirror data of the parity bit P associated with the actual data of the original data are stored in the last bit (the 16-th bit). The parity bit P is a redundant bit which is set to the value of "1" or "0" so that the number of "1" in the 16-bit data including the parity bit P and the upper 15 bits is always an odd number. Otherwise, the parity bit P may be set to the value of "1" or "0" so that the number of "1" in the 16-bit data including the parity bit P and the upper 15 bits is always an even number. In addition, instead of the parity bit P, other types of redundant data, which are formed by making redundancy in the actual data, or an error detection code may be used.

Among the (m-n) rows of the read-only area ROA, the rows other than the last row (An−1 row) constitute the actual data area which is used to store the actual data, and the last row constitutes the parity bit area which is used to store the parity bit P. The parity bit P of the read-only area ROA may be allocated to each information having a predetermined unit (for example, 8-bit actual data) among the actual data of the rows other than the last row. In the read-only area ROA, one set of the actual data attached with the parity bit P is referred to as a "the data set" or an "information set". If the number of bits in one data set is set to a predetermined value (for example, 8 bits or an integer multiple thereof), the correspondence between the data set and the parity bit P may be easily implemented. In addition, in the case where the number of bits in the data set is large, two or more rows may be allocated to the parity bit area of the read-only area ROA.

The reason why the parity bit P is collectively stored in the final portion of the read-only area ROA is as follows. There is a case where at least a portion of the actual data stored in the read-only area ROA is expressed by an 8-bit character code. In this case, if the parity bit P is added just after the 8-bit code, the number of bits of one data set (actual data+parity bit) becomes 9 bits. In such a configuration, bit shift control performed in units of one bit is necessary for the main controller 40 to determine a separation position in the data set. On the other hand, as illustrated in FIG. 8, if the parity data P of each data set in the read-only area ROA is collectively stored in the final portion of the read-only area ROA, there is an advantage in that it is not necessary to perform the bit shift control so as for the main controller 40 to obtain the actual data. In addition, as described later, in the embodiment, it is sufficient that the data of the read-only area ROA is read once after the attachment of the ink cartridge 100 (that is, the storage device 130) is verified by the main controller 40 of the printer 20. Therefore, even in the case where the actual data and the parity bit P thereof are stored in separate positions, there are almost no disadvantages.

On the other hand, in the rewritable area RWA, the actual data are stored in the upper 15 bits among the individual 16-bit data, and the parity bit P is stored in the last one bit. This is because the data in the rewritable area RWA may be written in units of a row and thus, if the actual data and the parity bit P thereof are stored in separate positions, it is difficult to perform parity check at the time of the data writing.

As understood from the description hereinbefore, in the identification information area IIA and the rewritable area RWA, the original data include the actual data and the parity bit P thereof. In addition, in the read-only area ROA, the original data which are stored in the area other than the final parity bit area are the actual data themselves. In addition, the original data which are stored in the rear end portion of the read-only area ROA are the parity bit P. In addition, the advantages of the method of storing the actual data and the parity bit P in the storage device 130 will be described later in detail again after the description of the reading process.

The ID number (identification information) defined with respect to each type (color) of the ink cartridge 100 is stored as 8 bits from the front end cell in the front-end first row of the storage device 130, that is, in the A0 row of the identification information area IIA. In FIG. 8, the area in which the ID number is stored is indicated by hatching. The remaining cells other than the cell of the parity bit P of the original data in the A0 row and the cell in which the ID number is stored are empty areas, and fixed data of 0 or 1 are stored therein. For example, in the case where the number of types of the ink cartridges 100 mounted on the printer 20 is M, the ID number takes M different values which are different according to the types of the ink cartridges 100.

Various types of information, for example, the consumed ink amount information, usage history information of the ink cartridge 100, or the like are stored in the rewritable area RWA. The first ink consumption count value X is stored in the first row (A1 row) of the rewritable area RWA, and the second ink consumption count value Y is stored in the second row (A2 row). In FIG. 8, the areas in which the ink consumption count values X and Y are stored are indicated by hatching. The first ink consumption count value X is, for example, 10-bit information and is stored in the cells of the lower 10 bits among the 15 bits except for the parity bit P of the A1 row. Data are transmitted from the side of the printer 20 so that "1" is always stored in the upper 5 bits of the A1 row. The second ink consumption count value Y is also, for example 10-bit information and is stored in the cells of the lower 10 bits among the 15 bits except for the parity bit P of the A2 row. Data are transmitted from the side of the printer 20 so that "1" is always stored in the upper 5 bits of the A2 row. The first and second ink consumption count values X and Y are values indicating a total sum of the consumed ink amount of each ink cartridge 100, which is obtained based on the consumed ink amount estimated by the consumed ink amount estimation unit M3 (FIG. 6). Difference between the two ink consumption count values X and Y will be described later.

Ink end information is stored in other predetermined rows of the rewritable area RWA. The ink end information is, for example, 2-bit data, and there are 3 types of "01", "10", and "11". The value "01" indicates the state (hereinafter, referred to as a full state) where it is not detected by the sensor 110 of the ink cartridge 100 that the remaining ink amount is equal to or smaller than the first threshold value Vref1, that is, the state where the remaining ink amount is larger than the first threshold value Vref1. The value "10" indicates the state (hereinafter, referred to as a low state) where the remaining ink amount is equal to or small than the first threshold value Vref1 and the remaining ink amount is larger than the ink end level ((first threshold value Vref1)>(ink end level)). The state where the remaining ink amount is equal to or smaller than the first threshold value Vref1 is detected by the sensor 110 of the ink cartridge 100. The value "11" indicates the state (hereinafter, referred to as an end state) where the remaining ink amount is equal to or small than the ink end level. The ink end level denotes a remaining ink amount level at which the ink cartridge 100 is preferably replaced. If the printer 20 continuously performs printing at the ink end level, air may be flowed and mixed into the printing head unit 60 due to ink exhausting. For example, the first threshold value Vref1 is set to a remaining ink amount of about 1.5 g (gram), and the ink end level is set to a remaining ink amount of about 0.8 g. The process using the ink end information will be described later in detail.

For example, maker information indicating a manufacturing maker of the ink cartridge 100, a manufacturing date of the ink cartridge, a volume of the ink cartridge, a type of the ink cartridge, and the like are stored in the read-only area ROA. It is preferable that at least a portion of information (for example, a type of the ink cartridge) in the read-only area ROA is described by using an 8-bit character code.

Various types of the flag information including the increment flag information and the write locking flag information are stored in the control area CTA. The increment flag information is prepared as one bit for each row of the memory cell array 132. The row in which the corresponding increment flag information is set to "1" becomes an area in which the rewriting (increment rewriting) of the row corresponding to the value larger than the value previously stored in the row is permitted, and the rewriting (decrement rewriting) of the row corresponding to the value smaller than the value previously stored in the row is not permitted. With respect to the row in which the corresponding increment flag information is set to "0", the rewriting is freely performed. It is determined by the read/write controller M14 of the memory control circuit 136 with reference to the increment flag information whether only the increment rewriting is permitted or the writing is freely permitted. For example, with respect to the A1 row and A2 row in which the aforementioned first and second ink consumption count values X and Y are recorded, the corresponding increment flag information is set to "1". This is because the updating of the ink consumption count values X and Y by the printer 20 is difficult to consider in directions other than the increasing direction. Therefore, the possibility of erroneous writing in the A1 row and A2 row may be reduced. Hereinafter, the storage area, in which the corresponding increment flag information is set to "1", such as the A1 row and the A2 row are referred to as an "increment-dedicated area". In addition, in the case where the remaining ink amount is stored instead of the consumed ink amount, it may be controlled by using the decrement flag information instead of the increment flag information whether only the decrement rewriting is permitted or free rewriting is permitted.

The write locking flag information registered in the control area CTA is prepared as one bit for each row of the identification information area IIA, the rewritable area RWA, and the read-only area ROA. The row in which the write locking flag information is set to "1" becomes the area in which the rewriting by the access of an external portion is not permitted. With respect to the row in which the write locking flag information is set to "0", the rewriting by the access of an external portion is permitted. It is determined by the read/write controller M14 of the memory control circuit 136 with reference to the write locking flag information whether or not the rewriting is permitted. With respect to the A1 to Am−1 rows, which are the rewritable area RWA, the write locking flag information is set to "0" in the state of shipment from a factory, and data erasing and writing by the communication processing unit 55 of the printer 20 are permitted. On the contrary, with respect to the A0 row, which is the identification information area IIA, and the Am to An−1 rows, which are the read-only area ROA, the write locking flag information is set to "1" in the state of shipment from the factory, and the data erasing and writing by the communication processing unit 55 of the printer 20 are not permitted. The storage area in which the write locking flag information is set to "1" is referred to as a "write locking area".

C. Whole Procedure of Access to Storage Device

Figure 9:
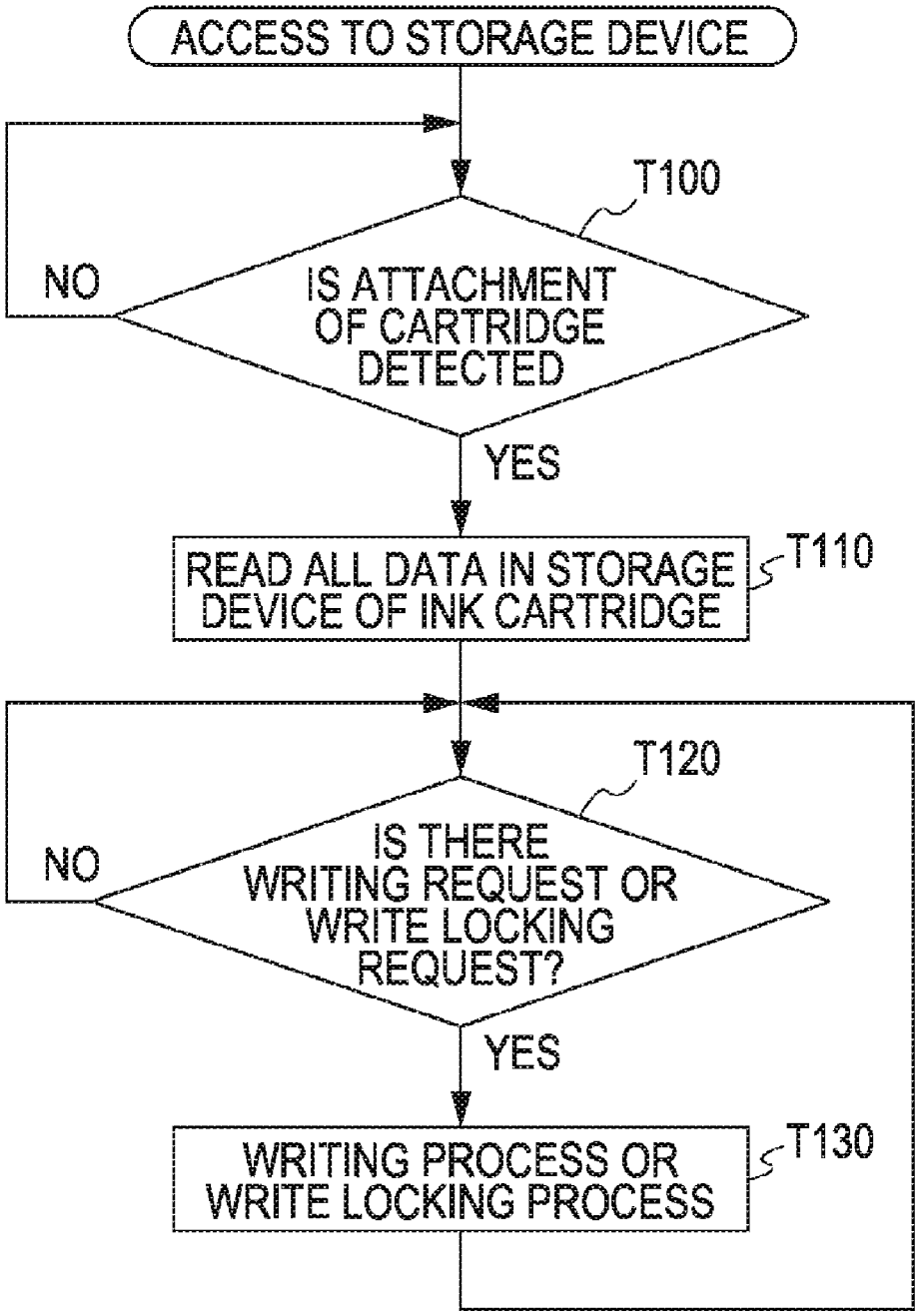
FIG. 9 is a flowchart illustrating a whole procedure of access to a storage device.

FIG. 9 is a flowchart illustrating a whole procedure of access to the storage device 130. The procedure is mainly described from the point view of the sub controller 50. In Step T100, if the attachment of the ink cartridge 100 to the printer 20 is detected by the sub controller 50, Step T110 and the following steps are started. In Step T110, all the data which are stored in the storage device 130 of the attached ink cartridge 100 are read by the sub controller 50. In addition, the attachment of the ink cartridge 100 is detected (1) after the printer 20 is powered on and (2) when the ink cartridge 100 is replaced. In the former case, the data reading of Step T110 is performed on all the ink cartridges 100 which are attached to the printer 20, and in the latter case, the data reading is performed on only the newly attached ink cartridge 100. The read data are stored in the memory of the main controller 40. During the operation of the printer 20, since the processes using the data in the memory of the main controller 40 are performed, the reading of data again from the ink cartridge 100 is unnecessary.

In Step T120, the sub controller 50 stands by until there is a writing request or a write locking request from the main controller 40. In Step T130, the corresponding process is performed according to the writing request or the write locking request. The writing process is a process of writing data in the storage device 130 in one of the ink cartridges 100. In general, in the writing process, all the data of the rewritable area RWA (FIG. 8) in the storage device 130 which is the access object are written. The write locking process is a process of writing the write locking flag information (the flag indicating the availability of rewriting) in the control area CTA. In addition, the processes of Steps T110 and T130 are described later in detail.

In addition, the whole procedure described with reference to FIG. 9 is merely an example, but various processes may be performed with other different procedures. For example, the data may be read from the storage device 130 irrespective of the presence and absence of the detection of attachment of the ink cartridge. In addition, the range of the data reading or writing may be arbitrarily changed if needed. For example, in order to check the result of the writing of the data, which are written in the storage device 130, the process of reading only the data in the rewritable area RWA may be performed at an arbitrary timing.

D. Reading Process with Respect to Storage Device

Figure 10:
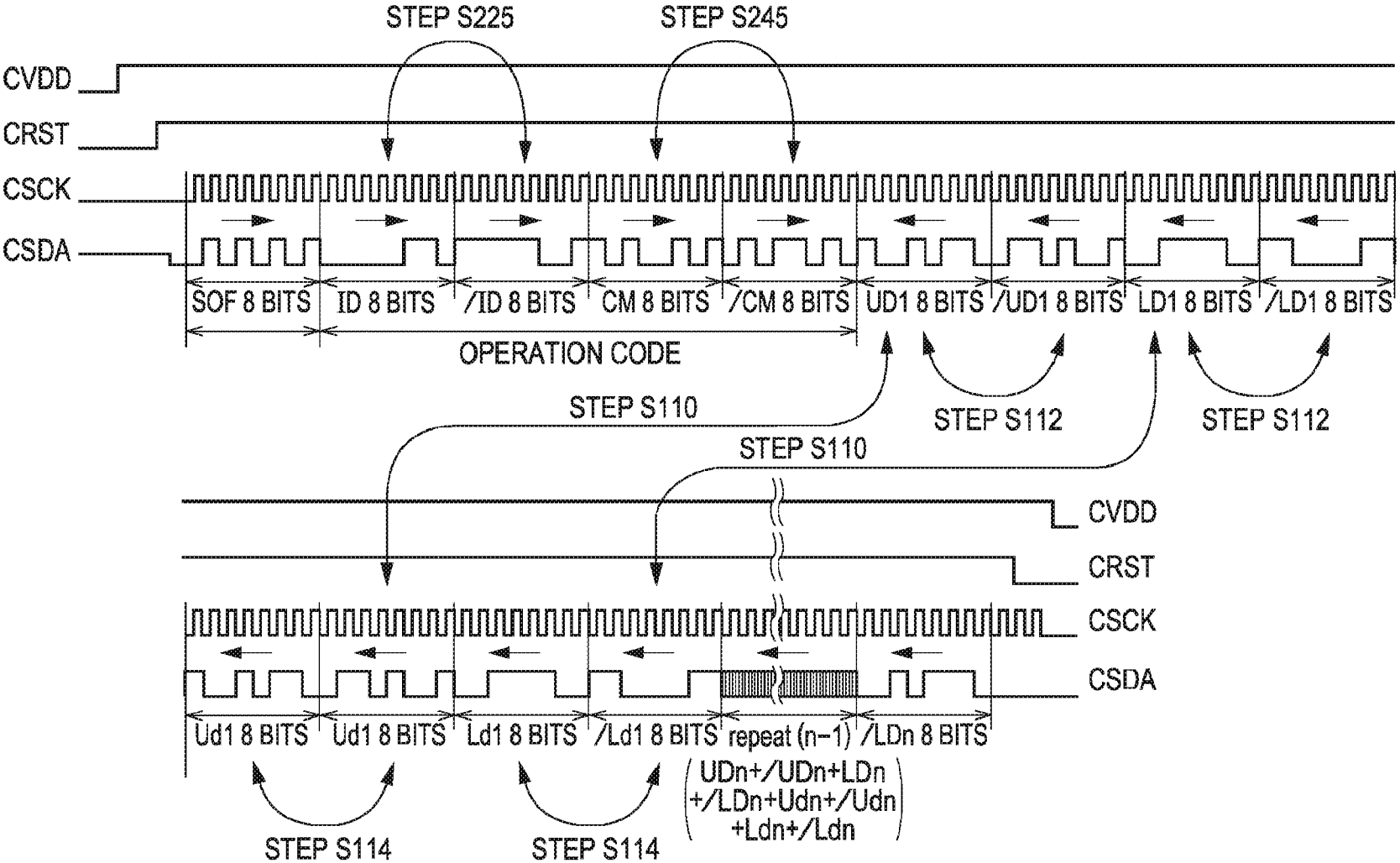
FIG. 10 is a timing chart schematically illustrating signals which are transmitted and received in a reading process with respect to a storage device.

FIG. 10 is a timing chart schematically illustrating signals which are transmitted and received between the communication processing unit 55 of the printer 20 and the memory control circuit 136 of the storage device 130 in the reading process with respect to the storage device 130. Herein, examples of the power supply voltage CVDD, the reset signal CRST, the clock signal CSCK, and the data signal CSDA are illustrated. The power supply voltage CVDD is a signal occurring on the first power supply line LCV which connects the sub controller 50 and the storage device 130 and is supplied from the sub controller 50 to the storage device 130. The reset signal CRST is a signal occurring on the reset signal line LR1 which connects the sub controller 50 and the storage device 130 and is supplied from the sub controller 50 to the storage device 130. The clock signal CSCK is a signal occurring on the clock signal line LC1 which connects the sub controller 50 and the storage device 130 and is supplied from the sub controller 50 to the storage device 130. The data signal CSDA is a signal occurring on the data signal line LD1 which connects the sub controller 50 and the storage device 130. In addition, in FIG. 10, arrows indicating the data directions of the data signal CSDA are illustrated. The rightward arrows indicate that the sub controller 50 is a transmission side and the storage device 130 is a reception side. The leftward arrows indicate that the sub controller 50 is a reception side and the storage device 130 is a transmission side. In the embodiment, the storage device 130 receives data in synchronization with the rising edge of the clock signal CSCK supplied from the sub controller 50. In other words, the level of the data signal at the time of the rising edge of the clock signal CSCK is received as an effective data value.

The main controller 40 of the printer 20 transmits the reading command of instructing reading data from the storage device 130 of the ink cartridge 100 to the sub controller 50 through the bus BS. In response to the command, the communication processing unit 55 supplies the power supply voltage CVDD to each of the ink cartridges 100. In other words, the communication processing unit 55 supplies an operating voltage to the storage device 130 of each of the ink cartridges 100, so that the storage device 130 is in the operable state. After the power supply voltage CVDD is supplied, the reset signal CRST of the low level is supplied, so that the storage device 130 is initialized. In general, since the reset signal CRST is in the low level at the time of end of the previous access, the reset signal CRST is in the low level before the power supply voltage CVDD is supplied to the storage device 130.

If the reading command is received from the main controller 40, the communication processing unit 55 of the sub controller 50 starts the reading process. If the reading process is started, the communication processing unit 55 transitions the reset signal CRST from the low level to the high level and transmits the clock signal CSCK having a predetermined frequency. If the reset signal CRST is changed from the low level to the high level, the storage device 130 is in the stand-by state where the data signal CSDA is received from the communication processing unit 55.

Figure 11:
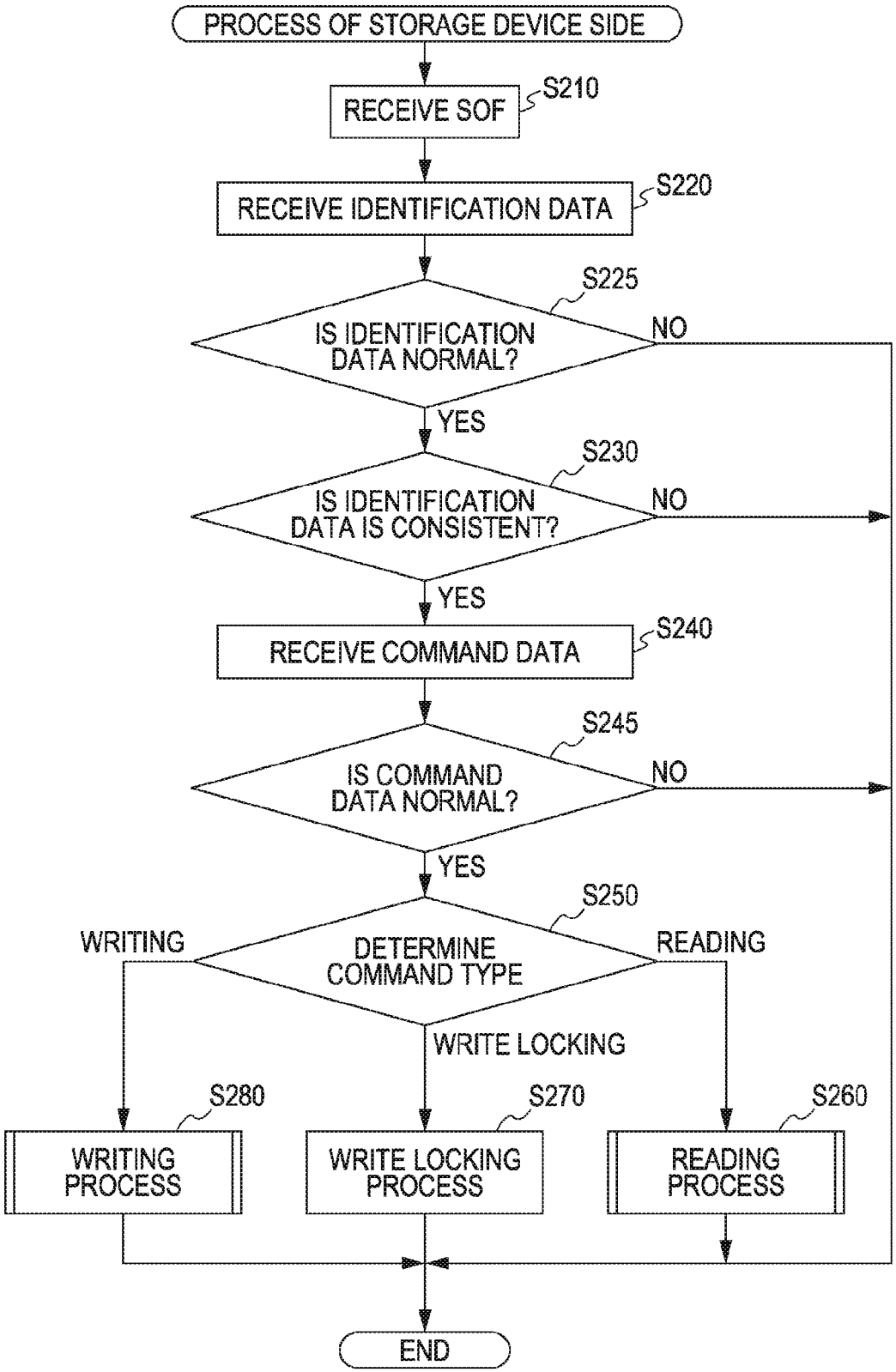
FIG. 11 is a flowchart illustrating a process routine of a process (storage-device-side process) of a storage device of an ink cartridge.

FIG. 11 is a flowchart illustrating a process routine in the process (the process of the storage device side) in the storage device of the ink cartridge. Although the process flow is performed by the memory control circuit 136 (FIG. 6), the process is not limited to the case of the reading process, but the whole process flow of the storage device side including other processes (the writing process and the write locking process) may be included.

Before the processes of the storage device side, the storage device 130 is input with the power supply voltage CVDD from the sub controller 50 to be driven, and the storage device 130 itself is initialized according to the reset signal CRST of the low level (FIG. 10). In the initialization, the address counter M13 is set to the initial value (=A0), and various registers are reset to the initial value. In addition, the data transmitting/receiving unit M15 (FIG. 7) of the storage device 130 sets the data transmission and reception directions to the direction in which the storage device 130 receives the data from the sub controller 50.

In the process of the side of the storage device being started, the memory control circuit 136 receives SOF (Start Of Frame) data in Step S210. The SOF data are a signal for notifying start of communication of the sub controller 50 with respect to the storage device 130. In Step S220, the memory control circuit 136 receives the identification data (ID number). As illustrated in FIG. 10, the identification data include the original identification data ID and the inverted identification data/ID. The inverted identification data/ID are data obtained by inverting the original identification data ID. In this specification, the inverted data have the same amount (the same number of bits) as that of the original data and are data obtained by inverting the value of each of the bits of the original data. Hereinafter, the inverted data of the original data is denoted by a symbol "/" (slash symbol) added to the front portion of the symbol of the original data. For example, in the case of the original data ID=(01001001), the inverted data/ID=(10110110).

In Step S225, the ID comparison unit M11 determines whether or not the received identification data are normal. More specifically, the ID comparison unit M11 performs Exclusive OR operation bit by bit with respect to, the original identification data ID and the inverted identification data/ID to determine whether or not all the values are "1" (refer to FIG. 10). According to the process, it is possible to determine whether or not there is no communication error in the received identification data. In the case where there is no communication error, the received identification data are determined to be normal. In the case where there is a communication error, the received identification data are determined not to be normal. In the case where the received identification data are determined not to be normal, the ID comparison unit M11 does not perform any process, and the procedure is ended.

On the other hand, in the case where the received identification data are determined to be normal, in Step S230, the ID comparison unit M11 determines whether or not the first identification data (the first ID number) allocated to the storage device 130 itself and the received original identification data (the second ID number) are consistent with each other. At this time, the read/write controller M14 reads the ID number stored in the A0 row in FIG. 8. The ID comparison unit M11 compares the first ID number read by the read/write controller M14 with the second ID number transmitted from the communication processing unit 55 bit by bit. If the two ID numbers are determined not to be consistent with each other, the memory control circuit 136 does not perform any process, and the procedure is ended. In addition, with respect to the data transmitting/receiving unit M15 (FIG. 7) of the storage device 130, the data transmission and reception directions are set to the transmission direction, so that the data transmitting/receiving unit M15 is set to the data non-receivable state. More specifically, a 3-state buffer 158 in the reception direction is set to the high impedance state.

In this manner, if the two ID numbers are determined to be consistent with each other, in Step S240, the memory control circuit 136 receives the command data supplied through the data signal CSDA. As illustrated in FIG. 10, the command data include original command data CM and inverted command data/CM. The inverted command data/CM are data obtained by inverting the original command data CM. In addition, among the 8 bits of the original command data CM, the upper 4 bits and the lower 4 bits have a relationship of inversion therebetween. In Step S245, the command analyzing unit M12 determines whether or not the received command data are normal. More specifically, the command analyzing unit M12 determines whether or not the upper 4 bits and lower 4 bits of the original command data CM have a relationship of the inverted data therebetween. In addition, the command analyzing unit M12 determines whether or not the upper 4 bits and lower 4 bits of the inverted command data/CM have a relationship of the inverted data therebetween. In addition, the command analyzing unit M12 performs Exclusive OR operation bit by bit with respect to the original command data CM and the inverted command data/CM to determine whether or not all the values are "1". As a result, in the case where (i) the upper 4 bits and lower 4 bits of the original command data CM have a relationship of the inverted data therebetween, (ii) the upper 4 bits and lower 4 bits of the inverted command data/CM have a relationship of the inverted data therebetween, and (iii) in the result of Exclusive OR operation with respect to the original command data CM and the inverted command data/CM, all the bits are "1", the command analyzing unit M12 determines that the received command data are normal (there is no communication error). On the other hand, in the case where any one of the three conditions (i) to (iii) is not satisfied, the command analyzing unit M12 determines that the received command data are not normal (there is a communication error).

If the command data are determined not to be normal, the memory control circuit 136 ends the process. On the other hand, in the case where the command data are determined to be normal, in Step S250, the command analyzing unit M12 analyzes the command data to determine the type of the command (access type). Herein, it is preferable that the types of the command data include at least a writing command, a reading command, and a write locking command. The writing command is a command of instructing writing data in the memory cell array 132. The reading command is a command of instructing reading data from the memory cell array 132. The write locking command is a command of instructing writing the write locking flag in the control area CTA (FIG. 8). The memory control circuit 136 performs the processes according to the commands indicated by the command data (Steps S260, S270, and S280). In addition, as a result of determination of the type of command, in the case where the command is not any one of the commands with respect to the storage device 130, the command analyzing unit M12 determines that the command data are non-analyzable. If the command analyzing unit M12 determines that the command data are non-analyzable, the memory control circuit 136 proceeds to the end, so that any process is not performed (not shown).

In addition, the steps of the flowchart illustrated in FIG. 11 may be performed in the order which is arbitrary changed or simultaneously within a range where contradiction does not occur in the process contents. For example, the memory control circuit 136 may verify the consistency of the ID number (the identification data) in Step S230 and, after that, determine whether or not the identification data are normal in Step S225. In addition, the memory control circuit 136 may determine whether or not the identification data are normal in Step S225 and, simultaneously, receive the command data in Step S240.

Figure 12:
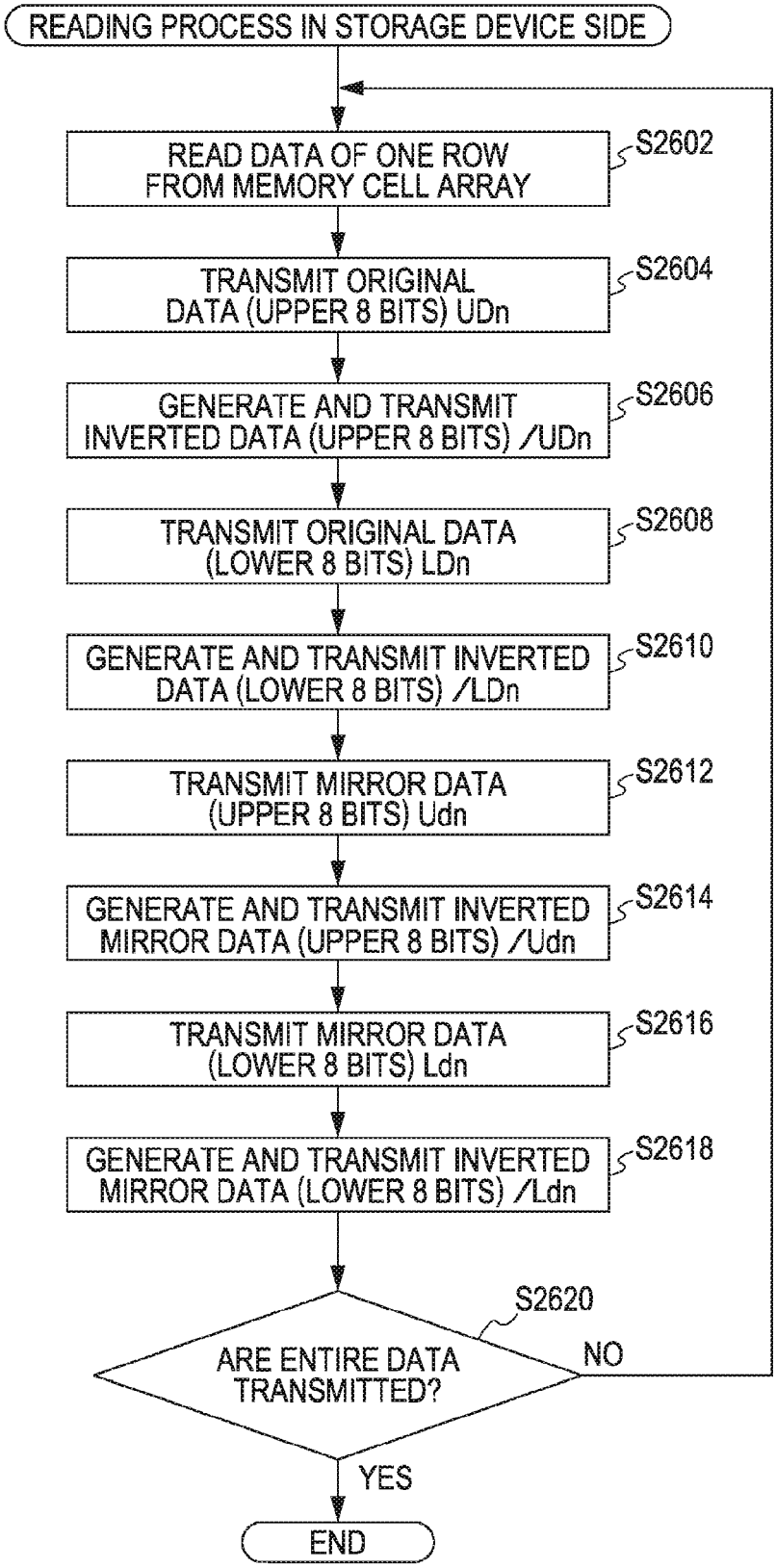
FIG. 12 is a flowchart illustrating a process routine in a reading process of a storage device side.

FIG. 12 is a flowchart illustrating a process routine of the reading process (Step S260 of FIG. 11) of the storage device side. The read/write controller M14 of the memory control circuit 136 reads data in units of a row from the memory cell array 132 according to the address selected by the address counter M13 and sequentially transmits the data bit by bit as the data signal CSDA to the communication processing unit 55. In addition, in the reading process, the data transmitting/receiving unit M15 (FIG. 7) sets the data transmission and reception directions to the transmission direction. In addition, the counter controller M16 supplies a control signal to the address counter M13 so that the first row of the reading object is designated with the A1 row (FIG. 8). After that, in Step S2602, the read/write controller M14 reads data of one row (32 bits) from the memory cell array 132 and stores the data in a register (not shown) based on an address designated by the count value of the address counter M13. In addition, in the following processes, the data which are to transmitted to the communication processing unit 55 are first stored in the output register 150 (FIG. 7) and, after that, are transmitted.

The 32-bit data of one row include the following four data (FIG. 8).

(1) original data upper 8 bits UDn (n indicates a row address)

(2) original data lower 8 bits LDn (3) mirror data upper 8 bits Udn (mirror data of original data upper 8 bits UDn)

(4) mirror data lower 8 bits Ldn (mirror data of original data lower 8 bits LDn)

The data transmitting/receiving unit M15 transmits the uppermost 8 bits among the 32-bit data of one row as the original data upper 8 bits UDn to the sub controller 50 (Step S2604). Subsequently, the inverted data generation unit M18 generates the inverted original data upper 8 bits/UDn by inverting each bit of the original data upper 8 bits UDn. Next, the data transmitting/receiving unit M15 transmits the inverted original data upper 8 bits/UDn to the sub controller 50 (Step S2606). Subsequently, the data transmitting/receiving unit M15 transmits the 8 bits of the 9-th to 16-th bits as the original data lower 8 bits LDn to the sub controller 50 (Step S2608). Subsequently, the inverted data generation unit M18 generates the inverted original data lower 8 bits/LDn by inverting each bit of the original data lower 8 bits LDn. Next, the data transmitting/receiving unit M15 transmits the generated inverted original data lower 8 bits/LDn to the sub controller 50 (Step S2610). Subsequently, the data transmitting/receiving unit M15 transmits the 8 bits of the 17-th to 24-th bits as the mirror data upper 8 bits Udn to the sub controller 50 (Step S2612). Subsequently, the inverted data generation unit M18 generates the inverted mirror data upper 8 bits/Udn by inverting each bit of the mirror data upper 8 bits Udn. Next, the data transmitting/receiving unit M15 transmits the generated inverted mirror data upper 8 bits/Udn to the sub controller 50 (Step S2614). Subsequently, the data transmitting/receiving unit M15 transmits the 8 bits of the 25-th to 32-th bits as the mirror data lower 8 bits Ldn to the sub controller 50 (Step S2616). Subsequently, the inverted data generation unit M18 generates the inverted mirror data lower 8 bits/Ldn by inverting each bit of the mirror data lower 8 bits Ldn. Next, the data transmitting/receiving unit M15 transmits the generated inverted mirror data lower 8 bits/Ldn to the sub controller 50 (Step S2618).

In this manner, if the transmission of the data of one row and the inverted data thereof, that is, a total sum of 64 bits is ended, the memory control circuit 136 determines whether or not the transmission of the entire data is completed (Step S2620). In the case where the transmission of the entire data is not completed, the procedure returns to Step S2602, and the processes of Steps S2602 to S2618 are repeated with respect to the data of the next row of the memory cell array 132. If the transmission of the entire data is completed, the memory control circuit 136 ends the reading process.

In addition, in the processes of FIG. 12, the data of one row are read from the memory cell array 132 in Step S2602. However, if the data are transmitted in synchronization with the clock signal supplied to the storage device 130 after the reception of the command data in the order of from Step S2604 to Step S2618, the reading of data from the memory cell array 132 may not be performed in units of a row.

Figure 13:
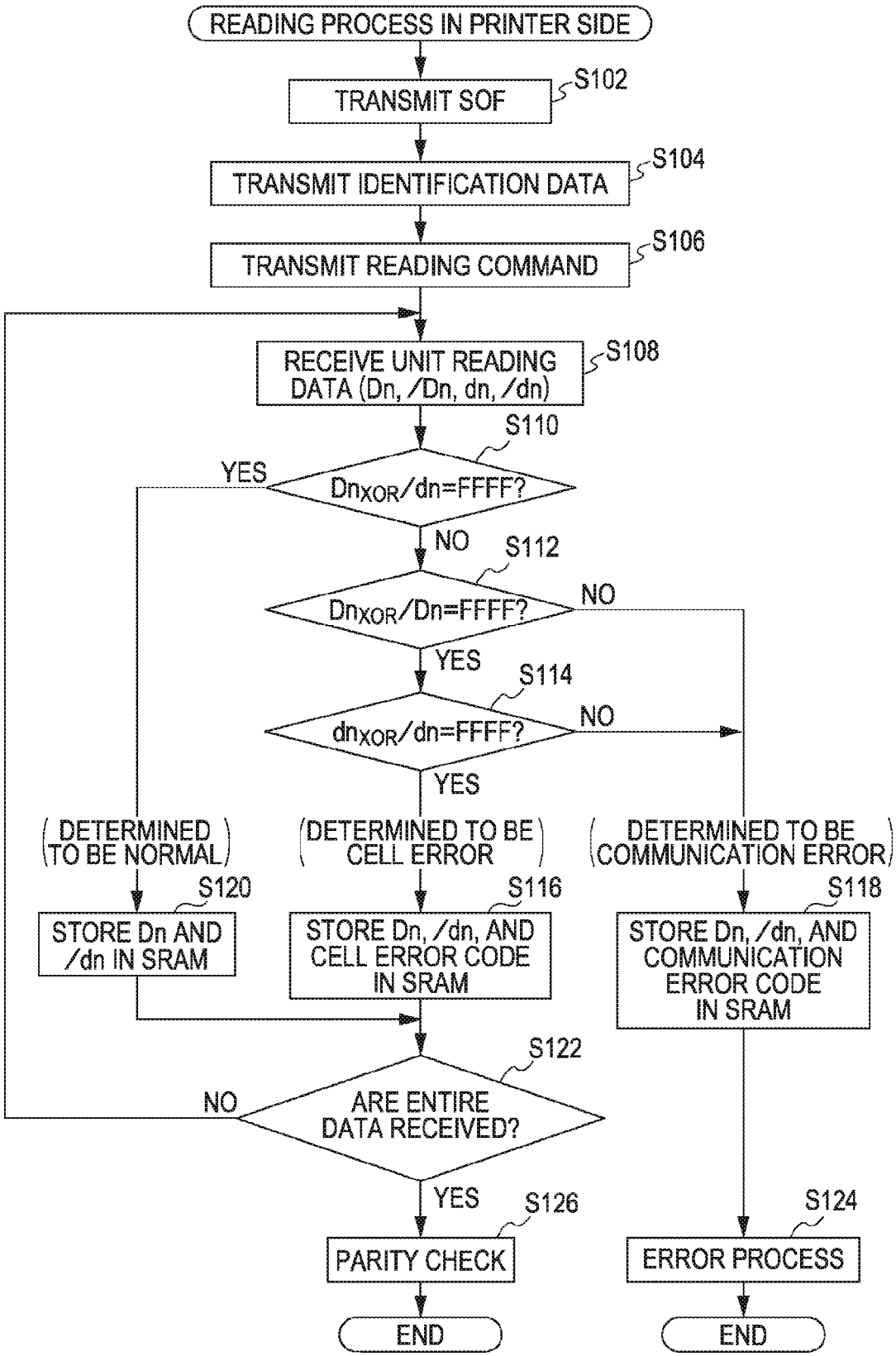
FIG. 13 is a flowchart illustrating a process routine of a reading process with respect to a storage device of a printer side.

FIG. 13 is a flowchart illustrating a process routine of the reading process with respect to the storage device 130 performed by the sub controller 50 of the printer 20. The communication processing unit 55 transmits the SOF data (FIG. 10) of Step S102. In Steps S104 and S106, the communication processing unit 55 transmits an operation code (FIG. 10) subsequently to the SOF data. The operation code is data to which the identification data and the command data are subsequent. The identification data are identification information of designating the storage device 130 of the ink cartridge 100 which is to be read and include the 8-bit original identification data ID and the inverted identification data/ID thereof. The inverted identification data/ID are generated based on the original identification data ID by the main controller 40 or the communication processing unit 55. In this manner, due to the duplexing of the identification data, the possibility that the storage device 130 of the ink cartridge 100 which is not a process object is erroneously operated may be reduced.

In Step S106, the communication processing unit 55 transmits the command data. The command data are data for transmitting the type (writing, reading, or the like) of access to the storage device 130. The command data include the 8-bit original command data CM and the inverted command data/CM (FIG. 10). The command data transmitted in the reading process are a read command. In addition, among the 8 bits of the original command data CM, the upper 4 bits and lower 4 bits have a relationship of inversion therebetween. The inverted command data/CM are generated based on the original command data CM by the main controller 40 or the communication processing unit 55. In this manner, due to the multiplexing of the command data, the possibility of malfunction of the storage device 130 may be reduced.

In Step S108, the communication processing unit 55 starts the reception of the reading data, which are transmitted from the storage device 130, from the next clock signal CSCK after the transmission of the command data is ended. The communication processing unit 55 receives the reading data corresponding to one row of the storage device 130 as one unit. More specifically, the communication processing unit 55 sequentially receives unit reading data of 8 bits×8=64 bits bit by bit in synchronization with the rising edge of the clock signal CSCK. The 64-bit unit reading data include the following eight data (FIG. 10).

(1) original data upper 8 bits UDn (n indicates a row address)
(2) inverted original data upper 8 bits/UDn
(3) original data lower 8 bits LDn
(4) inverted original data lower 8 bits/LDn
(5) mirror data upper 8 bits Udn (mirror data of original data upper 8 bits UDn)
(6) inverted mirror data upper 8 bits/Udn
(7) mirror data lower 8 bits Ldn (mirror data of original data lower 8 bits LDn)
(8) inverted mirror data lower 8 bits/Ldn In addition, the inverted data/UDn, /LDn, /Udn, and /Ldn are data generated by the inverted data generation unit M18 in the storage device 130.

In this specification, the following terminology of the data is also used.

(a) original data Dn: original data upper 8 bits UDn+original data lower 8 bits LDn
(b) inverted data/Dn: inverted original data upper 8 bits/UDn+inverted original data lower 8 bits/LDn
(c) mirror data dn: mirror data upper 8 bits Udn+mirror data lower 8 bits Ldn
(d) inverted mirror data/dn: inverted mirror data upper 8 bits/Udn+inverted mirror data lower 8 bits/Ldn In other words, the unit reading data received by the communication processing unit 55 may be data including the original data Dn, the inverted data/Dn, the mirror data dn, and the inverted mirror data/dn. Finally, by repeating the reception of the unit reading data, the communication processing unit 55 reads all the data in the storage device 130.

If the one set of the unit reading data is received, the communication processing unit 55 temporarily stores the unit reading data in a register (not shown) and performs Step S110 and the following steps in FIG. 11. In Step S110, the communication processing unit 55 first determines whether or not the Exclusive OR operation of the m-th value (m is an integer of 1 or more and 16 or less) of the original data Dn and the m-th value of the inverted mirror data/dn among the unit reading data is TRUE "1" with respect to all m's (FIG. 10). In the case where the result of the Exclusive OR operation is TRUE, that is, FFFFh ("h" of the end indicates the hexadecimal form) with respect to all 16 bits, the communication processing unit 55 determines that the communication state and the memory cell of the reading side are normal. In other words, in the case where the Exclusive OR operation of the original data Dn and the inverted mirror data/dn is FFFFh, it may be estimated that the original data Dn and the mirror data dn which are stored in the storage device 130 are equal to each other and both of the original data Dn and the inverted mirror data/dn are correctly transmitted. Therefore, in this case, it may be determined that both of the state of the memory cell in the storage device 130 and the state of communication between the communication processing unit 55 and the storage device 130 are normal. If both of the memory cell state and the communication state are determined to be normal, in Step S120, the communication processing unit 55 stores the original data Dn and the inverted mirror data/dn in the SRAM 551.

On the other hand, in the case where the result of the Exclusive OR operation is FALSE "0" with respect to any one of 16 bits, that is, in the case where the result is not FFFFh, in Step S112, the communication processing unit 55 determines whether or not the Exclusive OR operation of the original data Dn and the inverted data/Dn is FFFFh. In the case where the result of the Exclusive OR operation is FFFFh, in Step S114, the communication processing unit 55 determines whether or not the Exclusive OR operation of the mirror data dn and the inverted mirror data/dn is FFFFh. In the case where the Exclusive OR operation of the original data Dn and the inverted data/Dn is not FFFFh, or in the case where the Exclusive OR operation of the mirror data do and the inverted mirror data/dn is not FFFFh, the communication processing unit 55 determines that there is a communication error. The reason why it is possible to determine that there is a communication error is that the data and the corresponding inverted data are not correctly received. In this case, in Step S118, the communication processing unit 55 stores the original data Dn and the inverted mirror data/dn in the SRAM 551 and stores a predetermined communication error code indicating the communication error in the error code register 553 in the communication processing unit 55. Next, in Step S124, the communication processing unit 55 performs a predetermined error process and ends the process. The error code register 553 may inclusively store information identifying whether or not a communication error occurs in the transmission of the original data from the storage device (corresponding to NO of Step S112) and whether or not a communication error occurs in the transmission of the mirror data from the storage device (corresponding to NO of Step S114). In the error process of Step S124, for example, the communication error may be notified to the main controller 40, or the message that the reading process is ended may be notified thereto. In addition, Step S124 may be omitted. Since data may not be correctly received in the state where the communication error occurs, the communication processing unit 55 ends the reading process after Step S124.

Since the main controller 40 may recognize the occurrence of a communication error by referring to a communication error code stored in the SRAM 551, an appropriate process may be performed according to the communication error. For example, in the case where the occurrence of a communication error in one of the original data Dn and the mirror data dn may be recognized, the main controller 40 performs various process (for example, checking of the remaining ink amount, notifying the remaining ink amount to the user, or the like) by using the data in which a communication error does not occur. Alternatively, the main controller 40 performs moving and stopping of the carriage 30 by using the carriage motor 32 (FIG. 1) to try to improve the communication state (the contact state of terminals) and, after that, transmits the reading command to the sub controller 50 again to allow the sub controller 50 to perform the reading process.

In the case where the Exclusive OR operation of the original data Dn and the inverted data/Dn is FFFFh in Step S112 and the Exclusive OR operation of the mirror data dn and the inverted mirror data/dn is FFFFh in Step S114, the communication processing unit 55 determine that there is a memory cell error in the storage device 130. The reason why it is possible to determine that there is a memory cell error is as follows. Since the data and the corresponding inverted data are correctly received, there is no communication error. However, the possibility that there is no consistency between the data stored in the original data area of the storage device 130 and the data stored in the mirror data area thereof is high. In this case, in Step S116, the communication processing unit 55 stores the original data Dn and the inverted mirror data/dn in the SRAM 551 and stores a predetermined memory cell error code indicating the memory cell error in the error code register 553 of the communication processing unit 55. The memory cell error denotes a problem in that one of the memory cell storing the original data Dn of the process object and the memory cell storing the mirror data do of the process object is in the state where the memory cell itself is disordered, so that the stored information may not be correctly stored.

After Step S120 or Step S116 is performed, in Step S122, the communication processing unit 55 determines whether or not the reception of the entire data which are to be read is completed. In the case where the reception of the entire data is completed, the communication processing unit 55 ends the reading process. More specifically, as illustrated in FIG. 10, if the reading process is ended, the communication processing unit 55 changes the reset signal CRST from the high level to the low level and stops supplying the clock signal CSCK. If the supplying of the clock signal CSCK is stopped, the communication processing unit 55 subsequently stops supplying the power supply voltage CVDD. In the case where the reading of the entire data is not completed, the procedure returns to Step S108, and the aforementioned processes are repeated with respect to the next unit reading data. For example, the processes of Steps S108 to S122 are performed on the unit reading data D1, /D1, d1, and /d1 of the first row, and after that, the aforementioned processes are performed on the unit reading data D2, /D2, d2, and /d2 of the second row. In addition, the "first row" corresponds to the A1 row of FIG. 8, and the "second row" corresponds to the A2 row. The reading process is repeated until the entire data in the storage device 130 are read. Alternatively, the main controller 40 may designate the last row of the reading process so that the sub controller 50 performs the reading process up to the designated row.

In the case where the ID comparison unit M11 or the command analyzing unit M12 determines that there is a communication error in the identification data ID or the command data CM, when the memory control circuit 136 ends the process without performing any process, the storage device 130 does not transmit data in the time period when the reading data are transmitted. As described above, when there is no exchange of data between the sub controller 50 and the storage device 130, the data signal line LD1 is maintained in the low level by the resistor R1 (FIG. 6) of the sub controller 50. Since all the data received in the reception time period of the original data Dn and the inverted data/Dn are the data of the low level, Step S112 of FIG. 13 leads to NO, so that the communication processing unit 55 determines that there is a communication error. By the reading process, the entire data in the storage device 130 are temporarily stored in the SRAM 551. In addition, in the case where the communication error or the memory cell error occurs in the data in the rewritable area RWA, the error code is stored in the error code register 553 of the communication processing unit 55. The original data Dn, the inverted mirror data/dn, the communication error, and the cell error code stored in the communication processing unit 55 are acquired by the main controller 40 and stored in the memory in the main controller 40.

In Step S126, the main controller 40 performs the parity check on the original data Dn and the inverted mirror data/dn which are determined to have the memory cell error. As described with reference to FIG. 8, the original data Dn and the inverted mirror data/dn stored in the rewritable area RWA includes the 15-bit actual data and the parity bit P. The main controller 40 may perform various process (checking of the remaining ink amount, notifying of the remaining ink amount to the user, or the like) associated with the remaining ink amount by using the data in which the actual data and the parity bit are in the consistent state among the original data Dn and the inverted mirror data/dn which are determined to have the memory cell error. As a result of the parity check, in the case where both of the original data Dn and the inverted mirror data/dn have the parity error or in the case where both of the data Dn and /dn have the consistency with the parity bit, the possibility that there is a memory cell error is high. In this case, a message of notifying the memory error of the ink cartridge 100 to the user may be displayed on a display panel of the manipulation unit 70. In addition, in the case where the main controller 40 performs reading the data in the rewritable area RWA in order to check the result of the writing of the data written in the rewritable area RWA, the main controller 40 compares the data for writing stored in the main controller 40 with the original data Dn and the inverted mirror data/dn, which are determined to have the memory cell error, to determine whether or not the data are correct.

It is preferable that the parity check in Step S126 is also performed on the data in the read-only area ROA. In this manner, the parity check is not performed during the reading process, but it is performed after the reading process is completed. Therefore, as illustrated in FIG. 8, although the parity bit P of the read-only area ROA is stored in the last portion of the read-only area ROA, this does not lead to the delay in the reading process or the parity check process. In addition, since the data in the read-only area ROA includes an 8-bit character code, if the parity bit P is collectively disposed at the last end portion, there is an advantage in that the main controller 40 does not necessarily perform bit shift control in order to obtain the actual data. On the other hand, since the data in the rewritable area RWA does not include an 8-bit character code and the actual data may be sufficiently expressed by 15 bits or less, if the parity bit P is disposed at the last bit of the 16 bits, there is an advantage in that the data in the writing process or the reading process may be easily treated.

In the reading process according to the embodiment, by the determinations of Steps S110 to S114, in the case where the read data are determined to be normal or in the case where it is determined that there is a communication error, the parity check is not performed. Only in the case where it is determined that there is a memory cell error, the parity check is performed. Therefore, in comparison with the case where the parity check is performed on all the data, it is possible to simplify the process. However, even in the case where the read data are determined to have a communication error, the parity check may be performed. In this case, in the case where there is no consistency between the original data Dn and the inverted mirror data/dn, the parity check is performed.

In addition, in Step S110, although the consistency between the original data Dn and the inverted mirror data/dn is determined, as an alternative configuration, the consistency between the original data Dn and the mirror data dn may be determined, or the consistency between the inverted data of the original data Dn and the mirror data dn may be determined. It may be understood that the three determinations have a common point in that the consistency between the original data Dn and the mirror data dn (that is, the two sets of data included in one row of the memory cell array) is determined. It is preferable that the parity check in the reading process is performed in the case where there is no consistency between the two sets of data read from the memory cell array. Accordingly, it is possible to improve reliability of the data which are transmitted and received through communication.

After the reading process, the main controller 40 performs a predetermined control process (for example, checking of the remaining ink amount, notifying of the remaining ink amount to the user, or the like) on the original data Dn and the inverted mirror data/dn, which are not allocated with an error code, by using the original data Dn. In the case where the original data Dn and the inverted mirror data/dn which are allocated with a communication error code exist, the main controller 40 performs, for example, a communication error treatment process such as a process of displaying a message for prompting the user on a display panel of the manipulation unit 70 so that the attachment of the ink cartridge 100 is reconsidered.

In the reading process described hereinbefore, since the original data Dn and the inverted data/Dn thereof are transmitted from the storage device 130 to the sub controller 50, the side of the sub controller 50 checks the consistency between the original data Dn and the inverted data/Dn, so that it is possible to determine the existence of a communication error. As a result, it is possible to improve reliability of communication between the sub controller 50 and the storage device 130. Therefore, it is possible to reduce the possibility of occurrence of problems such as a malfunction of the printer 20. In addition, in the reading process with respect to the storage device 130, since the original data Dn and the inverted data/Dn have a relationship such that the corresponding bits are inverted, for example, in the case where a communication error where only one of the low level and the high level occurs on the data signal line LD1 occurs due to the defective contact between the data terminal 260 of the ink cartridge 100 and the corresponding terminal of the side of the printer 20, it is possible to reliably determine the communication error. In addition, in the reading process with respect to the storage device 130, since the storage device 130 transmits the mirror data dn which is the data substantially the same as the original data Dn and the inverted mirror data/dn which is the data substantially the same as the inverted data/Dn to the sub controller 50, for example, although there is no consistency between the original data Dn and the inverted data/Dn due to the communication error, if there is consistency between the mirror data dn and the inverted mirror data/dn, the side of the printer 20 may continuously perform the process by using one of the mirror data dn and the inverted mirror data/dn, so that the communication error resistance is improved. In addition, the storage device 130 stores the original data Dn and the mirror data dn in the memory cell array 132 and transmits both thereof to the printer 20. As a result, although the memory cell error occurs in one of the original data area and the mirror data area of the memory cell array 132, the side of the printer 20 may continuously perform the normal process by using the data stored in the area where the memory cell error does not occur. Therefore, the cell error resistance is improved, so that it is possible to greatly suppress a defect ratio of the storage device 130.

In addition, when the original data Dn, the inverted data/Dn, the mirror data dn, and the inverted mirror data/dn are received, the printer 20 according to the embodiment first checks the consistency between the original data Dn and the inverted mirror data/dn. In the case where there is no consistency between the original data Dn and the inverted mirror data/dn, the printer 20 checks the consistency between the original data Dn and the inverted data/Dn and the consistency between the mirror data dn and the inverted mirror data/dn. Next, in the case where there is no consistency between the original data Dn and the inverted mirror data/dn and there are the consistency between the original data Dn and the inverted data/Dn and the consistency between the mirror data dn and the inverted mirror data/dn, it is determined that there is a memory cell error. In addition, in the case where there is no consistency between the original data Dn and the inverted mirror data/dn and the consistency between the original data Dn and the inverted data/Dn or the consistency between the mirror data dn and the inverted mirror data/dn, it is determined that there is a communication error. Accordingly, the printer 20 may correctly recognize the type of error, so that it is possible to perform the process according to the type of error.

In addition, in the embodiment, in the memory cell array 132 (FIG. 8), the actual data and the parity bit P are stored in the original data area, and the actual data and the parity bit P are stored in the mirror data area. In the reading process with respect to the rewritable area RWA, the actual data (upper 15 bits) and the parity bit P (lower 1 bit) stored in the original data area are transmitted from the storage device 130 to the sub controller 50, and the actual data (the upper 15 bits) and the parity bit P (lower 1 bit) stored in the mirror data area are transmitted from the storage device 130 to the sub controller 50. Therefore, the printer 20 which receives the data performs the parity check on the actual data stored in the original data area and performs the parity check on the actual data stored in the mirror data area. Next, although a parity error occurs in one of the actual data stored in the original data area and the actual data stored in the mirror data area, the main controller 40 continuously performs the normal process by using the actual data in which the parity error does not occur. As a result, communication error resistance and cell error resistance are improved.

E. Writing Process with Respect to Storage Device

Figure 14:
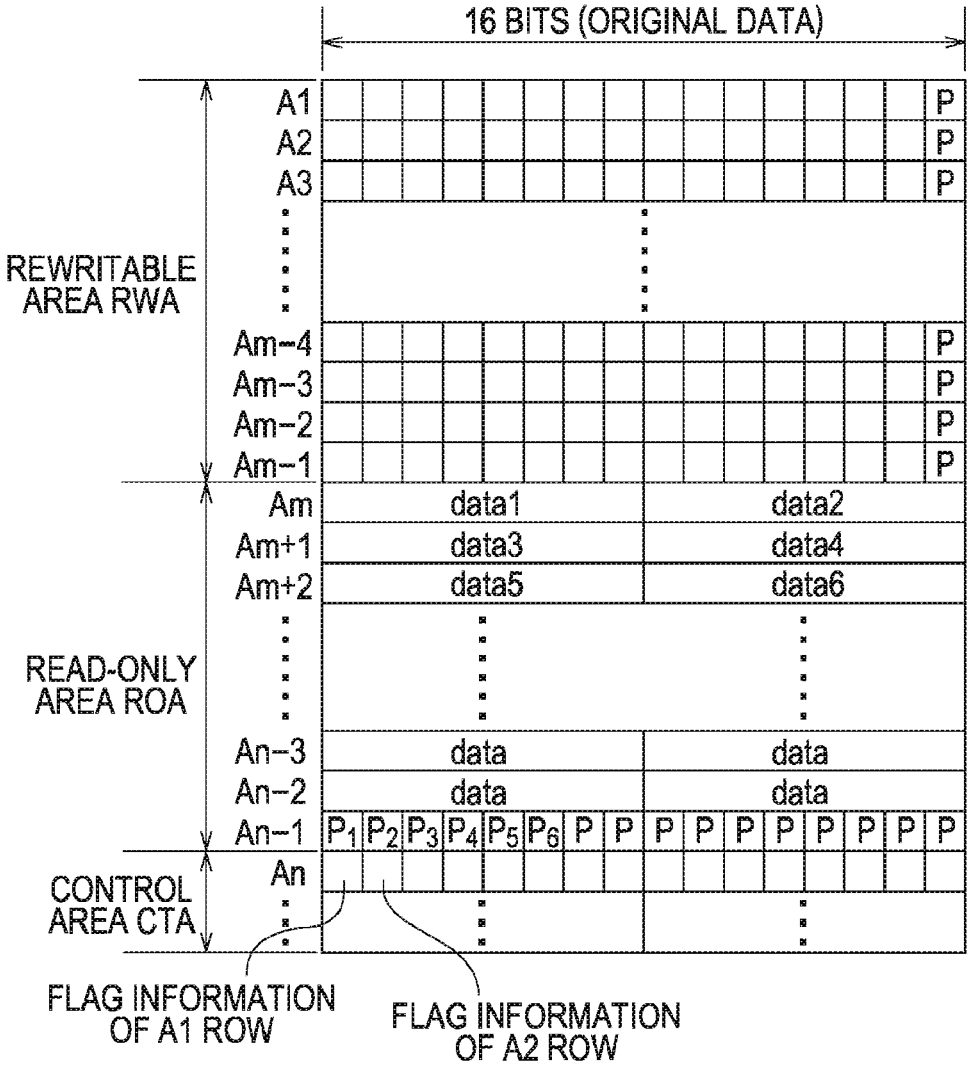
FIG. 14 is a schematic diagram illustrating a memory map which is recognized by a printer side in a writing process with respect to a storage device.

FIG. 14 is a schematic diagram illustrating the memory map of the storage device 130 which is recognized by the main controller 40 of the side of the printer 20 in the writing process with respect to the storage device 130. At the time of the writing process, the main controller 40 and the sub controller 50 recognizes the memory map as the memory map of the writing object area in the storage device 130. In other words, at the time of the writing process, it is recognized that only the original data area (the left half of FIG. 8) among the actual memory cell array 132 (FIG. 8) exists and the mirror data area does not exist. In addition, it is recognized that one row of the original data area is 16 bits. In the SRAM 551 in the sub controller 50, the memory area illustrated by the memory map is secured as the writing data area. However, with respect to the number of rows of the writing data area, the number of row which is the same as the number of rows of the rewritable area RWA may be prepared, and the read-only area ROA or the control area CTA may be omitted.

The main controller 40 of the printer 20 allows the sub controller 50 to write the data, which are to be written in the storage device 130 of a predetermined ink cartridge 100, in the SRAM 551 through the bus BS. As described above, at the time of the writing process the main controller 40 recognizes that the storage device 130 is a 1-row 16-bit memory. Therefore, the data which are to be written in the storage device 130 are the actual data of the upper 15 bits and the parity bit P of the lower 1 bit. The parity bit P may be generated by the main controller 40 to be added to the actual data of the upper 15 bits, so that a total sum of the 16-bit data may be written in the SRAM 551. Alternatively, the parity bit P may be generated by the sub controller 50 to be added every time when the main controller 40 writes the 15-bit data in the SRAM 551. After that, the main controller 40 notifies one storage device 130, which is to be a writing object, to the sub controller 50 through the bus BS and transmits the writing command of instructing writing the data, which are written in the SRAM 551, to the storage device 130 which is the writing object. If the writing command is received, the sub controller 50 starts the writing process.

Figure 15A:
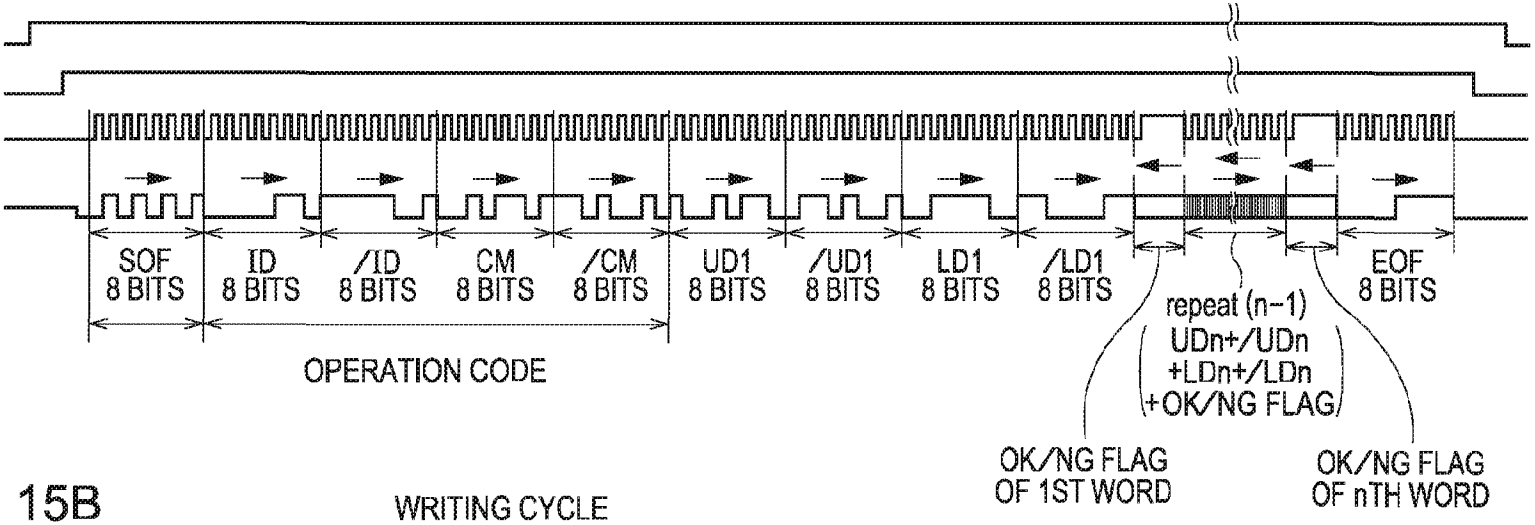
FIGS. 15A and 15B are timing charts schematically illustrating signals which are transmitted and received in a writing process with respect to a storage device.

FIG. 15A is a timing chart schematically illustrating signals which are transmitted and received between the communication processing unit 55 of the printer 20 and the memory control circuit 136 of the storage device 130 in the writing process with respect to the storage device 130. Similarly to FIG. 10, in FIG. 15A, the power supply voltage CVDD, the reset signal CRST, the clock signal CSCK, the data signal CSDA, and the arrows indicating the data directions are illustrated.

If the writing command is received from the main controller 40, the sub controller 50 first supplies the power supply voltage CVDD to each of the ink cartridges 100, so that the storage device 130 of each of the ink cartridges 100 are in the operable state. After the power supply voltage CVDD is supplied from the sub controller 50, the reset signal CRST of the low level is supplied from the sub controller 50, so that the storage device 130 is initialized. In addition, since the reset signal is in the low level at the time of end of the previous access, the reset signal is maintained in the low level from the time before the power supply voltage CVDD is supplied to the storage device 130. After that, the communication processing unit 55 of the sub controller 50 starts the writing process as follows.

At the time of starting the writing process, the communication processing unit 55 first transitions the reset signal CRST fro the low level to the high level and transmits the clock signal CSCK having a predetermined frequency. If the reset signal CRST is changed from the low level to the high level, the memory control circuit 136 of the storage device 130 is in the stand-by state where the data signal CSDA is received from the communication processing unit 55.

Figure 16:
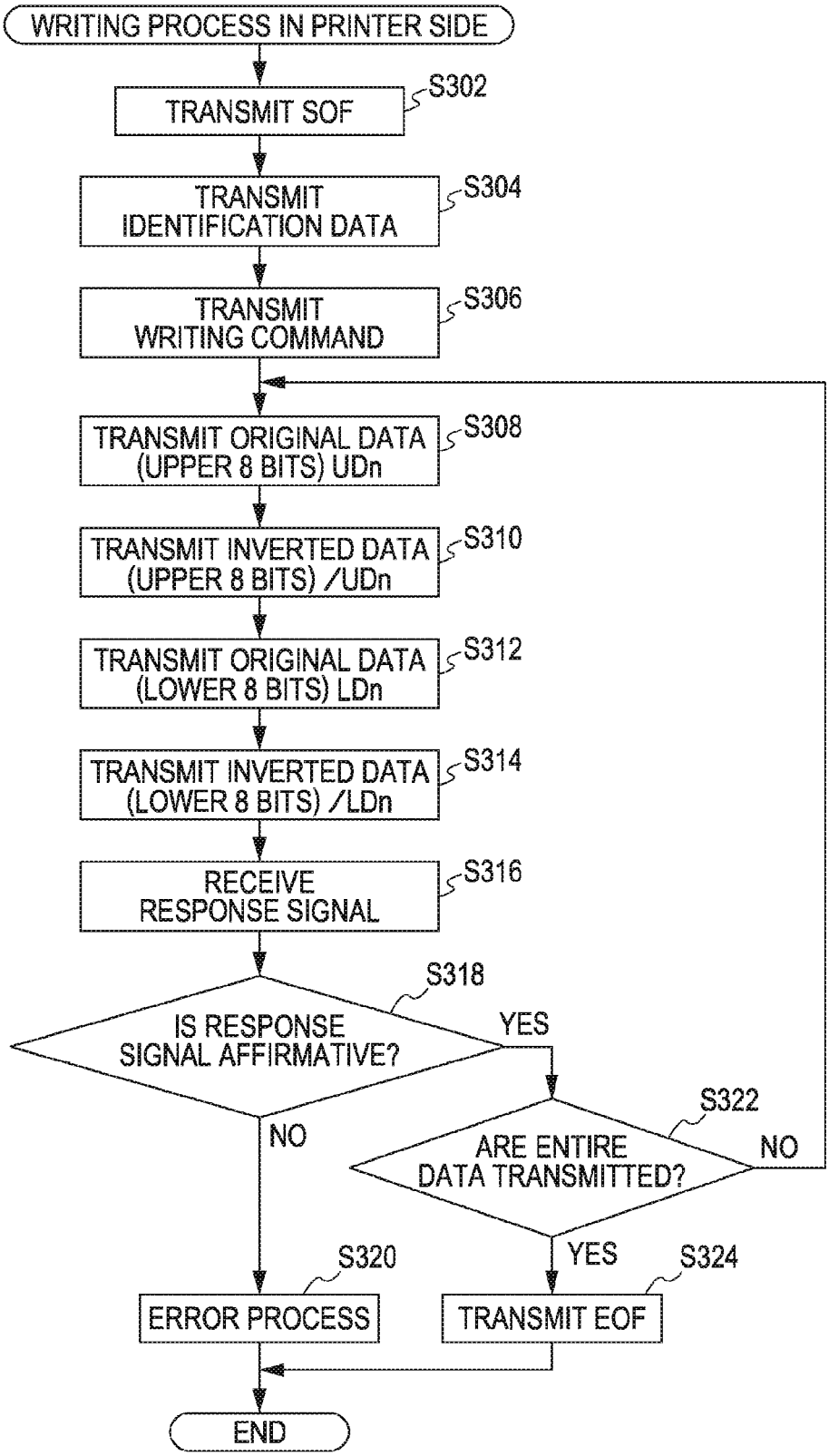
FIG. 16 is a flowchart illustrating a process routine of a writing process with respect to a storage device of printer side.

FIG. 16 is a flowchart illustrating a process routine of the writing process with respect to the storage device 130 performed by the sub controller 50 of the side of the printer 20. Similarly to the aforementioned reading process, the communication processing unit 55 first transmits the SOF data as the data signal CSDA (Step S302). Similarly to the aforementioned reading process, the communication processing unit 55 transmits the identification data as the data signal CSDA subsequently to the SOF data (Step S304). The communication processing unit 55 transmits the command data as the data signal CSDA subsequently to the identification data (Step S306). The command data transmitted in the writing process is a write command.

Figure 15B:
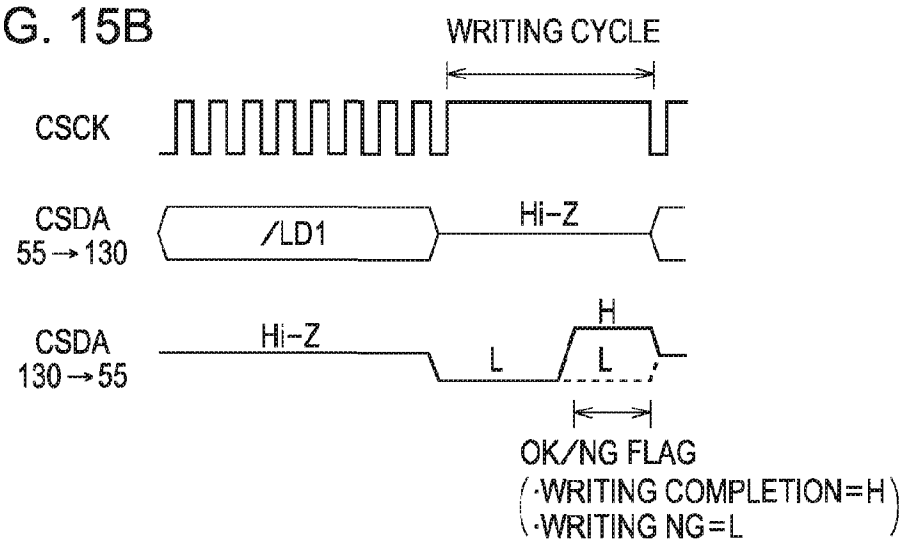

The communication processing unit 55 transmits the writing data to the storage device 130 from the next clock signal CSCK after the transmission of the command data is ended. At this time, data are transmitted in synchronization with a falling edge of the clock signal CSCK, and data are received in synchronization with a rising edge of the clock signal CSCK in the storage device 130. The writing data are transmitted in the order of rows from the data which are written in the A1 row among the data corresponding to the original data. More specifically, the communication processing unit 55 sequentially transmits the unit writing data of 8 bits×4=32 bits bit by bit (FIGS. 15A and 15B). The 32-bit unit writing data include original data upper 8 bits UDn, inverted original data upper 8 bits/UDn, original data lower 8 bits LDn, and inverted original data lower 8 bits/LDn. The communication processing unit 55 transmits a total sum of 32-bit data UDn, /UDn, LDn, and /LDn in this order (Steps S308 to S314).

The communication processing unit 55 receives the 1-bit response signal from the memory control circuit 136 in synchronization with the next clock signal CSCK after the transmission of the unit writing data is ended (Step S316). The response signal of the high level (hereinafter, referred to as an "OK response signal" or an "OK flag") is a signal indicating that the side of the storage device 130 correctly receives the unit writing data, and the response signal of the low level (hereinafter, referred to as an "NG response signal" or an "NG flag") is a signal indicating that the side of the storage device 130 does not correctly receive the unit writing data. With respect to the response signal, the reason why the OK response signal is configured to be in the high level is that, as illustrated in FIG. 6, the data signal line LD1 is connected to the potential of the low level through the pull-down resistor R1. According to the configuration, for example, when there is defective contact between the data terminal 260 and the terminal 460 of the connection mechanism 400, it is possible to prevent communication from being incorrectly performed and to prevent the OK response signal of the high level from being erroneously input to the communication processing unit 55.

FIG. 15B is an enlarged diagram illustrating the data/LDn of the inverted original data lower 8 bits and portions of the response signal (OK/NG flag). Herein, as the data signal CSDA on the data line LD1, a signal directing from the communication controller 55 to the storage device 130 and a signal directing from the storage device 130 to the communication controller 55 in the opposite direction are separately illustrated. The level (the state of the 3-state buffer circuit 566 of FIG. 7) of the signal directing from the communication controller 55 to the storage device 130 becomes the high impedance state after the transmission of the data/LDn. The time period of the high impedance state corresponds to the writing cycle of the storage device 130. In other words, in writing cycle, the read/write controller M14 (FIG. 6) performs writing data in the memory cell array 132. On the other hand, the level (the state of the 3-state buffer circuit 156 of FIG. 7) of the signal directing from the storage device 130 to the communication controller 55 is completely changed over from the high impedance state to the L level after the reception of the data/LDn. The reason why the signal level is completely changed over to the L level is that, when there is no data exchange between the sub controller 50 and the storage device 130, the data signal line LD1 is maintained in the low level by the resistor R1 (FIG. 6) of the sub controller 50. In the case where the writing of data in the memory cell array 132 is completed, the OK flag of the high level is transmitted from the storage device 130 to the communication controller 55. On the other hand, in the case where the writing of data in the memory cell array 132 is not completed (in the case where the writing does not succeed), the data are not transmitted from the storage device 130 to the communication controller 55, and the signal level remains in the L level (indicated by a broken line). In addition, instead of transmitting no data, the NG flag of the L level may be transmitted in the direction from the storage device 130 to the communication controller 55. In the case where the data is correctly received by the storage device 130 and the writing is completed, the response signal becomes the OK flag of the H level. On the other hand, in the case where the data is not correctly received by the storage device 130 or the writing is not completed, the response signal becomes the NG flag of the L level. Therefore, the communication controller 55 may determines whether or not the data is correctly received by the storage device 130 and the writing is completed by checking the level of the response signal at a predetermined timing in the second half of the writing cycle.

In addition, with respect to the time period (writing cycle) in which the response signal is transmitted from the storage device 130 toward the communication controller 55, the period of the clock signal CSCK is set to be larger than the period thereof at the time of data transmission. This is because the memory cell array 132 used in the embodiment uses an EEPROM and, thus, a relatively long time is taken to perform the writing thereof. In the case where other types of the memory cell arrays (for example, a ferroelectric memory cell array) of which the writing time is short are used, the period of the clock signal CSCK in the writing cycle may be set to be the same as the period thereof at the time of data transmission. In addition, in the case where the period (frequency) of the clock signal is changed, it is preferable that a variable clock generation circuit (not shown) capable of changing the period of the clock signal in the communication processing unit 55 is provided.

In the case where the received response signal is the NG response signal, the communication processing unit 55 performs a predetermined error process (Step S320), and the writing process is ended. In the error process, for example, the transmission of the same unit writing data is retried, and as a result of retries performed predetermined times, in the case where only the NG response signal is obtained, the message is notified to the main controller 40. In this case, the main controller 40 may perform, for example, a communication error treatment process such as a process of displaying a message for prompting the user on a display panel of the manipulation unit 70 so that the attachment of the ink cartridge 100 is reconsidered.

On the other hand, in the case where the received response signal is the OK response signal, the communication processing unit 55 determines whether or not all the to-be-written data are transmitted (Step S322). In the case where all the to-be-written data are transmitted, the communication processing unit 55 transmits an EOF (End Of Frame) data to the storage device 130 (Step S324), and the writing process is ended. As illustrated in FIG. 15, if the writing process is ended, the communication processing unit 55 changes the reset signal CRST from the high level to the low level and stops supplying the clock signal CSCK. The EOF data are, for example, 8-bit data. The EOF data may be meaningful data or simple dummy data. In the case where all the to-be-written data are not transmitted, the communication processing unit 55 returns from Step S322 to Step S308 to repeat the aforementioned processes on the following unit writing data. For example, the communication processing unit 55 performs the aforementioned processes on the unit writing data UD1, /UD1, LD1, and /LD1 of the A1 row, and after that, performs the aforementioned processes on the unit writing data UD2, /UD2, LD2, and /LD2 of the A2 row.

Figure 17:
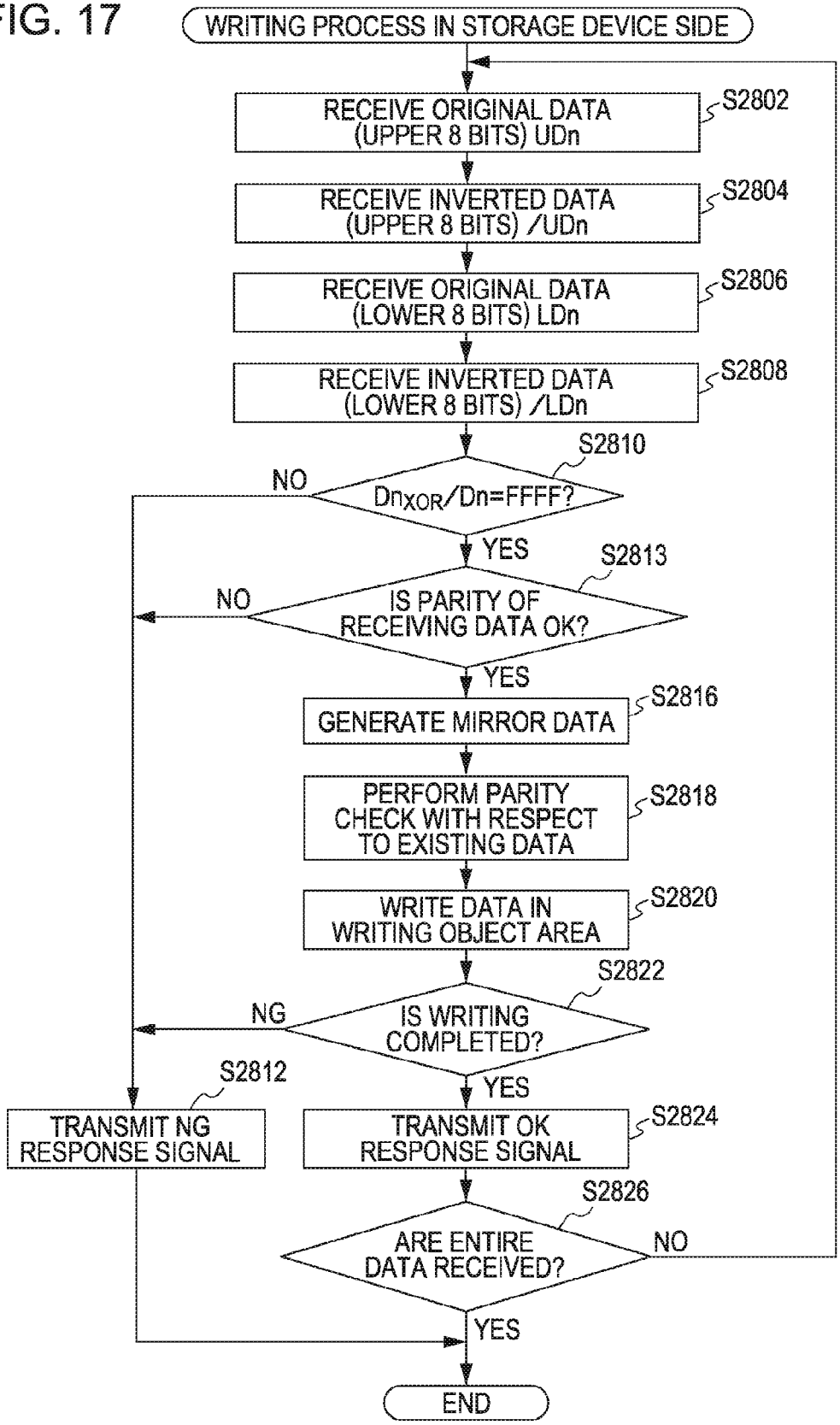
FIG. 17 is a flowchart illustrating a process routine of a writing process with respect to a storage device.

FIG. 17 is a flowchart illustrating a process step of the writing process of the storage device side. In addition, similarly, the aforementioned processes of Steps S210 to S250 in FIG. 11 are also performed in the writing process. In the case of the writing process, the memory control circuit 136 of the storage device 130 receives a write command in Step S240. The memory control circuit 136 which receives the write command performs the writing process of the storage device side in Step S280. FIG. 17 illustrates the detailed procedure of Step S280 in FIG. 11.

In addition, similarly to the reading process, in the writing process, the counter controller M16 initializes the count value of the address counter M13 so that the A1 row is designated as the first row of the writing object. After that, the data transmitting/receiving unit M15 of the memory control circuit 136 receives signals occurring on the data signal line LD1 subsequently to the command data bit by bit in synchronization with the rising edge of the clock signal CSCK and sequentially stores the signals in the input register 152 (FIG. 7). As a result, the data transmitting/receiving unit M15 sequentially receives 32-bit unit writing data UDn, /UDn, LDn, and /LDn (Steps S2802 to 2808 of FIG. 17). After Step S2808 is ended, the data transmitting/receiving unit M15 sets the data transmission and reception directions to the transmission direction in order to transmit the response signal (the NG response signal or the OK response signal) from the storage device 130 to the sub controller 50.

If the unit writing data are received, the data determination unit M19 determines whether or not the result of the Exclusive OR operation of the original data Dn and the inverted data/Dn is TRUE, that is, FFFFh with respect to all the 16 bits (Step S2810). The original data Dn referred herein are 16-bit data including the original data upper 8 bits UDn received in Step S2802 and the original data lower 8 bits LDn received in Step S2806. In addition, the inverted data/Dn are 16-bit data including the inverted original data upper 8 bits/UDn received in Step S2804 and the inverted original data lower 8 bits/LDn received in Step S2808.

In the case where the result of the Exclusive OR operation (the result of determination of the data determination unit M19) is not FFFFh, the data transmitting/receiving unit M15 transmits the NG response signal to the communication processing unit 55 of the sub controller 50 (Step S2812). Herein, when there is no exchange of the data signals, since the data signal line LD1 is in the low level through the pull-down resistor R1, the data transmitting/receiving unit M15 may transmit no response to the communication processing unit 55 of the sub controller 50 instead of transmitting the NG response signal. In this case, the communication processing unit 55 may recognize the state where the data signal line LD1 is in the low level as the NG response signal. Therefore, in this case, the configuration is equivalent to the configuration where the NG response signal is substantially transmitted. If the NG response signal is transmitted, the writing process of the side of the storage device is ended (abnormal ending).

On the other hand, in the case where the result of the Exclusive OR operation (the result of determination of the data determination unit M19) is FFFFh, the data determination unit M19 performs the parity check on the received 16-bit original data Dn to determine the data consistency (Step S2813). As a result of the parity check, in the case where there is no data consistency, the data transmitting/receiving unit M15 transmits the NG response signal to the communication processing unit 55 of the sub controller 50 (Step S2812). Herein, when there is no exchange of the data signals, since the data signal line LD1 is in the row level through the pull-down resistor R1, the data transmitting/receiving unit M15 may transmit no response to the communication processing unit of the sub controller 50 instead of transmitting the NG response signal. This may be considered that the NG response signal is substantially transmitted. If the NG response signal is transmitted, the writing process of the storage device side is ended (abnormal ending). On the other hand, as a result of the parity check, in the case where there is data consistency, the procedure proceeds to the next Step S2816. In the case where the parity of the receiving data is consistent, the copy data generation unit M17 of the memory control circuit 136 generates the mirror data dn which is a copy of the received 16-bit original data Dn (Step S2816). More specifically, the memory control circuit 136 is provided with the input register 152 for receiving the original data Dn and a 16-bit register for storing the mirror data dn, and the mirror data dn are stored in the latter register.

Next, the read/write controller M14 reads the existing data from the storage area (the writing object area RWA) which is the writing object of the original data Dn and the mirror data dn, and the data determination unit M19 performs the parity check on the read existing data (Step S2818). The writing object area which is the object of one-time writing is one row on the memory map in FIG. 8. As illustrated in FIG. 8, the upper 16 bits of the writing object area (area of one row)

constitute the original data area for writing the original data Dn, and the last bit of the original data area stores the parity bit P. The lower 16 bits of the writing object area (area of one row) constitute the mirror data area for writing the mirror data dn, and similarly to the original data area, the last bit of the mirror data area stores the parity bit P. In Step S2818, the parity check is performed on existing data which are stored in the original data area of the writing object area and existing data which are stored in the mirror data area.

If the parity check is ended, the read/write controller M14 performs data writing on the writing object area (Step S2820). For example, in the parity check for the existing data, in the case where there is no parity error in both of the existing data of the original data area and the existing data of the mirror data area of the writing object area, the read/write controller M14 writes the original data Dn, which are received from Steps S2802 and S2806, in the original data area and writes the mirror data dn, which are generated in Step S2816, in the mirror data area. On the other hand, in the parity check, in the case where there is a parity error in the existing data of the original data area of the writing object area and there is no parity error in the existing data of the mirror data area of the writing object area, the read/write controller M14 writes not the received original data Dn but the existing data, in which the parity error exists, in the original data area and writes the mirror data dn, which are generated in Step S2816, in the mirror data area. In addition, in the parity check, in the case where there is no parity error in the existing data of the original data area of the writing object area and there is a parity error in the existing data of the mirror data area of the writing object area, the read/write controller M14 writes the received original data Dn in the original data area and writes the existing data in the mirror data area. In addition, in the parity check, in the case where there is a parity error in both of the existing data of the original data area and the existing data of the mirror data area of the writing object area, the read/write controller M14 writes the corresponding existing data again in the original data area and the mirror data area. In other words, the read/write controller M14 writes the existing data again in the storage area in which there is a parity error and performs data updating with respect to the storage area in which there is no parity error. In this manner, the reason why the data updating is performed is that, with respect to the storage area in which there is a parity error, since one of the cells constituting the storage area is highly likely to be an unreliable cell (defective cell), the storage area is maintained in a parity error state. Accordingly, after that, when the main controller 40 of the side of the printer reads the data of the storage area and performs the parity check (Step S126 of FIG. 13), since there is a parity error in the storage area, the main controller 40 may allow the data not to be used. In addition, instead of performing rewriting of the existing data in the area in which the parity error is detected, the data writing may not be performed on the area in which the parity error is detected.

In the case where the writing of the receiving data is normally completed, the data transmitting/receiving unit M15 transmits the OK response signal to the communication processing unit 55 (Steps S2822 and S2824). On the other hand, in the case where the writing of the receiving data is not normally completed, the data transmitting/receiving unit M15 transmits the NG response signal to the communication processing unit 55 (Steps S2822 and S2812). In other words, in the embodiment, only in the case where the receiving data are normally received and normally written in the memory cell array 132, the OK response signal is transmitted.

The response signal (the NG response signal or the OK response signal) is transmitted in a pulse period of the clock signal CSCK after the unit writing data are received (refer to FIGS. 15A and 15B). In other words, after the storage device 130 receives the unit writing data in synchronization with the clock signal CSCK transmitted from the sub controller 50, next in the pulse period of the clock signal CSCK transmitted from the sub controller 50, the storage device 130 transmits the response signal to the sub controller 50. Herein, in the case where the ID comparison unit M11 or the command analysis/comparison unit M12 determines that there is a communication error in the identification data ID or the command data CM, when the process is ended without the reception of the unit writing data in the storage device 130, the storage device 130 does not make any response to the sub controller 50 in the transmission time period of the response signal. When there is no data exchange between the sub controller 50 and the storage device 130, since the data signal line LD1 is maintained in the low level by the resistor R1 of the sub controller 50, the communication processing unit 55 determines that the NG response signal is transmitted from the storage device 130, so that it may be recognized that there is a communication error. In other words, although there is no consistency in the identification data ID and the command data CM, the NG response signal in Step S2812 is transmitted.

If the data writing is performed on the writing object area, the command analyzing unit M12 of the memory control circuit 136 determines whether or not all the to-be-written data are received (Step S2822). If the EOF data are received, the command analyzing unit M12 determines that all the to-be-written data are received. Alternatively, when the reset signal CRST is detected to be transitioned from the high level to the low level, all the to-be-written data are determined to be received. In the case where all the to-be-written data are received, the memory control circuit 136 ends the writing process. In the case where all the to-be-written data are not received, the memory control circuit 136 returns to Step S2802 to repeat the aforementioned processes with respect to the next unit writing data. For example, the unit writing data D1 and /D1 of the first row are received, and the aforementioned processes are performed. After that, the unit writing data D2 and /D2 of the second row are received, and the aforementioned processes are performed. In addition, the "first row" corresponds to the A1 row of FIG. 8, and the "second row" corresponds to the A2 row. In the embodiment, since the address counter M13 sequentially designates the word address, the writing process is sequentially performed in the order of the A1 row, the A2 row, the A3 row . . . . In addition, after the OK response signal is transmitted (Step S2814), the data transmitting/receiving unit M15 sets the data transmission and reception directions to the direction in which the storage device 130 receives the data from the sub controller 50 in order to receive the next unit writing data.

In addition, the steps of the flowchart illustrated in FIG. 17 may be performed in the order which is arbitrary changed or simultaneously within a range where contradiction does not occur in the process contents. For example, the memory control circuit 136 may generate the mirror data before the OK response signal is transmitted. Alternatively, the memory control circuit 136 may generate the mirror data and, simultaneously, performs the parity check on the existing data.

Figure 18:
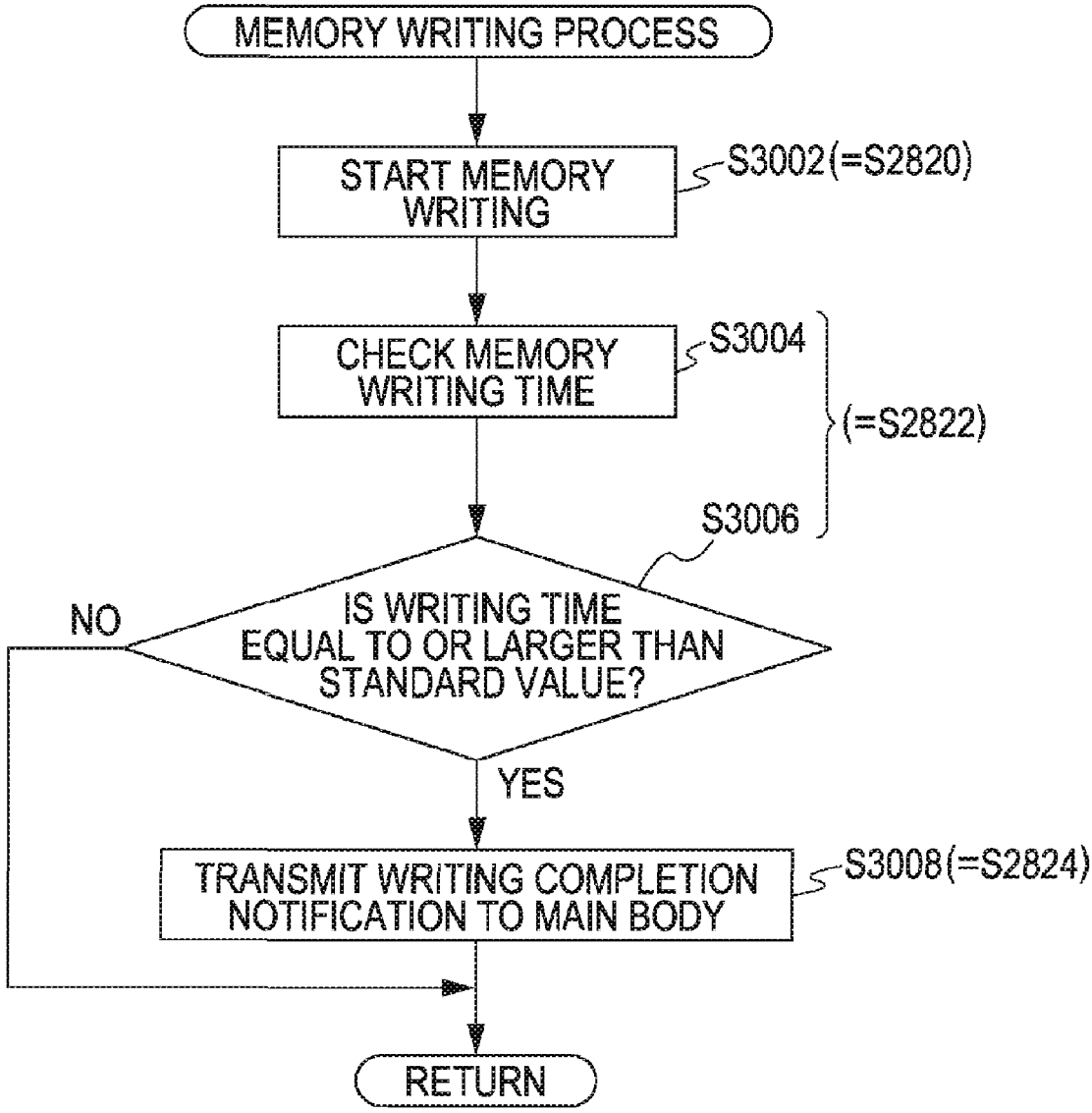
FIG. 18 is a flowchart illustrating details of a procedure of a writing process with respect to a storage device.

FIG. 18 is a flowchart illustrating an example of a specific process of the read/write controller M14 in Steps S2829, S2822, and S2824 of FIG. 17. The read/write controller M14 starts writing of the receiving data in the memory in Step S3002. In Step S3004, it is determined by checking a writing time of the memory (the retention time of the voltage applied to the memory cell) whether or not the writing time in Step S3006 is equal to or larger than a standard value. Herein, the "standard value of the writing time" is a voltage retention time for reliably performing the writing with respect to the memory cell. In the case where the writing time is equal to or larger than the standard value, the writing is determined to be normally performed, so that a writing completion notification (that is, the OK response signal) is transmitted to the communication processing unit 55 of the main body side in Step S3008. On the other hand, in the case where the writing process is ended before the writing time reaches the standard value for some reasons, the writing is determined not to be normally performed, so that the process is ended. In the latter case, as indicated by the broken line in FIG. 15B, the NG response signal is substantially transmitted to the communication processing unit 55. In addition, Step S3002 of FIG. 18 corresponds to Step S2820 of FIG. 17; Steps S3004 and S3006 correspond to Step S2822; and Step S3008 corresponds to Step S2824.

Figure 19:
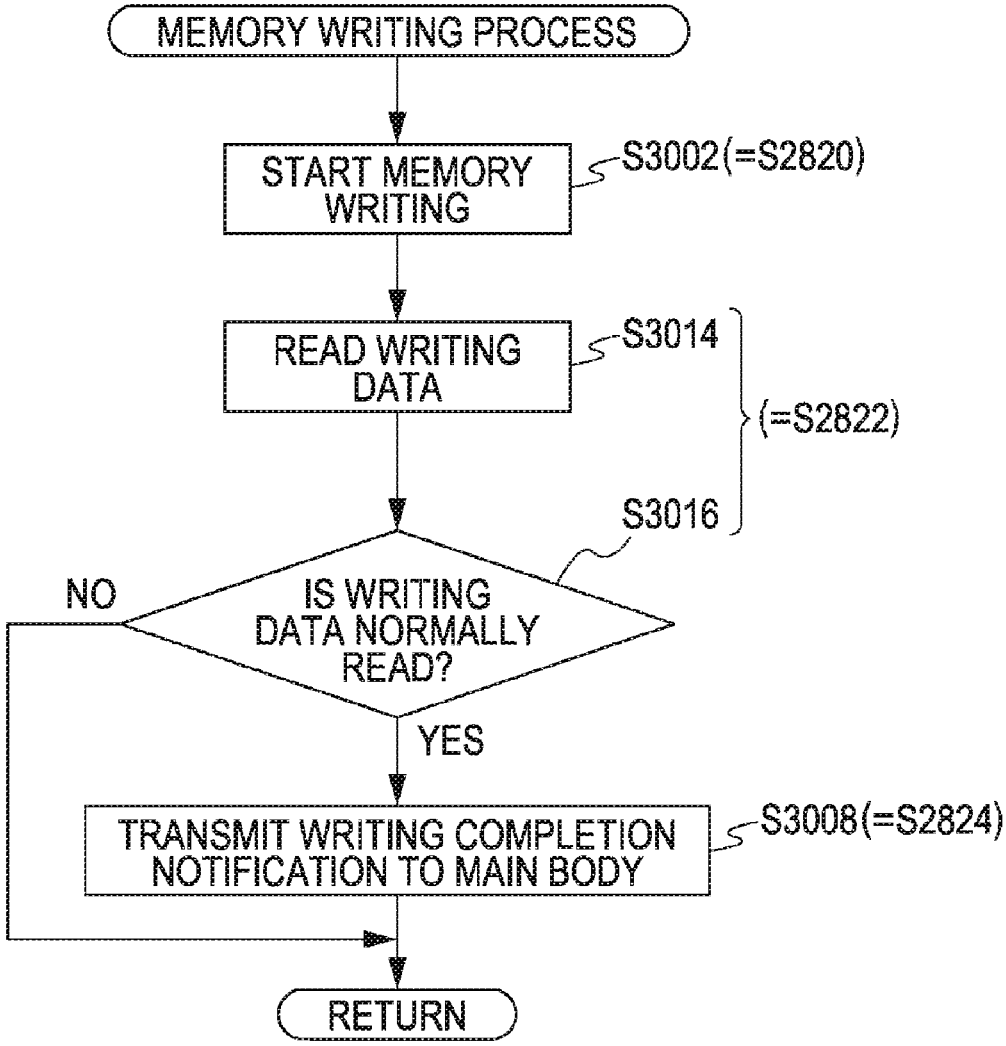
FIG. 19 is a flowchart illustrating details of another procedure of a writing process with respect to a storage device.

FIG. 19 is a flowchart illustrating another example of the detailed processes of the read/write controller M14 in Steps S2829, S2822, and S2824 of FIG. 17. Steps S3002 and S2008 are the same as those in FIG. 18. In Step S3014, the data written in the memory are read, and in Step S3016, it is determined whether or not the written data may be normally read. In the case where the written data are normally read, in Step S3008, a writing completion notification (that is, the OK response signal) is transmitted to the communication processing unit 55 of the main body side. On the other hand, in the case where the written data are not normally read (in the case where the written data and the read data are not equal to each other), the process is ended. In the latter case, the NG response signal is substantially transmitted to the communication processing unit 55. In addition, Step S3002 of FIG. 19 corresponds to Step S2820 of FIG. 17; Steps S3014 and S3016 correspond to Step S2822; and Step S3008 corresponds to Step S2824.

In the writing process with respect to the storage device 130 described above, the storage device 130 checks the consistency between the original data Dn and the inverted data/Dn and transmits the response signal indicating whether or not there is consistency every 16 bits of the original data Dn. As a result, it is possible to improve reliability of communication between the sub controller 50 and the storage device 130. In addition, in the case where there is no consistency between the original data Dn and the inverted data/Dn, since the storage device 130 does not write the original data Dn in the memory cell array 132, it is possible to reduce the possibility that the memory cell array 132 is erroneously updated. In addition, in the writing process with respect to the storage device 130, since the original data Dn and the inverted data/Dn have a relationship such that the corresponding bits are inverted, for example, in the case where a communication error where only one of the low level and the high level occurs on the data signal line LD1 occurs due to the defective contact between the data terminal 260 of the ink cartridge 100 and the corresponding terminal of the side of the printer 20, it is possible to reliably detect the communication error. In addition, since the consistency between the original data Dn and the inverted data/Dn (existence of a communication error) is determined by calculating the Exclusive OR operation of the original data Dn and the inverted data/Dn with respect to each bit thereof, it is possible to easily detect communication error at a high accuracy.

In addition, in the writing process according to the embodiment, the storage device 130 performs the parity check of 16 bits stored in the original data area and the parity check of 16 bits stored in the mirror data area with respect to the existing data of the writing object area. As a result, the rewriting of the existing data is performed on the area in which the parity error is detected, and the writing of new data is performed on the area in which the parity error is not detected. Since it is considered that there is a defect of the memory cell in the area in which the parity error is detected, the parity check may be referred to as a storage area defect a detection unit. As a result, since data updating is not performed on the area in which the defect occurs, it is possible to reduce a possibility that an unexpected defect occurs due to the data updating with respect to the area in which the defect occurs. In addition, the rewriting of the existing data is performed on the area in which the parity error is detected, so that it is possible to reduce a possibility that the data of the area in which the memory cell error occurs are changed due to the data retention defect. Herein, the "data pretension defect" denotes a defect where charges of the memory cell gradually disappear and, thus, the value of the stored data is changed. In the area in which the memory cell error should have occurred, if the data are changed due to the data retention defect, the parity consistency may be inadvertently acquired, so that the memory cell error may not be correctly detected.

As described hereinbefore, at the time of the writing process (FIGS. 15A and 15B), the identification data ID, the inverted identification data/ID, the write command data CM, the inverted write command data/CM, and one set (having a predetermined size) of the writing data D1 and the inverted writing data/D1 are transmitted from the communication processing unit 55 to the storage device 130 in this order, and, after that, the second set of the writing data Dn and the inverted writing data/Dn and the following sets thereof repetitively transmitted set by set. In the examples of FIGS. 15A and 15B, although the data size of one set of the writing data Dn and the inverted writing data/Dn is 32 bits, the one set of data may be set to other data sizes. In addition, the memory control circuit 136 of the storage device 130 does not transmit the result of the consistency determination of the receiving data as the OK response signal or the NG response signal to the communication processing unit 55 after the reception of the identification data ID is started until the reception of the first set of the writing data D1 and the inverted writing data/D1 is completed. The memory control circuit 136 of the storage device 130 transmits the result of the consistency determination to the communication processing unit 55 after the reception of the first set of the writing data D1 and the inverted writing data/D1 is completed. In addition, with respect to the second set of the writing data Dn and the inverted writing data/Dn and the following sets thereof, the result of the consistency determination is transmitted from the memory control circuit 136 to the communication processing unit 55 every time when the reception of each set is completed. In this manner, since the storage device 130 receives the result of the consistency determination to the communication processing unit 55 every time when one set (having a predetermined size) of the writing data Dn and the inverted writing data/Dn is received, it is possible to improve reliability of communication between the communication processing unit 55 and the storage device 130.

In addition, in the initial stage of the writing process, since the result of determination of the data consistency is not transmitted to the communication processing unit 55 after the reception of the identification data ID is started until the reception of the first set of the writing data D1 and the inverted writing data/D1 is completed, it is possible to reduce the number of times of transmission of the result of determination from the storage device 130 to the communication processing unit 55, so that it is possible to efficiently perform the whole of the writing process. In addition, similarly to the reading process, in the writing process, the consistency between the identification data ID and the inverted identification data/ID or the consistency between the write command data CM and the inverted write command data/CM is also determined (refer to Steps S220 to S245 of FIG. 11). In the case where the identification data ID or the write command data CM is not consistent, the memory control circuit 136 ends the process in which the writing of the received data is not performed. In this case, in the transmission time period of the first response signal (the time period after the transmission of the data UD1, /UD1, LD1, and /LD1) of FIGS. 15A and 15B, since the response signal (the OK flag) is not transmitted from the storage device 130 to the communication processing unit 55, the communication processing unit 55 may recognize that there is an error. However, after and before the transmission of the response signal (OK/NG flag), the data transmission direction is changed, and the change of the data transmission direction is likely to generate the so-called bus collision. Therefore, it is preferable that the change of the data transmission direction is reduced if possible. In the embodiment, in the initial stage of the writing process, after the reception of the identification data ID is started until the reception of the first set of the writing data D1 and the inverted writing data/D1 is completed, the result of determination of the data consistency is not transmitted to the communication processing unit 55, so that the frequency of the change of data transmission direction is reduced. Accordingly, reliability or rapidity of communication is increased.

In addition, in the embodiment, as illustrated in FIG. 13, only in the case where the writing data Dn and the inverted writing data/Dn have a relationship of inversion therebetween and there is no parity error in each of the data, an affirmative result of consistency determination is generated. If the consistency determination is performed, it is possible to further improve the reliability of communication. In other words, if 1 bit of the writing data Dn and 1 bit of the inverted writing data/Dn have an error at the same bit position, a result of determination that the writing data Dn and the inverted writing data/Dn are consistent with each other is obtained. However, even in this case, since the error is determined through the parity check, it is possible to prevent erroneous data from being written.

As understood from the description hereinbefore, the original data Dn according to the embodiment corresponds to first data disclosed in the above-described aspects, and the inverted data/Dn according to the embodiment corresponds to second data disclosed in the above-described aspects. In addition, the transmission of the response signals (the OK response signal and the NG response signal) according to the embodiment corresponds to transmission of result of determination disclosed in the above-described aspects.

F. Write Locking Process with Respect to Storage Device

Figure 20:
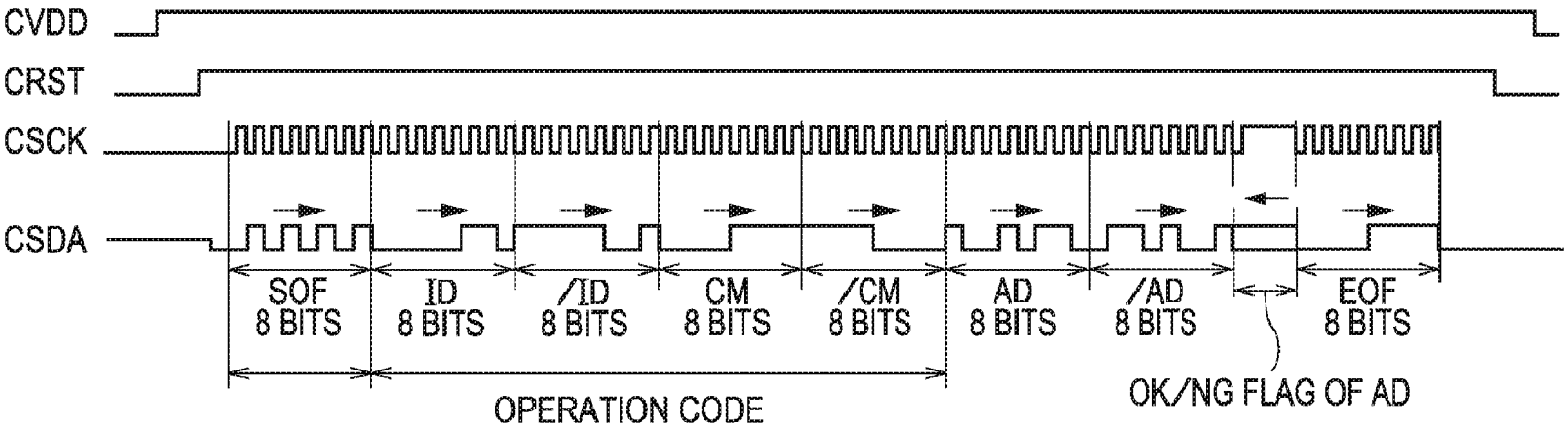
FIG. 20 is a timing chart illustrating schematically illustrating signals which are transmitted and received in a write locking process with respect to a storage device.

FIG. 20 is a timing chart schematically illustrating signals which are transmitted and received between the communication processing unit 55 of the printer 20 and the memory control circuit 136 of the storage device 130 in the write locking process with respect to the storage device. The write locking process is a process of changing the storage area of the rewritable area RWA in the memory map of the memory cell array 132 (FIG. 8) into a write locking area in units of a row. The rows which are changed into the write locking area may not be subject to rewriting through the access of an external unit (for example, the communication processing unit 55 of the sub controller 50).

Similarly to the aforementioned reading process and writing process, first, the communication processing unit 55 sequentially transmits the SOF data, the identification data, and the command data as the data signal CSDA. The command data transmitted in this process are a command (write locking command) indicating the write locking process.

After the command data are transmitted, the communication processing unit 55 transmits the write locking object address data AD and the inverted write locking object address data/AD. The write locking object address data AD are, for example, 8-bit data and data which specify the row which is converted to the write locking area among the rows of the rewritable area RWA. The inverted write locking object address data/AD are 8-bit data obtained by inverting value of each bit of the write locking object address data AD.

After the write locking object address data AD and the inverted write locking object address data/AD are transmitted, the communication processing unit 55 receives a 1-bit response signal from the memory control circuit 136. The response signal (the OK response signal) of the high level indicates that the write locking object address data AD and the inverted write locking object address data/AD are correctly received by the side of the storage device 130. The response signal (the NG response signal) of the low level indicates that the write locking object address data AD and the inverted write locking object address data/AD may not be correctly received by the side of the storage device 130.

In the case where the NG response signal is received, the communication processing unit 55 performs a predetermined error process so as to end the write locking process. The error process may be, for example, a process such as an error process of the time when the NG response signal is received in the aforementioned writing process. On the other hand, in the case where the OK response signal is received, the communication processing unit 55 transmits the EOF (End Of Frame) data to the storage device 130 so as to end the write locking process (FIG. 16).

The processes of the storage device side in the write locking process are performed according to the aforementioned procedure of FIG. 11. In the case of the write locking process, the memory control circuit 136 of the storage device 130 receives the write locking command in Step S240 of FIG. 11. Therefore, in Step S270, the memory control circuit 136 which receives the write locking command performs the write locking process described hereinafter.

If the write locking process is started, the data transmitting/receiving unit M15 of the memory control circuit 136 sequentially reads signals occurring on the data signal line LD1 bit by bit subsequently to the command data in synchronization with the rising edge of the clock signal CSCK and sequentially stores the signals in the input register 152. As a result, the memory control circuit 136 sequentially receives the write locking object address data AD and the inverted write locking object address data/AD.

The data determination unit M19 determines whether or not the result of the Exclusive OR operation between the received write locking object address data AD and the inverted write locking object address data/AD is TRUE, that is, FFh with respect to all the 8 bits. As a result of the determination, in the case where the result of the Exclusive OR operation is not FFh, the data transmitting/receiving unit M15 transmits the NG response signal (the response signal of the low level) to the communication processing unit 55 of the sub controller 50. If the NG response signal is transmitted, the write locking process of the side of the storage device is ended (abnormal ending).

On the other hand, in the case where the result of the Exclusive OR operation is FFh, the read/write controller M14 changes one row (hereinafter, referred to as a "write locking object row") of the rewritable area RWA specified by the write locking object address data AD so as to be set to a write locking area. More specifically, the counter controller M16 sets the counter value of the address counter M13 so that the front end row An (FIG. 8) of the control area CTA is selected. Next, the count up is performed so that the row including the cell which stores the flag of the write locking object row is selected among the control area CTA. After the row including the cell which stores the flag of the write locking object row is selected as the writing object row by the address counter M13, the read/write controller M14 updates the entire one row of the control area CTA so that the flag information of the cell of the write locking object row is changed from "0" to "1".

According to the write locking process described hereinbefore, the main controller 40 changes an arbitrary row in the rewritable area RWA into the write locking area, so that rewriting from an external portion is prevented. As a result, since the data value of the row at a desired timing may be maintained, it is possible to prevent the data value from being incorrectly rewritten.

G. Printing Process of Printer

Figure 21:
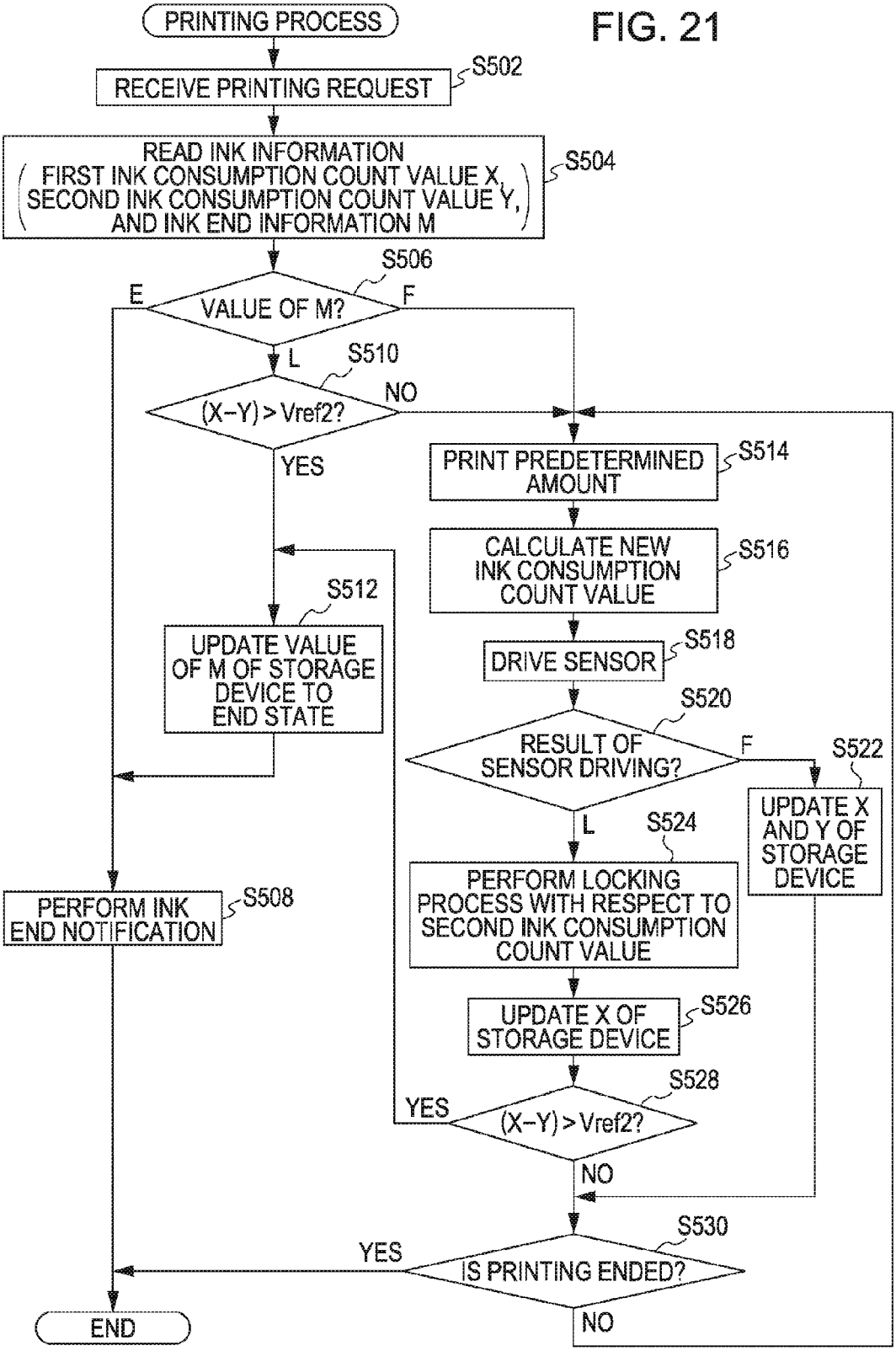
FIG. 21 is a flowchart illustrating process steps of a printing process.

FIG. 21 is a flowchart illustrating process steps of a printing process performed by the main controller 40 as a main component. Although the printing process is described hereinafter by concentrating on one ink cartridge 100 for the convenience of description, in actual cases, the same process may be performed on each of the ink cartridges 100 mounted on the printer 20.

The printing process is started when the main controller 40 receives a printing request from a user through the computer 90 or the manipulation unit 70 (Step S502). If the printing request is received, the main controller 40 performs the aforementioned reading process with respect to the storage device 130 to read the ink information from the storage device 130 of the ink cartridge 100 (Step S504). In addition, instead of performing the reading process with respect to the storage device 130, in Step T110 of FIG. 9, the data stored in the memory in the main controller 40 may be read.

It is preferable that the ink information read in Step S504 includes the first ink consumption count value X and the second ink consumption count value Y in the rewritable area RWA, and the ink end information M. The first and second ink consumption count values X and Y are values indicating a total sum of the consumed ink amount of each ink cartridge 100 obtained based on the consumed ink amount which is estimated by the consumed ink amount estimation unit M3 in the printer 20. The ink end information M is, for example, 2-bit data. M="01" indicates the state (full state) where the remaining ink amount detected by the sensor 110 is larger than the first threshold value Vref1. M="10" indicates the state (low state) where the remaining ink amount is equal to or smaller than the first threshold value Vref1 and the remaining ink amount is larger than the ink end level. M="11" indicates the state (end state) where the remaining ink amount is equal to or smaller than the ink end level.

The main controller 40 determines which one of the full state, the low state, and the end state the value of the ink end information M is (Step S506). If the ink end information M is determined to be in the end state, the main controller 40 performs the ink end notification to the user (Step S508). The ink end notification is performed, for example, by displaying a message of prompting the user to replace the ink cartridge 100 on the display panel of the manipulation unit 70.

If the ink end information M is determined to be in the low state, the main controller 40 determines whether or not a difference value (X-Y) between the first ink consumption count value X and the second ink consumption count value Y is equal to or larger than a second threshold value Vref2 (Step S510). As described later, since the row in which the second ink consumption count value Y of the storage device 130 is stored is locked in writing at the time of detection of the ink end, the second ink consumption count value Y is not updated. In the case where the difference value (X-Y) is equal to or larger than the second threshold value Vref2, the main controller 40 updates the value of the ink end information M of the storage device 130 to the end state (Step S512). More specifically, the main controller 40 performs the writing process with respect to the aforementioned storage device 130 to update the value of the ink end information M to "11". If the value of the ink end information M is updated, the main controller 40 performs the aforementioned ink end notification (Step S508).

On the other hand, in the case where the ink end information M is determined to be in the full state or in the case where the difference value (X-Y) is smaller than the second threshold value Vref2, the main controller 40 performs printing of a predetermined amount among the printing according to the printing request (Step S514). Herein, the "printing of a predetermined amount" is, for example, printing extending in a predetermined length (for example, 2 cm) in the sub scan direction on the printing paper.

If the printing of a predetermined amount is performed, the main controller 40 calculates a new consumed ink amount count value (Step S516). More specifically, the main controller 40 estimates the consumed ink amount according to the printing based on the contents of the performing of the printing of a predetermined amount. The main controller 40 sets the value, which is obtained by adding the count value corresponding to the estimated consumed ink amount to the first ink consumption count value X read from the storage device 130 in Step S504, to the new consumed ink amount count value.

If the new consumed ink amount count value is calculated, the main controller 40 drives the sensor 110 (Step S518). The main controller 40 determines based on the result of the driving of the sensor 110 whether the remaining ink amount of the ink cartridge 100 is equal to or larger than the first threshold value Vref1 (full state) or the remaining ink amount is smaller than the first threshold value Vref1 (low state) (Step S520).

If the remaining ink amount of the ink cartridge 100 is determined to be equal to or larger than the first threshold value Vref1, the main controller 40 updates the first ink consumption count value X and the second ink consumption count value Y stored in the storage device 130 to the new consumed ink amount count value calculated in Step S516 (Step S522). As a result, the values of the first ink consumption count value X and the second ink consumption count value Y become equal to each other.

On the other hand, if the remaining ink amount of the ink cartridge 100 is determined to be smaller than the first threshold value Vref1, the main controller 40 checks whether or not the storage area (A2 row of FIG. 8) which stores the second ink consumption count value Y becomes a write locking area. This checking may be performed with reference to a flag in the control area CTA of the storage device 130 among the data stored in the memory of the main controller 40. In the case where the second ink consumption count value Y does not become the write locking area, a write-locking process with respect to the A2 row which stores the second ink consumption count value Y is performed (Step S524). If the write locking process is performed, the value of the second ink consumption count value Y in the storage device 130 becomes in the non-changeable state. Therefore, the value of the second ink consumption count value Y in the storage device 130 is maintained to be the consumed ink amount count value just before the remaining ink amount is first detected to be smaller than the first threshold value Vref1 by the driving of the sensor 110.

If the write locking process for the second ink consumption count value is ended, the main controller 40 updates the first ink consumption count value X stored in the storage device 130 to the new consumed ink amount count value calculated in Step S516 (Step S526). At this time, the updating of the value of the second ink consumption count value Y in the write-locked state is not performed.

If the value of the first ink consumption count value X is updated, the main controller 40 determines whether or not the difference value (X-Y) between the first ink consumption count value X and the second ink consumption count value Y is equal to or larger than the second threshold value Vref2 (Step S528). The first ink consumption count value X used herein is the value updated in Step S526. On the other hand, the second ink consumption count value Y used herein is a new value among the value read in Step S504 and the value updated in Step S522. In the case where the difference value (X-Y) is equal to or larger than the second threshold value Vref2, the main controller 40 updates the value of the ink end information M of the storage device 130 to an end state (Step S512) and performs the aforementioned the ink end notification (Step S508).

After the first ink consumption count value X and the second ink consumption count value Y are updated in Step S522, or in the case where the difference value (X-Y) is smaller than the second threshold value Vref2 in Step S528, the main controller 40 determines whether or not the printing based on the printing request is entirely ended (Step S530). In the case where the printing is entirely ended, the printing process is ended. In the case where the printing is not entirely ended, the procedure returns to Step S514, and the printing of a predetermined amount is performed again.

As described hereinbefore, in the printer 20 according to the embodiment, in the case where it is determined by driving the sensor 110 that the remaining ink amount of the ink cartridge 100 is smaller than the first threshold value Vref1, the second ink consumption count value Y is not updated, and a prohibition request (the write locking process) is performed with respect to the storage area of the storage device 130 in which the second ink consumption count value Y is stored. As a result, after the prohibition request is performed, the storage device 130 does not receive the updating request with respect to the second ink consumption count value Y. As a result, the second ink consumption count value Y is maintained to be the ink consumption count value just before it is detected by the sensor that the remaining ink amount is smaller than the first threshold value Vref1, so that it is possible to prevent the second ink consumption count value Y from being erroneously updated. In addition, even after the updating the second ink consumption count value Y is stopped, since the first ink consumption count value X is updated, it is possible to accurately recognize the consumed ink amount after it is detected by the sensor that the remaining ink amount is smaller than the first threshold value Vref1, by using the difference value (X-Y). As a result, it is possible to accurately determine the ink end, so that it is possible to use the ink contained in the ink cartridge 100 without waste.

H. Modified Examples

Hereinbefore, the embodiment of the invention is described, but the invention is not limited to the embodiment. Various modifications are available within a range without departing from the spirit of the invention.

First Modified Example

In the embodiment, although the inverted data/Dn of the original data Dn are used as the associated data for checking the consistency with respect to the original data Dn. Instead of the data, other data having a predetermined logical relationship with respect to the original data Dn may also be used. More specifically, the following associated data may be used. (1) a copy of the original data Dn (2) data obtained by adding a predetermined value to the original data Dn (3) data obtained by subtracting a predetermined value from the original data Dn (4) data obtained by multiplying a predetermined value and the original data Dn (5) data obtained by performing predetermined-bit shift on the original data Dn (6) data obtained by performing predetermined-bit rotation on the original data Dn.

In general, the original data Dn and the data associated with the original data Dn may have a predetermined logical relationship so that the existence of the predetermined logical relationship (that is, the consistency between the data) may be determined with respect to the original data Dn and the associated data. However, it is preferable that the original data Dn and the associated data have the same data amount in terms of reliability.

In addition, as the predetermined logical relationship, there is a bi-directional logical relationship such as "inversion", "copy (mirror)", or "bit rotation". Through the bi-directional logical relationship, arbitrary one data of the original data and the associated data (first and second data) may be generated from the other data. In addition, as the predetermined logical relationship, there is a one-directional logical relationship such as "bit shift". Through the one-directional logical relationship, specific one data of the original data and the associated data may be generated from the other data by logical calculation, but the other data may not be generated from the specific one data by logical calculation. It is preferable that the bi-directional logical relationship is employed as the logical relationship between the original data and the associated data.

Second Modified Example

In the embodiment, although the memory cell array 132 is provided with the original data area and the mirror data area, the configuration of the data area in the memory cell array 132 may be variously modified. For example, the memory cell array 132 may be provided with only the original data area. In this case, it is preferable that the memory control circuit 136 includes a copy data generation unit for reading which copies the data stored in the original data area to generate the mirror data dn (copy data) and an inverted data generation unit which inverts each of bits of the data stored in the original data area to generate the inverted data/Dn and the inverted mirror data/dn. Next, in the reading process, in the side of the storage device 130, the data transmitting/receiving unit M15 of the memory control circuit 136 may transmit the data stored in the original data area as the original data Dn to the sub controller 50, and it may transmit the mirror data dn, the inverted data/Dn, and the inverted mirror data/dn, which are generated by using the original data Dn, to the sub controller 50. In addition, after the data read from the original data area is retained in an output register, the data transmitting/receiving unit M15 may transmit the data as the original data, and it may transmit the data retained in the output register as the mirror data.

Alternatively, the memory cell array 132 may be provided with the original data area and the inverted data area. In this case, the read/write controller M14 may store the original data Dn in the original data area, and it may store the inverted data/Dn in the inverted data area. Next, in the reading process, the data transmitting/receiving unit M15 of the memory control circuit 136 may transmit the data read from the original data area as the original data Dn and the data read from the inverted data area as the inverted data/Dn to the sub controller 50, and it may transmit the data read from the same original data area as the mirror data do and the data read from the same inverted data area as the inverted mirror data/dn to the sub controller 50. In this case, the host circuit may detect the communication error or the memory cell error according to Steps S110 to S114 of FIG. 13. In addition, the parity check (Step S126) is performed on the original data and the inverted data which are determined to have a memory cell error, so that it is possible to use the data which has a parity consistency.

In addition, the memory cell array 132 may be provided with the original data area which stores the original data Dn, the inverted data area which stores the inverted data/Dn of the original data Dn, the mirror data area which stores the mirror data dn of the original data Dn, and the inverted mirror data area which stores the inverted mirror data/dn which are the inverted data of the mirror data dn. In this case, the read/write controller M14 and the data transmitting/receiving unit M15 of the memory control circuit 136 may read the stored data as they are and transmit the data.

As understood from the above description, it is preferable that the data of one row (access unit of the memory control circuit 136) of the memory cell array 132 include the original data (first data) and other data (second data) having a predetermined logical relationship with respect to the original data Dn.

Third Modified Example

In the reading process according to the embodiment, although the original data Dn, the inverted data/Dn, the mirror data dn, and the inverted mirror data/dn are transmitted from the storage device 130 to the sub controller 50, various modifications available with respect to the data transmitted in the reading process. For example, only the original data Dn and the inverted data/Dn may be transmitted, but the transmission of the mirror data dn and the inverted mirror data/dn may be omitted. In addition, only the original data Dn and the mirror data dn may be transmitted, but the transmission of the inverted data/Dn and the inverted mirror data/dn may be omitted.

Forth Modified Example

In the writing process according to the embodiment, although 32-bit data are transmitted from the sub controller 50 to the storage device 130 in the order of the original data upper 8 bits UDn, the inverted mirror data upper 8 bits/Udn, the original data lower 8 bits LDn, and the inverted original data lower 8 bits/LDn, the order of transmission may be arbitrarily changed. The 16-bit original data Dn may be first transmitted, and after that, the 16-bit inverted data/Dn may be transmitted. In addition, the inverted data may be first transmitted, and after that, the original data may be transmitted.

In addition, in the writing process according to the embodiment, the 32-bit data are transmitted as one set of the unit data from the sub controller 50 to the storage device 130, and, when the transmission of the unit data is ended, the response signal is transmitted from the storage device 130 to the sub controller 50. However, the data length of the unit data may be arbitrarily changed. For example, the 64-bit original data and the inverted data thereof may constitute a total sum of 128 bits as one unit data.

In the writing process according to the embodiment, both of the actual data and the parity bit which are to be stored in the memory cell array 132 are generated by the side of the printer 20, and the actual data and the parity bit are transmitted to the storage device 130. Alternatively, the printer 20 may generate only the actual data and transmit the actual data to the storage device 130, and the side of the storage device 130 may generate the parity bit. In this case, a parity acquisition unit which generates the 1-bit parity bit matching with the actual data 15 bits transmitted from the printer 20 may be provided in the memory control circuit 136.

Fifth Modified Example

In the embodiment, although the first ink consumption count value X and the second ink consumption count value Y indicating the consumed ink amount are recorded in the memory cell array 132, remaining amount information indicating the remaining ink amount may be recorded. In this case, an initial value of the remaining amount information becomes a value indicating an ink amount charged in the ink cartridge 100. In addition, in the printing process, the printer 20 rewrites the remaining amount information in the direction of decreasing the remaining amount information stored in the memory cell array 132 according to the ink amount consumed by the printing. In this case, it is preferable that the storage area storing the remaining amount information is set to a decrement area. The decrement area is an area in which the rewriting in only the direction of decreasing the value is permitted and the rewriting in the direction of increasing the value is not permitted. It is preferable that, similarly to the increment area according to the embodiment, the decrement area is set according to the writing of the decrement flag information in the read-only area.

Sixth Modified Example

In the embodiment, the second ink consumption count value Y and the first ink consumption count value X are stored in the memory cell array 132, and the ink end is determined based on the difference value (X-Y) (Step S510 of FIG. 19). Alternatively, only the second ink consumption count value Y may be stored in the memory cell array 132. In this case, the value of the first ink consumption count value X may be stored in a non-volatile memory provided to the side of the printer 20, and the same processes as those of the aforementioned embodiment may be performed.

Seventh Modified Example

Various signals which are exchanged in the communication between the storage device 130 and the sub controller 50 according to the embodiment may also modified in various manners. For example, in the examples of FIG. 10 and FIGS.

15A and 15B, although the reset signal CRST is supplied from the sub controller 50 to the storage device 130, the supplying of the reset signal CRST may be omitted. In this case, the reset terminal 240 of the storage device 130, the terminal 440 of the side of the printer 20 corresponding to the reset terminal 240, and the reset signal line LR1 are omitted. In this case, for example, when the storage device 130 is driven by receiving the supplying of the power supply voltage CVDD, the initialization of the storage device 130 may be spontaneously performed by the storage device 130. After that, similarly to the embodiment, at the time of the driving, the storage device 130 which initializes itself may be operated by receiving the supplying of the clock signal CSCK and the data signal CSDA from the sub controller 50.

Eighth Modified Example

In the embodiment, although the storage device 130 is described to be an EEPROM having the memory cell array 132, the invention is not limited thereto. Other types of non-volatile memories such as a flash memory may be used.

Ninth Modified Example

In the embodiment, although the sub controller 50 of the printer 20 is used as a host circuit, an arbitrary circuit such as a calculator may be used as the host circuit. In addition, in the embodiment, although the storage device 130 of the ink cartridge 100 is used as a storage device, an arbitrary non-volatile storage device may be used. In this case, it is effective that the invention is adapted to the configuration where the host circuit and the storage device are electrically connected through a circuit-side terminal electrically connected to the host circuit and a storage-device-side terminal detachable from the circuit-side terminal which is electrically connected to the storage device. Accordingly, the occurrence of a communication error due to a defective contact between the storage-device-side terminal and the circuit-side terminal is detected, so that it is possible to improve reliability of communication between the host circuit and the storage device.

Tenth Modified Example

In the embodiment, the sensor 110 using a piezoelectric element is used. Alternatively, for example, an oscillation device such as an oscillation circuit which returns a response signal of a frequency indicating that ink constantly exists may be used, and a processor such as a CPU or an ASIC or a simpler IC, which performs some communication with the sub controller 50 may be used as a substitute for the sensor 110. In addition, the invention may be adapted to some types of the ink cartridge 100 where a sensor or the like is not mounted and only the storage device is mounted.

Eleventh Modified Example

In the aforementioned embodiment, although an ink jet type printing apparatus and an ink cartridge are employed, a liquid ejecting apparatus which sprays or ejects a liquid other than ink and a liquid container which supplies the liquid to the liquid ejecting apparatus may be employed. The liquid referred herein includes a liquid phase material where particles of functional materials are dispersed in a solvent and a fluid phase material such as a gel phase material. For example, a liquid crystal display, an EL (electroluminescence) display, a surface emission display, a liquid ejecting apparatus which ejects a liquid including a material such as an electrode material or a coloring material used for manufacturing a color filter or the like in a dispersed or dissolved manner, a liquid ejecting apparatus which ejects a bio organic material used for manufacturing a bio chip, and a liquid ejecting apparatus which ejects a liquid which becomes a specimen used as a precision pipette may be employed. In addition, a liquid ejecting apparatus which ejects a lubricant in a precision machine such as a watch or a camera by using a pin point, a liquid ejecting apparatus which ejects a transparent resin solution such as a UV cured resin so as to form a hemispherical micro lens (optical lens) or the like used for an optical communication device or the like, a liquid ejecting apparatus which ejects an acid etchant, an alkali etchant, or the like so as to etch a substrate or the like, and a liquid container which supplies a liquid to the aforementioned liquid ejecting apparatus may be employed. In addition, the invention may be adapted to any types of the ejecting apparatus and the liquid container among the aforementioned ejecting apparatuses and liquid containers. In addition, the invention is not limited to an ink jet type printer, but the invention may be adapted to a laser printer which performs printing using a recording material such as toner and a toner cartridge.

Twelfth Modified Example

In the embodiment, a liquid supply unit is an ink cartridge in which a board is fixed on a liquid receiving container main body, and the board is integrated with the liquid receiving container main body to be attached to a holder disposed to a printing head unit. However, the liquid supply unit which the invention is adapted to may have a configuration where a cover or an adaptor, which the board is fixed to, and a container main body, which contains a liquid, are separately attached to the holder. For example, a configuration where the cover or the adaptor, the board is fixed to, is inserted into the holder in a predetermined insertion direction to be attached thereto and, after that, the container main body is attached to the holder may be used. In this case, a configuration where, if there is no liquid in the container main body, only the liquid receiving container main body is replaced, the liquid consumed amount information (liquid consumption count values X and Y) stored in the storage device are reset according to the replacement may be used.

In addition, in the embodiment, a liquid receiving unit is attached to the holder of the printing head unit and ink is directly supplied from the ink supply unit to the printing head. However, a configuration where the liquid receiving unit may be attached at a position separated from the head in the liquid ejecting apparatus and liquid is supplied to the head through a tube connected to the liquid supply unit of the liquid receiving unit may be used.

Thirteenth Modified Example

In the aforementioned embodiment, the memory control circuit 136 of the storage device 130 includes the ID comparison unit M11, the command analyzing unit M12, and the data determination unit M19. Each of the ID comparison unit M11, the command analyzing unit M12, and the data determination unit M19 may be configured with different hardware. In addition, a portion or all thereof may be configured with common hardware.

Fourteenth Modified Example

In the aforementioned embodiment, a portion of the configuration implement with hardware may be replaced with software. On the contrary, a portion of the configuration implemented with software may be replaced with hardware.

The entire disclosure of Japanese Patent Application No. 2010-118937, filed May 25, 2010 is expressly incorporated by reference herein.

What is claimed is:

1. A storage device being electrically connectable to a host circuit, comprising:

a non-volatile data storage unit;

a data receiving unit which receives data including first data which are to be written in the data storage unit and second data which are generated based on the first data from the host circuit;

a determination unit which determines consistency of the data received by the data receiving unit;

a data transmitting unit which transmits a result of the determination to the host circuit, wherein the determination unit determines whether or not the first and second data are consistent with each other, and wherein in the case where an affirmative determination result is obtained by the determination unit, (1) in the case where writing data in the data storage unit is completed, the data transmitting unit transmits the affirmative determination result to the host circuit, and (2) in the case where the writing data in the data storage unit is not completed, the data transmitting unit does not transmit the affirmative determination result to the host circuit.

2. The storage device according to claim 1, wherein the second data are inverted data of the first data, wherein, at the time of a writing process from the host circuit to the storage device, the data receiving unit receives identification data for designating one storage device among a plurality of the storage devices, inverted identification data, write command data, inverted write command data, a first set of the first data and the second data having a predetermined size in this order from the host circuit, and after that, the data receiving unit repetitively receives a second set and the following sets of the first data and the second data having the predetermined size set by set, wherein (i) after the reception of the identification data is started until the reception of the first set of the first data and the second data is completed, the data transmitting unit does not transmit the result of determination unit to the host circuit, and after the reception of the first set of the first data and the second data having a predetermined size is completed, the data transmitting unit transmits the result of determination unit to the host circuit, and wherein (ii), with respect to the second set and the following sets of the first data and the second data having the predetermined size, every time when the reception of each of the sets is completed, the data transmitting unit transmits the result of determination unit to the host circuit.

3. The storage device according to claim 2, wherein each of the first and second data includes a parity bit, and wherein, only in the case where the first and second data have a relationship of inversion therebetween and there is no parity error in the first and second data, the determination unit generates the affirmative determination result.

4. The storage device according to claim 1, wherein a data amount of the first data is equal to a data amount of the second data.

5. The storage device according to claim 4, further comprising a read/write controller which writes the first data in the data storage unit in the case where the determination result is affirmative and which does not write the first data in the data storage unit in the case where the determination result is negative.

6. The storage device according to claim 4, wherein the first data and the second data are n-bit signals (n is an integer of 1 or more), and wherein the second data are inverted data which are obtained by inverting a value of each bit of the first data.

7. The storage device according to claim 6, wherein the data receiving unit serially receives the first data and the second data in synchronization with a clock signal supplied from the host circuit, and wherein the data transmitting unit transmits the result of the determination to the host circuit in a time period of the next clock signal pulse of a clock signal pulse for receiving the last data among the first data and the second data.

8. The storage device according to claim 6, wherein, in the case where a result of Exclusive OR operation between an m-th value of the first data (m is an integer of 1 or more and n or less) and an m-th value of the second data is TRUE with respect to all n bits, the determination unit determines that the determination result is affirmative, and wherein, in the case where the result of the Exclusive OR operation is FALSE with respect to any one of the n bits, the determination unit determines that the determination result is negative.

9. The storage device according to claim 6, wherein n is an even number, wherein the data receiving unit receives upper n/2 bits of the first data, upper n/2 bits of the second data, lower n/2 bits of the first data, and lower n/2 bits of the second data in this order in synchronization with a clock signal, and wherein the data transmitting unit transmits the determination result in a time period of the next clock signal pulse of a clock signal pulse in which a lowermost bit of the lower n/2 bits of the second data is received.

10. The storage device according to claim 4, wherein the host circuit and the storage device are electrically connected through a circuit-side terminal electrically connected to the host circuit and a storage-device-side terminal electrically connected to the storage device.

11. A board connectable to a liquid ejecting apparatus, comprising:

a non-volatile data storage unit;

a data receiving unit which receives data including first data which are to be written in the data storage unit and second data which are generated based on the first data from the liquid ejecting apparatus;

a determination unit which determines consistency of the data received by the data receiving unit;

a data transmitting unit which transmits a result of the determination to the liquid ejecting apparatus, wherein the determination unit determines whether or not the first and second data are consistent with each other, and wherein in the case where an affirmative determination result is obtained by the determination unit, (1) in the case where writing data in the data storage unit is completed, the data transmitting unit transmits the affirmative determination result to the liquid ejecting apparatus, and (2) in the case where the writing data in the data storage unit is not completed, the data transmitting unit does not transmit the affirmative determination result to the liquid ejecting apparatus.

12. A liquid container attachable to a liquid ejecting apparatus, comprising:

a non-volatile data storage unit;

a data receiving unit which receives data including first data which are to be written in the data storage unit and second data which are generated based on the first data from the liquid ejecting apparatus;

a determination unit which determines consistency of the data received by the data receiving unit;

a data transmitting unit which transmits a result of the determination to the liquid ejecting apparatus, wherein the determination unit determines whether or not the first and second data are consistent with each other, and wherein in the case where an affirmative determination result is obtained by the determination unit, (1) in the case where writing data in the data storage unit is completed, the data transmitting unit transmits the affirmative determination result to the liquid ejecting apparatus, and (2) in the case where the writing data in the data storage unit is not completed, the data transmitting unit does not transmit the affirmative determination result to the liquid ejecting apparatus.

* * * * *